US008502062B2

(12) United States Patent
Mishima et al.

(10) Patent No.: US 8,502,062 B2
(45) Date of Patent: Aug. 6, 2013

(54) ELECTRONIC KEYBOARD MUSICAL INSTRUMENT

(75) Inventors: Junichi Mishima, Iwata (JP); Takashi Fujita, Hamamatsu (JP)

(73) Assignee: Yamaha Corporation (JP)

( * ) Notice: Subject to any disclaimer, the term of this patent is extended or adjusted under 35 U.S.C. 154(b) by 38 days.

(21) Appl. No.: 13/178,586

(22) Filed: Jul. 8, 2011

(65) Prior Publication Data

US 2012/0006185 A1 Jan. 12, 2012

(30) Foreign Application Priority Data

| | | |
|---|---|---|
| Jul. 12, 2010 | (JP) | 2010-157825 |
| Aug. 11, 2010 | (JP) | 2010-180335 |
| Aug. 12, 2010 | (JP) | 2010-181170 |
| Jan. 13, 2011 | (JP) | 2011-004729 |

(51) Int. Cl.
*G10H 1/32* (2006.01)
*G10H 3/00* (2006.01)

(52) U.S. Cl.
USPC ..... 84/743; 84/13

(58) Field of Classification Search
USPC ..... 84/743, 13, 744
See application file for complete search history.

(56) References Cited

U.S. PATENT DOCUMENTS

| | | | |
|---|---|---|---|
| 2005/0069158 | A1 | 3/2005 | Lu et al. |
| 2006/0159295 | A1 | 7/2006 | Onishi et al. |

FOREIGN PATENT DOCUMENTS

| | | | |
|---|---|---|---|
| EP | 1471768 | A1 | 10/2004 |
| GB | 2422265 | A | 7/2006 |
| JP | 2006-148612 | A | 6/2006 |
| JP | 2008-028652 | A | 2/2008 |
| JP | 2008-227832 | A | 9/2008 |
| JP | 2010-068053 | A | 3/2010 |
| WO | 9709857 | A2 | 3/1997 |

OTHER PUBLICATIONS

Extended European Search Report issued in European counterpart application No. EP11173396.0, issued Jul. 31, 2012.

*Primary Examiner* — Jeffrey Donels

(74) *Attorney, Agent, or Firm* — Rossi, Kimms & McDowell LLP

(57) ABSTRACT

An electronic keyboard musical instrument, including: an instrument main body; a keyboard portion including a plurality of keys as performance operating elements; a musical-sound-signal generating portion configured to generate a musical sound signal by a key operation of the keyboard portion; and at least one planar speaker configured to output a sound in accordance with the musical sound signal generated by the musical-sound-signal generating portion, wherein the planar speaker is formed by superposing a plurality of flexible layers that at least include a vibrating layer and electrode layers which sandwich the vibrating layer from opposite sides of the vibrating layer and wherein the planar speaker is disposed at an inside of a casing that constitutes the instrument main body or disposed at a portion of a surface of the casing.

15 Claims, 33 Drawing Sheets

FIG.18A REAR SURFACE

FIG.18B REAR SURFACE

X–X

Y–Y

Z–Z

ELECTRONIC KEYBOARD MUSICAL INSTRUMENT

CROSS REFERENCE TO RELATED APPLICATION

The present application claims priority from Japanese Patent Application No. 2010-157825 filed on Jul. 12, 2010, No. 2010-181170 filed on Aug. 12, 2010, No. 2010-180335 filed on Aug. 11, 2010, and No. 2011-004729 filed on Jan. 13, 2011, the disclosure of which is herein incorporated by reference in its entirety.

BACKGROUND OF THE INVENTION

1. Field of the Invention

The present invention relates to an electronic keyboard musical instrument including a planar speaker such as an electrostatic speaker and configured to output musical sounds or tones from the planar speaker.

2. Discussion of Related Art

As an electroacoustic transducer, a planar speaker with a small thickness is known. For instance, there are known an electrostatic speaker (also referred to as a capacitor speaker) which is actuated by utilizing the Coulomb force with application of a voltage between electrodes, and a planar speaker which utilizes films having a piezoelectric characteristic.

In the planar speaker, the larger an area of a flat plate of the planar speaker becomes, the stronger the sound directivity in a direction perpendicular to the flat plate becomes. As a result, the sound reaches far.

SUMMARY OF THE INVENTION

As the electrostatic speaker, a thin flexible electrostatic speaker has been recently paid attention to. The flexible electrostatic speaker is not only thin and light-weight, but also flexible so as to be bendable. The flexible electrostatic speaker does not suffer from a stress remaining after having been bent and is unlikely to return to its original shape. (Patent Literatures 1 and 2)

There is known a curtain speaker realized by bendably connecting a plurality of electrostatic speakers, utilizing the feature described above. In such a curtain speaker, the sound field is freely controllable. (Patent Literature 2)

In electronic keyboard musical instruments, however, a cone speaker of a dynamic or electrodynamic type has been conventionally used, and no consideration has been given to employment of the planar speaker, such as the electrostatic speaker, in the electronic keyboard musical instruments while making use of the features thereof.

Patent Literature: JP-A-2010-68053

Patent Literature: JP-A-2008-28652

The present invention has been made in view of the situations described above. It is therefore an object of the invention to provide an electronic keyboard musical instrument which makes use of the features of a thin flexible planar speaker.

The object indicated above may be attained according to a principle of the invention which provides an electronic keyboard musical instrument, comprising:

an instrument main body;

a keyboard portion including a plurality of keys as performance operating elements;

a musical-sound-signal generating portion configured to generate a musical sound signal by a key operation of the keyboard portion; and at least one planar speaker configured to output a sound in accordance with the musical sound signal generated by the musical-sound-signal generating portion, wherein the planar speaker is formed by superposing a plurality of flexible layers that at least include a vibrating layer and electrode layers which sandwich the vibrating layer from opposite sides of the vibrating layer, and wherein the planar speaker is disposed at an inside of a casing that constitutes the instrument main body or disposed at a portion of a surface of the casing.

According to the present invention, it is possible to provide an electronic keyboard musical instrument which makes use of the features of the planar speaker.

FORMS OF THE INVENTION

There will be explained various forms of an invention which is considered claimable (hereinafter referred to as "claimable invention" where appropriate). Each of the forms of the invention is numbered like the appended claims and depends from the other form or forms, where appropriate. This is for easier understanding of the claimable invention, and it is to be understood that combinations of constituent elements that constitute the invention are not limited to those described in the following forms. That is, it is to be understood that the claimable invention shall be construed in the light of the following descriptions of various forms and preferred embodiments. It is to be further understood that any form in which one or more elements is/are added to or deleted from any one of the following forms may be considered as one form of the claimable invention.

(1) An electronic keyboard musical instrument, comprising:

an instrument main body (1, 2, 3, 4; 81, 82, 83, 88, 90, 91, 93; 111, 112, 113, 114, 118, 124; 201, 202, 203, 204, 208, 214; 321, 322, 326, 327, 329, 332; 401, 402, 406, 407, 409, 421, 422; 610);

a keyboard portion (4; 114; 204; KB) including a plurality of keys as performance operating elements;

a musical-sound-signal generating portion (63; 123; 213; 303; 493) configured to generate a musical sound signal by a key operation of the keyboard portion; and at least one planar speaker (7; 30; 40; 50A, 50B; 95; 132; 222; 290; 338; 350; 372; 380; 414; 512; 630) configured to output a sound in accordance with the musical sound signal generated by the musical-sound-signal generating portion, wherein the planar speaker is formed by superposing a plurality of flexible layers that at least include a vibrating layer and electrode layers which sandwich the vibrating layer from opposite sides of the vibrating layer.

According to the above form, it is possible to provide an electronic keyboard musical instrument which takes advantage of features of a thin flexible planar speaker.

(2) The electronic keyboard musical instrument according to the form (1), wherein the planar speaker is disposed at an inside of a casing that constitutes the instrument main body or disposed at a portion of a surface of the casing.

According to the above form, it is possible to provide an electronic keyboard musical instrument which takes advantage of the features of the planar speaker, by devising placement and installation structure of the planar speaker.

(3) The electronic keyboard musical instrument according to the form (1) or (2), wherein the planar speaker (630) is disposed at a rear portion of the inside of the casing that constitutes the instrument main body, and is curved so as to be convex, in plan view, in a backward direction of the electronic keyboard musical instrument.

According to the above form, the sound is widely and uniformly emitted rearward and is transmitted efficiently to a performer or player of the electronic keyboard musical instrument.

(4) The electronic keyboard musical instrument according to the form (3), further comprising a first window portion (615) which is provided above a rear portion of the keyboard portion (KB) and through which the sound generated from the planar speaker is transmitted to a performer's side.

According to the above form, the sound efficiently reaches to the performer.

(5) The electronic keyboard musical instrument according to the form (4), further comprising a fall board (620) configured to be slidably movable so as to selectively placed between: a closed state in which the fall board covers the keyboard portion; and an open state in which the fall board opens the keyboard portion for allowing the electronic keyboard musical instrument to be performed, wherein, when the fall board is placed in the open state, a sound emission path (R1) is formed which extends from a region of the planar speaker that is located at a position higher than a rear end portion (622*a*) of the fall board, passes above the fall board, and reaches to the first window portion.

According to the above form, the sound can be efficiently transmitted to the performer's side when the fall board is in the open state such that the keyboard portion is uncovered.

(6) The electronic keyboard musical instrument according to the form (4), further comprising a speaker box (625) which is disposed on a key bed in the inside of the instrument main body and whose rear portion has an upper surface formed as an inclined surface that becomes lower in the backward direction, wherein a rear end portion of the speaker box is located at a position lower than a center position of the planar speaker, and a sound emission path (R4) is formed which extends from the planar speaker, passes above the inclined surface, and reaches to the first window portion.

According to the above form, the sound can be efficiently transmitted to the performer's side where the electronic keyboard musical instrument incorporates the speaker box.

(7) The electronic keyboard musical instrument according to any one of the forms (4)-(6), wherein the planar speaker is disposed so as to be inclined in the backward direction in plan view.

(8) The electronic keyboard musical instrument according to any one of the forms (3)-(7), further comprising a second window portion (617) which is provided at a key slip portion (614) of the instrument main body by which the sound generated from the planar speaker is guided to a performer's side.

According to the above form, the sound efficiently reaches to the performer.

(9) The electronic keyboard musical instrument according to the form (8), further comprising a fall board (620) configured to be slidably movable so as to selectively placed between: a closed state in which the fall board covers the keyboard portion; and an open state in which the fall board opens the keyboard portion for allowing the electronic keyboard musical instrument to be performed, wherein, when the fall board is placed in the open state, a sound emission path (R2) is formed which extends from a region of the planar speaker that is located at a position lower than a rear end portion (622*a*) of the fall board, passes below the fall board, and reaches to the second window portion.

According to the above form, the sound can be efficiently transmitted to the performer's side when the fall board is in the open state such that the keyboard portion is uncovered.

(10) The electronic keyboard musical instrument according to the form (2), wherein the casing includes a side-surface portion (1; 81, 82, 83; 111, 112*b*, 113*c*, 113*d*, 115), a roof portion (2; 91; 112), and a bottom-surface portion (3; 113), and wherein the planar speaker is disposed at least one of the side-surface portion, the roof portion, and the bottom-surface portion.

According to the above form, the sound is outputted from the planar speaker disposed at the casing of the instrument main body other than the keyboard portion, so that the sound is heard as if the casing surface of the electronic keyboard musical instrument resounds, like a soundboard of an acoustic keyboard musical instrument. Accordingly, the present electronic keyboard musical instrument is capable of generating the sound which resembles a sound of the acoustic musical instrument.

Because the plane wave is generated from the planar speaker, the sound generated from the planar speaker is less likely to be attenuated even if a listening position is distant from the electronic keyboard musical instrument. On the other hand, even if the listening position is close to the electronic keyboard musical instrument, the sound generated from the planar speaker is not felt noisy.

The planar speaker is a thin speaker with a small thickness having an approximately two dimensional plane and is constituted by a laminated structure composed of a plurality of thin materials each having flexibility. Further, while the planar speaker has a flat-plate shape which is flat and thin, the planar speaker may have a shape having a curved surface obtained by curving a thin flat plate (i.e., a curved speaker in which the directivity is broadened at a wide angle) or may have a shape having an arbitrary curved surface. Concretely, the planar speaker includes an electrostatic speaker and a speaker using piezoelectric films.

The side-surface portion indicated above includes a front portion and a rear-surface portion of the casing, except for a roof plate portion (top plate) and a bottom-surface portion of the casing. Accordingly, examples of the planar speaker include a large roof plate speaker, a roof plate (top plate) speaker, a rear-surface speaker, a front plate speaker, a side plate speaker, and a bottom-surface speaker.

The sound pressure of the planar speaker largely attenuates in a bass range and becomes larger with an increase in a frequency. In a treble range, however, a flat frequency characteristic is exhibited due to area interference. Here, as the area of the planar speaker (namely, the area of the vibrating layer) increases, the sound pressure in the bass range becomes higher by an amount corresponding to the increased area.

The electronic keyboard musical instrument has a large width in a direction of arrangement of keys of the keyboard portion (hereinafter referred to as "the key arrangement direction" where appropriate). Accordingly, where the planar speaker is disposed such that one side of the planar speaker is disposed along the key arrangement direction, it is possible to enlarge the area of the planar speaker. An electronic keyboard musical instrument of an upright type has a height that is commensurate to a height of a performer or player. Accordingly, where the planar speaker is disposed such that one side of the planar speaker is disposed along a height direction of the casing, it is possible to enlarge the area of the planar speaker. An electronic keyboard musical instrument of a grand piano type has a large depth. Accordingly, where the planar speaker is disposed such that one side of the planar speaker is disposed along a depth direction of the casing, it is possible to enlarge the area of the planar speaker.

(11) The electronic keyboard musical instrument according to the form (10), wherein the roof portion includes a roof plate (2) at which the planar speaker is disposed, wherein the roof plate is attached to the instrument main body so as to be pivotable about an axis that extends along one side of the roof plate, such that the roof plate opens and closes an upper portion of the instrument main body, and wherein the planar speaker disposed at the roof plate is provided along a back surface of the roof plate and is exposed to an exterior when the upper portion of the instrument main body is opened by a pivotal movement of the roof plate.

The back surface of the roof plate of the musical instrument such as a grand piano increases the area of the planar speaker to be provided. According to the above form, therefore, it is possible to raise the sound pressure in the bass range in accordance with an increase in the area of the planar speaker.

Since the plane wave emitted from the planar speaker has acute directivity, the location of the planar speaker that assures both of the performer and audience of good sound reception is the back surface of the roof plate.

Since the roof plate opens and closes the upper portion of the instrument main body, the planar speaker disposed at the back surface of the roof plate is accommodated in the instrument main body when the roof plate closes the upper portion. Accordingly, the planar speaker not in use is protected from the exterior by the roof plate.

(12) The electronic keyboard musical instrument according to the form (10), wherein the planar speaker is disposed at a position where an inner space (102; 124) and the exterior are partitioned, and the sound outputted from the planar speaker propagates to both of the inner space and the exterior.

According to the above form, the electronic keyboard musical instrument does not have any partition plate that isolates the inner space from the exterior, and the planar speaker is disposed at a position where the planar speaker per se partitions the inner space and the exterior from each other. Accordingly, in addition to the sound emitted from the front surface (outer-side surface) of the planar speaker, the sound emitted from the rear surface (inner-side surface) of the planar speaker propagates through the inner space. As a result, a casing portion at which the planar speaker is not disposed is vibrated so as to permit the sound to be emitted to the exterior, or the sound is reflected by a part of the casing portion so as to be emitted to the exterior. Further, the sound is emitted to the exterior from an opening portion through which the inner space is open to the exterior.

Accordingly, the level of the sound outputted from the entirety of the casing becomes high.

(13) The electronic keyboard musical instrument according to the form (10), wherein the side-surface portion includes a left side-surface portion (82) and a right side-surface portion (82), wherein the electronic keyboard musical instrument further comprises a lid body (83) disposed so as to cover the planar speaker disposed along the side-surface portion of the casing, wherein the lid body is configured to be moved selectively between a position at which the planar speaker is exposed to an exterior and a position at which the planar speaker is not exposed to the exterior, and wherein the planar speaker and the lid body are disposed at least one of the left side-surface portion and the right surface-side portion.

According to the above form, the lid body opens and closes the planar speaker at least one of the left side-surface portion and the right side-surface portion. Accordingly, the planar speaker not in use is covered or closed by the lid body, so as to be protected from the exterior.

It is noted that, in some cases, a member (a side plate) which partially encloses the inner space is not provided at the left side-surface portion or the right surface-side portion at which the planar speaker and the lid are disposed.

The planar speaker may emit the sound with the lid body open or may emit the sound with lid body closed.

(14) The electronic keyboard musical instrument according to the form (13), wherein the lid body is configured to pivot about an axis that extends along one side of the at least one of the left side-surface portion and the right surface-side portion.

According to the above form, where the lid is opened widely, the propagation direction of the sound outputted from the planar speaker is broadened, enriching the sound. When the lid is closed, the instrument as a whole becomes compact and the planar speaker not in use is accommodated so as to be protected from the exterior.

(15) The electronic keyboard musical instrument according to the form (10), wherein the side-surface portion includes a left side-surface portion, a right side-surface portion, and a rear-surface portion, wherein the planar speaker is disposed at (a) at least one of the left side-surface portion and the right side-surface portion and (b) the rear-surface portion, and wherein the electronic keyboard musical instrument further comprises an acoustic reflection plate (101) configured to pivot about an axis that extends along adjoining sides of the left side-surface portion and the rear-surface portion at which the planar speaker is disposed and/or an axis that extends along adjoining sides of the right side-surface portion and the rear-surface portion at which the planar speaker is disposed.

According to the above form, the acoustic reflection plate acts on: a first planar speaker disposed at least one of the left side-surface portion and the right side-surface portion; and a second planar speaker disposed at the rear-surface portion.

By adjusting the rotational angle of the acoustic reflection plate depending upon the position where an audience is present, it is possible to change the propagation direction of the sound outputted from each of the first and second planar speakers to a direction in which the audience is present. The acoustic reflection plate is capable of serving as a lid for the first planar speaker or the second planar speaker not in use, so as to protect the planar speaker from the exterior.

(16) The electronic keyboard musical instrument according to the form (1) or (2), further comprising:

a left leg body (402) and a right leg body (402) which support the instrument main body at a left portion and a right portion of the instrument main body, respectively; and a holding portion (411*b*, 423, 431, 433, 444; 515, 517, 518, 519, 520, 521) configured to hold the planar speaker in an arbitrary state between the left leg body and the right leg body.

The above form ensures good sound propagation efficiency with respect to the performer, by providing the planar speaker between the left leg body and the right leg body.

(17) The electronic keyboard musical instrument according to the form (16), wherein the holding portion is configured to hold not only the planar speaker in a state before a configuration of a plane of the planar speaker changes, but also the planar speaker in a state after the configuration of the plane of the planar speaker has been changed.

The holding portion described above holds the planar speaker which is disposed between the left leg body and the right leg body and which has a flat and thin plate-like shape, so as to maintain the state of the planar speaker after the shape of the planar speaker has been changed due to the change of the configuration of the plane of the planar speaker.

The left leg body and the right leg body which support the instrument main body at the left portion and the right portion are not limited to bar-like leg bodies. Left and right side plates may function as the leg bodies.

(18) The electronic keyboard musical instrument according to the form (17), wherein the holding portion is configured to hold the planar speaker at least in a state in which the plane of the planar speaker is located on one flat plane.

By thus holding, between the left leg body and the right leg body, the planar speaker in a state in which the plane thereof is located on one flat plane, the sound propagation efficiency with respect to the performer becomes better.

(19) The electronic keyboard musical instrument according to the form (18), wherein the holding portion is configured to hold the planar speaker at least in a state in which the plane of the planar speaker is bent as a whole.

The planar speaker in a state in which the plane thereof is located on one flat plane outputs the sound wave close to the plane wave. On the other hand, in the planar speaker in a state in which the plane thereof is bent as a whole, the sound output direction is not identical among local regions in the plane. Accordingly, depending upon the bent state of the plane of the planar speaker, the directivity angle becomes large, as compared with the plane wave when the plane of the planar speaker is located on flat plane, or the planar speaker has the directivity angle in a plurality of directions.

Therefore, the sound propagation direction can be variously changed depending upon the holding state of the planar speaker, thereby ensuring good sound propagation in a direction in which the performer or the audience is present.

The planar speaker indicated above includes at least one planar-speaker unit, and the planar-speaker unit has flexibility and is bendable or foldable.

Since the planar speaker is thin and has a large surface area, it may be inconvenient to accommodate the planar speaker as it is. However, the present planar speaker is flexible and bendable. Therefore, where the planar speaker is kept in the bent state, the planar speaker can be accommodated or stored in a compact shape, when not in use. By arranging the planar speaker to be foldable, it is possible to further enhance accommodation or storage efficiency.

(20) The electronic keyboard musical instrument according to the form (18), wherein the planar speaker is constituted by a plurality of planar speaker panels ($413_1$, $413_2$, $413_3$, $413_4$) each of which is constituted such that respective peripheries of a plurality of planar speaker portions ($414_1$, $414_2$, $414_3$, $414_4$) of the planar speaker are supported by respective frames ($415_1$, $415_2$, $415_3$, $415_4$), wherein a connected planar speaker panel which is constituted by at least two of the plurality of planar speaker panels is constituted such that respective frames of any adjacent planar speaker panels are connected by connecting members (424, 425, 426), wherein an upper end of the connected planar speaker panel is held between the left leg body and the right leg body so as to be a fixed end while a lower end of the connected planar speaker panel is a free end, and wherein the holding portion is configured to hold the connected planar speaker panel at least in a state in which planes of the respective planar speaker portions of the planar speaker panels of the connected planar speaker panel are bent as a whole.

According to the above form, the planar speaker is divided into the plurality of planar speaker portions, and the periphery of each of the divided planar speaker portions is supported by the corresponding frame. Therefore, the above form not only increases the mechanical strength of the planar speaker, but also facilitates handling of the planar speaker when the planar speaker is deformed into a state in which the plane thereof is kept bent.

(21) The electronic keyboard musical instrument according to the form (20), further comprising guide members (423) provided on the left leg body and the right leg body, respectively, wherein the connected planar speaker panel includes, at a left end and a right end thereof, guided members (425, 427) whose movements are regulated by the corresponding guide members, wherein the connected planar speaker is configured such that the guided members move relative to the corresponding guide members while the movements of the guided members are regulated by the corresponding guide members, so that a state of the planar speaker changes, and wherein the connected planar speaker is held in a state in which the planes of the respective planar speaker portions of the planar speaker panels of the connected planar speaker panel are bent as a whole.

According to the above form, the guided members move relative to the guide members while being regulated by the guide members, whereby the states of the respective planar speaker panels always change in the same way. In particular, where the number of the planar speaker panels is three or more, the state in which the planes of the respective planar speaker portions are bent as a whole can be formed into a state in which the planes are alternately bent in a zigzag fashion.

Here, the state in which the planes of the respective planar speaker portions are bent as a whole is realized by holding a connected position of each guided member with respect to the corresponding guide member or by permitting the connecting member to hold a connection angle at which adjacent frames are connected to each other.

(22) The electronic keyboard musical instrument according to the form (18), wherein an upper end of the planar speaker is held between the left leg body and the right leg body so as to be a fixed end while a lower end of the planar speaker is a free end, wherein the electronic keyboard musical instrument further comprises: a guide member (518) configured to come into contact with a plane of the planar speaker so as to place the plane of the planar speaker in a bent state; and a connecting member (519, 521) configured to be connected to the lower end of the planar speaker, and wherein the lower end is connected to the connecting member after the plane of the planar speaker has been bent, whereby the planar speaker is held in the state in which the plane thereof is bent.

According to the above form, it is possible to easily realize the state in which the plane of the planar speaker is bent by utilizing flexibility of the planar speaker.

(23) An electronic keyboard musical instrument, comprising:

an instrument main body (201, 202, 203, 204, 208, 214);

a keyboard portion (204) including a plurality of keys as performance operating elements;

a musical-sound-signal generating portion (213, 303) configured to generate a musical sound signal by a key operation of the keyboard portion;

an internal speaker (210) configured to output a sound in accordance with the musical sound signal generated by the musical-sound-signal generating portion;

a first output terminal (309L, 309R) configured to amplify the musical sound signal generated by the musical-sound-signal generating portion and output the amplified signal to an exterior;

a second output terminal (242, 253, 336) configured to output a drive signal to a planar speaker which is formed by superposing a plurality of flexible layers that at least include a vibrating layer and electrode layers which sandwich the vibrating layer form opposite sides of the vibrating layer; and a planar-speaker drive circuit in which the musical sound signal generated by the musical-sound-signal generating portion is amplified, the amplified signal is boosted by a booster portion, and the drive signal on which a high bias voltage is superimposed is supplied to the second output terminal.

According to the above form, the electronic keyboard musical instrument is equipped with the second terminal. Accordingly, by connecting an input terminal of the planar speaker such as an electrostatic speaker to the second output terminal, the sound of the musical instrument can be generated from the planar speaker. The second output terminal is preferably disposed at a position of the instrument main body facing the exterior, thereby facilitating connection of the input terminal to the second output terminal.

(24) The electronic keyboard musical instrument according to the form (23), wherein the planar speaker is detachable from the casing and is disposed outside the casing.

The planar speaker having a planar shape generates the plane wave. Accordingly, the sound generated from the planar speaker is less likely to be attenuated even if a listening position is distant from the electronic keyboard musical instrument while the sound generated from the planar speaker is not felt noisy even if the listening position is close to the electronic keyboard musical instrument. On the other hand, in a curved speaker having a curved surface, the directivity of the sound wave is broadened at a wide angle on a convex-surface side of the curved surface while the sound wave converges on a concave-surface side of the curved surface.

The first output terminal is a conventional output terminal which is configured to output to headphones, monitor speakers, keyboard amplifiers, etc., which has relatively low impedance, and on which a bias voltage is not superimposed. Accordingly, where the planar speaker is an electrostatic speaker, it is impossible to reproduce a sound with a sufficient volume even if the planar speaker is connected to the first output terminal.

Therefore, by providing the above-indicated second output terminal, it is possible to dispose the electrostatic planar speaker outside the casing of the electronic keyboard musical instrument.

The planar speaker is disposed outside the casing of the instrument main body of the electronic keyboard musical instrument. For instance, the planar speaker may be disposed along an outer surface of the casing or may be disposed at a position distant or away from the casing.

The planar speaker of the electrostatic type is disposed outside the casing of the instrument main body of the electronic keyboard musical instrument as described above, whereby the area of the planar speaker (i.e., the area of the vibrating layer) can be enlarged, resulting in an increase of the sound pressure in the bass range.

(25) The electronic keyboard musical instrument according to the form (23) or (24), wherein the casing of the instrument main body includes a plurality of retaining portions (208*c*, 208*d*);

wherein the planar speaker includes a plurality of engaging portions (221*c*, 221*f*) corresponding to the plurality of retaining portions;

wherein each of the retaining portions is provided with the second output terminal (242, 253) for a corresponding one of electrodes (222*a*, 222*b*) of the planar speaker, wherein each of the engaging portions is provided with an input terminal (241, 251) which is connected to a corresponding one of the electrodes of the planar speaker, the input terminals of the engaging portions respectively corresponding to the second output terminals of the retaining portions, and wherein the planar speaker is attached to and held by the electronic keyboard musical instrument by engagement of the engaging portions and the retaining portions.

According to the above form, the engaging portions and the retaining portions realize, at the same time, both of a mechanism in which the planar speaker is attached to and held by the electronic keyboard musical instrument; and electric connection for supplying the drive signal of the planar speaker.

Further, the output terminals are provided independently for the electrodes of the planar speaker. Accordingly, even if a high voltage is being applied between the electrodes in a working operation for permitting the planar speaker to be attached to and held by the musical instrument, there is no risk of giving a worker an electric shock.

(26) The electronic keyboard musical instrument according to the form (24), wherein the planar speaker is constituted by a plurality of planar-speaker units continuously connected by bendable continuous portions (290C; 350C; 372C; 380C), and wherein the plurality of planar-speaker units are connected to an input terminal (364) which corresponds to the second output terminal, such that corresponding electrodes of any adjacent planar-speaker units are connected to each other.

According to the above form, the sound propagation direction can be changed depending upon a bending angle of the planar speaker. Further, the planar speaker can be folded in a compact shape when not in use.

(27) The electronic keyboard musical instrument according to the form (1) or (2), wherein the casing includes: a bottom surface portion (611); an upper surface portion; a side surface portion (613*p*) including a left surface portion (639L), a right surface portion (639R), and a rear surface portion (613); and a front surface portion having a first window portion, wherein the planar speaker is disposed at a rear portion of the inside of the casing along at least the rear surface portion, and wherein a sound emission path is formed so as to extend from the planar speaker to the first window portion.

(28) The electronic keyboard musical instrument according to the form (27), wherein sound emission holes (613*a*) are formed in at least one of the rear surface portion, the left surface portion, and the right surface portion, for permitting the sound generated from the planar speaker to be transmitted to an outside of the casing.

The reference signs in the brackets attached to respective constituent elements of the musical instrument in the above description correspond to reference signs used in the following embodiments to identify the respective constituent elements. The reference sign attached to each constituent element indicates a correspondence between each element and its one example, and each element is not limited to the one example.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

First Embodiment

Referring to the external view of FIG. 1, there will be explained an electronic keyboard musical instrument of a grand piano type constructed according to a first embodiment of the present invention.

Figure 1:
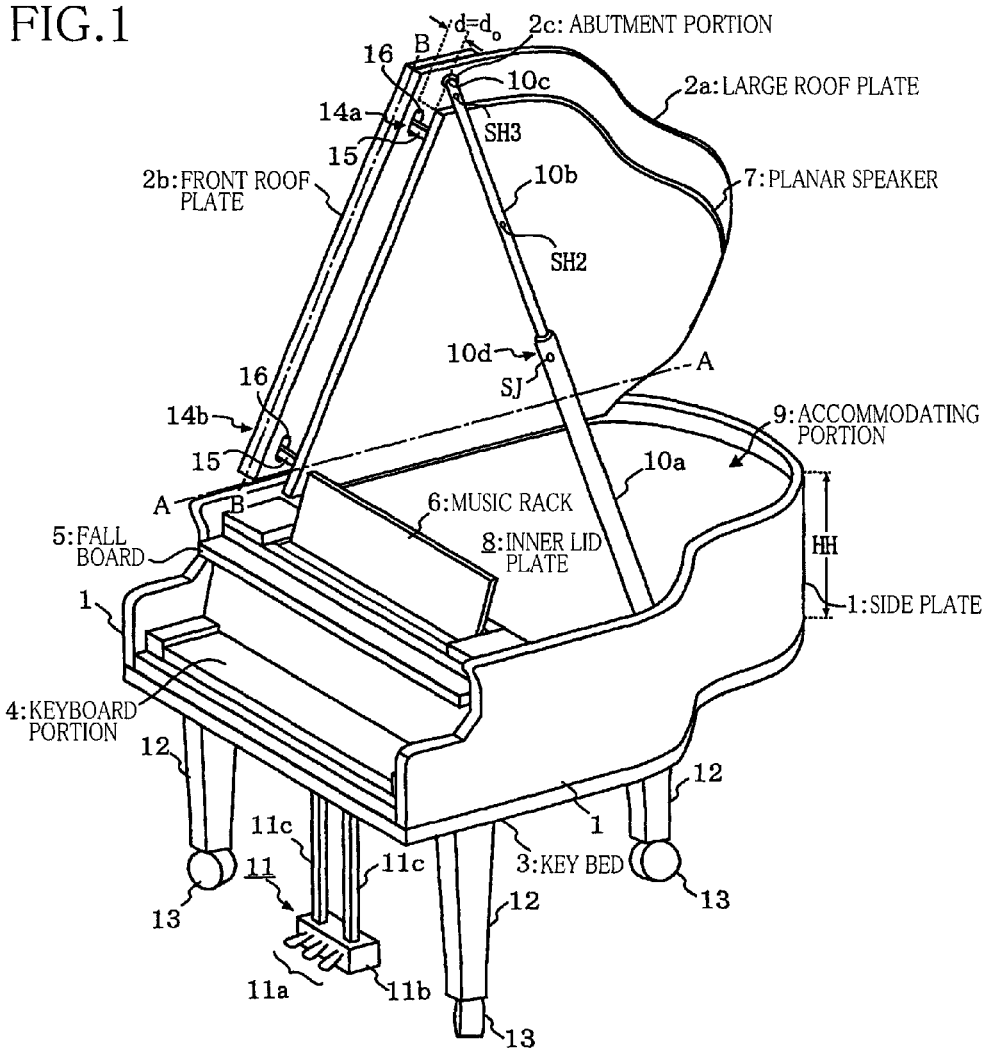
FIG. 1 is an external view of an electronic keyboard musical instrument of a grand piano type according to a first embodiment of the invention.

In FIG. 1, the reference numerals 1, 2, 2*a*, and 2*b* respectively denote a side plate (side-surface portion), a roof plate (roof portion), a large roof plate, and a front roof plate. The large roof plate 2*a* is attached to an instrument main body so as to be pivotable about a linear axis A-A that extends along a left side thereof. The front roof plate 2*b* is attached to the large roof plate 2*a* so as to be pivotable about a linear axis B-B that extends along a front side thereof.

Reference numerals 3, 4, 5, and 6 respectively denote a key bed (bottom-surface portion), a keyboard portion (in which illustration of white keys and black keys are omitted), a fall board, and a music rack. When the fall board 5 is open as shown in FIG. 1, a front plate portion is hidden behind the fall board 5. The side plate (side-surface portion) 1 includes the front plate portion. A joint between the side plate 1 and the key bed 3 is made invisible by bonding a decorative plate to the side plate 1 and the key bed 3.

The instrument main body includes the side plate (side-surface portion) 1, the roof plate (roof portion) 2, the key bed (bottom-surface portion) 3, the keyboard portion 4, and an inner space.

The roof plate (roof portion) 2 is configured to open and close an upper portion of the instrument main body. The music rack 6 is configured to be slidable backward and foldable.

In the present embodiment, a planar speaker 7 is disposed at the large roof plate 2*a* (roof portion). The planar speaker 7 is coupled to the large roof plate 2*a* so as to be movable with respect to the large roof plate 2*a*. The planar speaker 7 and the large roof plate 2*a* face each other with a distance d interposed therebetween. The distance d between the large roof plate 2*a* and the planar speaker 7 disposed at the large roof plate 2*a* is made larger when the large roof plate 2*a* opens an inner lid plate 8 (corresponding to the upper portion of the instrument main body) such that the inner lid plate 8 is exposed to an exterior (d=do) than when the large roof plate 2*a* covers the inner lid plate 8 (d=dc). The above-indicated distance is hereinafter referred to as a "spacing distance" where appropriate.

The planar speaker 7 outputs a sound not only from its front surface, but also from its rear surface. In the planar speaker 7, an air spring formed by an air layer present on its rear-surface side and a vibrating plate resonate, and a sound pressure is lowered in a frequency range lower than the resonance frequency. Here, the resonance frequency becomes higher as the thickness of the air layer on the rear-surface side becomes smaller.

Accordingly, when the electronic keyboard musical instrument is played with the large roof plate 2*a* opened, the air layer with a sufficient thickness (e.g., several centimeters) needs to be formed on the rear-surface side of the planar speaker 7. When the above-indicated spacing distance d is large, a part of the sound outputted from the rear surface of the planar speaker 7 is emitted to the exterior from a spacing between the rear surface of the planar speaker 7 and the large roof plate 2*a*. Accordingly, since the spacing distance is large when the large roof plate 2*a* is opened, sound generation efficiency is enhanced and, spreading of the sound is expected.

On the other hand, since the spacing distance d is small when the large roof plate 2*a* is closed, namely, when the large roof plate 2*a* is laid down, it is possible to enhance an accommodation efficiency of the instrument main body. Hence, a height HH of the side plate 1 (FIG. 1) can be made small.

Next, the structure of the electronic keyboard musical instrument according to the present embodiment is specifically explained.

The planar speaker 7 is disposed along the back surface of the large roof plate 2*a* so as to be in parallel therewith, and is exposed to the exterior when the upper portion of the instrument main body is opened by a pivotal movement of the large roof plate 2*a*.

In the illustrated embodiment, in a state in which the large roof plate 2*a* is opened, the inner lid plate 8 of the instrument main body is exposed to the exterior. The inner lid plate 8 and the side-surface portion 1 constitute an accommodating portion 9 for accommodating the planar speaker 7.

The reference numeral 10 denotes a prop stick. A proximal end of a prop-stick lower portion 10*a* is pivotably supported by an edge portion of the inner lid plate 8. The prop stick 10 is detachable from the inner lid plate 8.

A user or performer brings a top end 10*c* of a prop-stick upper portion 10*b* into an abutting contact with an abutment portion 2*c* provided on the back surface of the large roof plate 2*a*, whereby the large roof plate 2*a* is supported by the prop stick 10. The prop stick 10 is telescopically arranged such that the prop-stick upper portion 10*b* is advanceable and retractable with respect to an upper end 10*d* of the prop-stick lower portion 10*a*. The prop-stick lower portion 10*a* and the prop-stick upper portion 10*b* are held by a stopper shaft SJ that is fitted in any one of stopper holes SH1, SH2, SH3 formed in the prop-stick upper portion 10*b*. In FIG. 1, the stopper shaft SJ is fitted in the stopper hole SH1 (which is invisible, being hidden by the prop-stick lower portion 10*a*). When the stopper shaft SJ is fitted in the stopper hole SH3, the prop stick 10 is shortened, so that the prop stick 10 can be accommodated in the accommodating portion 9.

The reference numeral 11 denotes a pedal unit in which three pedals 11*a* are accommodated. A pedal box 11*b* is attached to the key bed 3 through pedal legs 11*c*. Three legs 12 have respective casters 13 at lower ends thereof, and the legs 12 are attached at upper ends thereof to the key bed 3.

The instrument main body incorporates a musical-sound-signal generating portion for generating a musical sound signal in accordance with a key operation by the user with respect to the keyboard portion 4. The planar speaker 7 outputs a sound corresponding to the musical sound signal outputted by the musical-sound-signal generating portion.

The planar speaker 7 may be disposed at the side plate (side-surface portion) 1 or the key bed (bottom-surface portion) 3, or may be disposed at a plurality of locations.

For instance, a multiplicity of through-holes (sound holes) may be formed at a specific portion of the key bed 3 corresponding to an underside of the keyboard portion 4 shown in FIG. 1. The planar speaker 7 may be disposed by attachment to the specific portion of the key bed 3 so as to be opposed to the through-holes, with or without a net-like protection plate interposed therebetween.

Such an arrangement causes slight vibration of the keyboard, on the upper side of the planar speaker, and there is obtained an effect in which the musical sound can be heard leaking from between the keys. At the same time, the musical sound is emitted from the planar speaker toward the floor surface. Accordingly, there is obtained an effect of feeling or sensing a direct sound and a reflected sound from the floor surface.

Further, one or more conventional dynamic (electrodynamic) cone speakers different from the planar speaker may be additionally disposed for reproduction of a bass range. In this instance, the sound holes may be formed in the inner lid plate 8, and the cone speakers may be disposed such that cone portions thereof are open through the sound holes. Alternatively, the sound holes may be formed in the lower surface of the key bed 3, and the cone speakers may be disposed such that the cone portions are open through the sound holes.

Figure 2A:
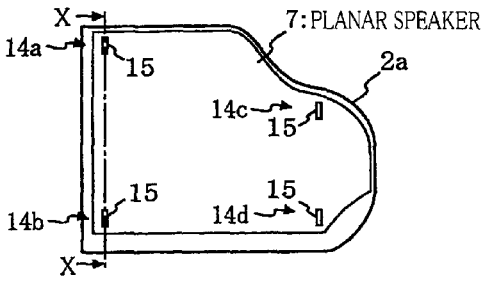
FIG. 2 is a plan view of a planar speaker of FIG. 1 when viewed from a back-surface side of a large roof plate.
Figure 2B:
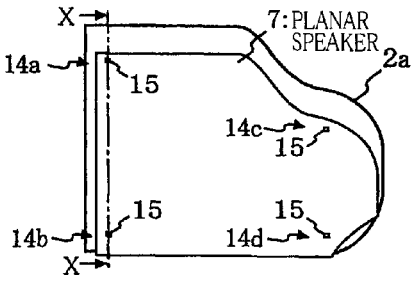

FIG. 2 is a plan view of the planar speaker 7 of FIG. 1 as viewed from the back-surface side of the large roof plate 2*a*. FIG. 2A shows a state in which the large roof plate 2*a* is opened while FIG. 2B shows a state in which the large roof plate 2*a* is closed.

Figure 3:
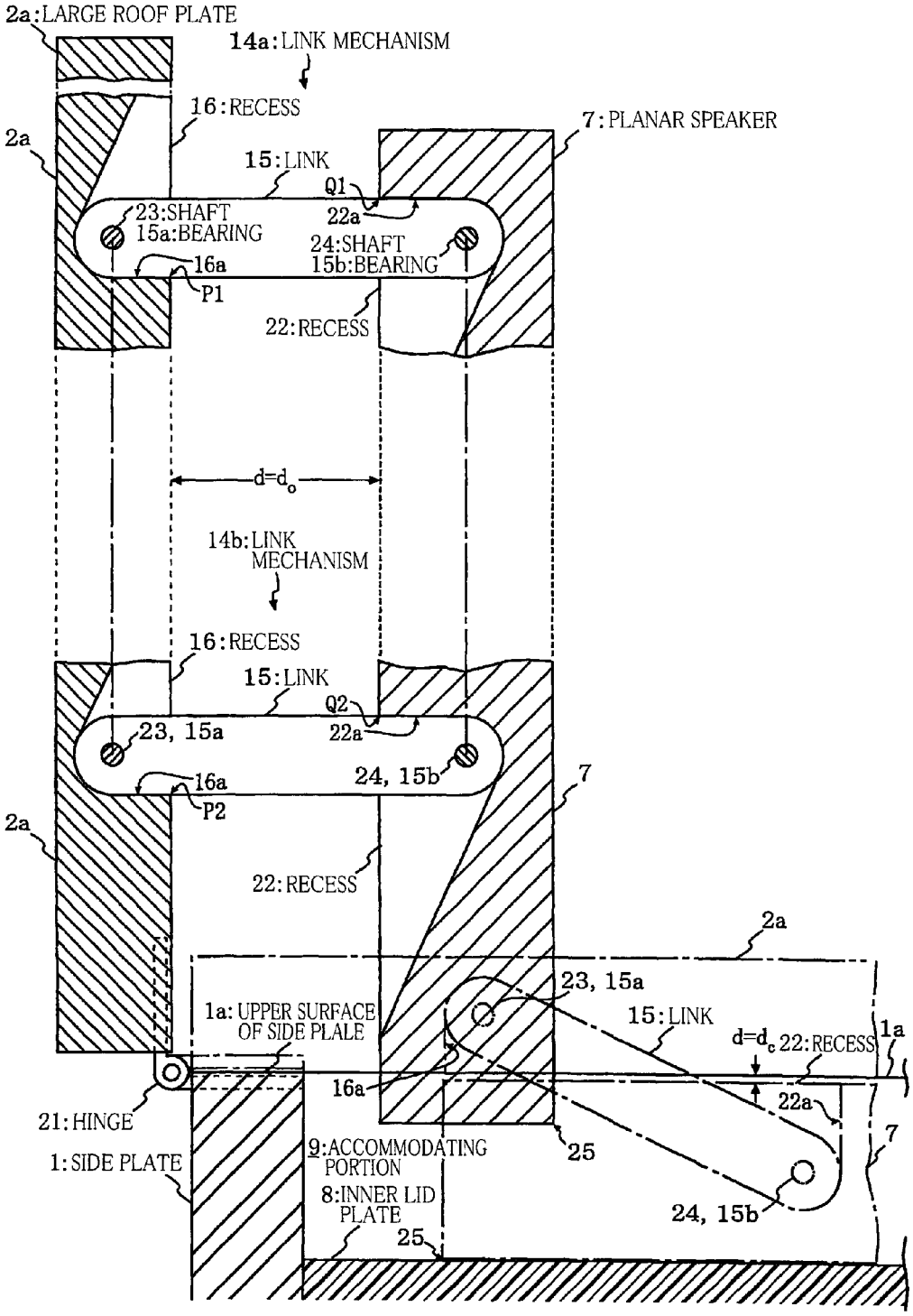
FIG. 3 is a cross-sectional view taken in the direction of arrows in FIG. 2 and showing cross sections of the large roof plate and the planar speaker taken along line X-X.

FIG. 3 is a cross-sectional view taken in the direction of arrows X in FIGS. 2A and 2B and showing cross sections of the large roof plate 2*a* and the planar speaker 7 taken along line X-X. The front roof plate 2*b* is not illustrated. The planar speaker 7 is illustrated as a flat plate, with omission of illustration of its internal structure. FIG. 3 shows the planar speaker 7 in a state in which the large roof plate 2*a* is upright about a hinge 21 as an axis A-A (FIG. 1). The planar speaker 7 in a state in which the large roof plate 2*a* is closed is indicated by the long dashed short dashed line.

As shown in FIG. 2, the planar speaker 7 of the present embodiment is coupled at its rear surface with respect to the back-surface side of the large roof plate (roof plate) 2*a* through four link mechanisms 14*a*-14*d* (hidden by the planar speaker 7). Owing to the link mechanisms 14*a*-14*d*, the planar speaker 7 disposed at the large roof plate 2*a* separates away and approaches the large roof plate 2*a* while keeping a state in which the planar speaker 7 is parallel to the large roof plate 2*a*, whereby the spacing distance d between the planar speaker 7 and the large roof plate 2*a* can be enlarged and narrowed.

As shown in FIG. 3, there are formed, in the back surface of the large roof plate 2*a*, recesses 16 for accommodating respective links 15. Similarly, there are formed, in the rear surface of the planar speaker 7, recesses 22 for accommodating the respective links 15.

A shaft 23 is provided in each of the recesses 16 while a shaft 24 is provided in each of the recesses 22. On the shafts 23 and 24, bearings 15*a*, 15*b* of each link 15 are respectively fitted, whereby the link couples the large roof plate 2*a* and the planar speaker 7.

In the state in which the large roof plate 2*a* is opened, the planar speaker 7 is supported owing to its self weight by the links 15 at surfaces 22*a* of the respective recesses 22, which are horizontal on this occasion. In particular, the shafts 24 and corner positions Q1, Q2 (at each of which a distance between the corresponding shaft 24 and the corresponding surface 22*a* is the largest) contribute to supporting of the planar speaker 7.

The links 15 are supported owing to the self weight of the planar speaker 7 and the self weights thereof by surfaces 16*a* of the respective recesses 16 of the large roof plate 2*a*, which surfaces 16*a* are horizontal on this occasion. In particular, the shafts 23 and corner positions P1, P2 (at each of which a distance between the corresponding shaft 23 and the corresponding surface 16 is the largest) contribute to supporting of the links 15.

Accordingly, when the large roof plate 2*a* opens the inner lid plate (the upper portion of the instrument main body) 8, the planar speaker 7 and the large roof plate 2*a* are spaced apart from each other, and the spacing distance therebetween is enlarged due to the self weight of the planar speaker 7 so as to be equal to do (d=do) at the maximum.

It is preferable to set the spacing distance d=do at 5 cm or more for shifting the resonance frequency by the vibrating plate of the planar speaker and the air layer toward a lower side and preventing a reduction of the sound pressure in the bass range.

The sound outputted from the rear surface of the planar speaker 7 is partially emitted from the spacing between the planar speaker 7 and the large roof plate 2*a* and propagates to the exterior together with the sound outputted from the front surface of the planar speaker 7.

On the other hand, when the large roof plate (roof plate) 2*a* closes the inner lid plate (the upper portion of the instrument main body) 8, a corner portion 25 of the planar speaker 7 disposed at the large roof plate 2*a* comes into contact with the inner lid plate 8, namely, the planar speaker engages an engaging member provided in the instrument main body, whereby the planar speaker 7 and the large roof plate 2*a* approach as indicated by the long dashed and short dashed line in FIG. 1, so that the spacing distance therebetween is narrowed or decreased (d=dc).

In this instance, a circumferential surface of each link 15 comes into contact with an inclined surface of the corresponding recess 22 of the planar speaker 7 and an inclined surface of the corresponding recess 16 of the large roof plate 2*a*, whereby the link 15 is accommodated in the corresponding recesses 16, 22. In this instance, the spacing distance d=dc may be equal to 0 cm or a slight spacing of about 1 cm may remain between the planar speaker 7 and the large roof plate 2*a*.

It is preferable that a smooth member be attached to a region of the inner lid plate (engaging member) 8 with which the corner portion 25 of the planar speaker 7 is to come into abutting contact. Further, by attaching a cushion member to the region, an impact of the abutting contact may be arranged to be mitigated. In FIG. 3, an accommodating place for the prop stick 10 is not illustrated.

The spacing distance d between the planar speaker 7 and the large roof plate 2*a* is enlarged and narrowed owing to the self weight of the planar speaker 7, thereby eliminating a drive mechanism for changing the spacing distance d.

FIG. 4 is a structural view of a planar speaker 30 having flexibility, as one example of the planar speaker 7 according to the embodiment shown in FIG. 1.

Figure 4A:
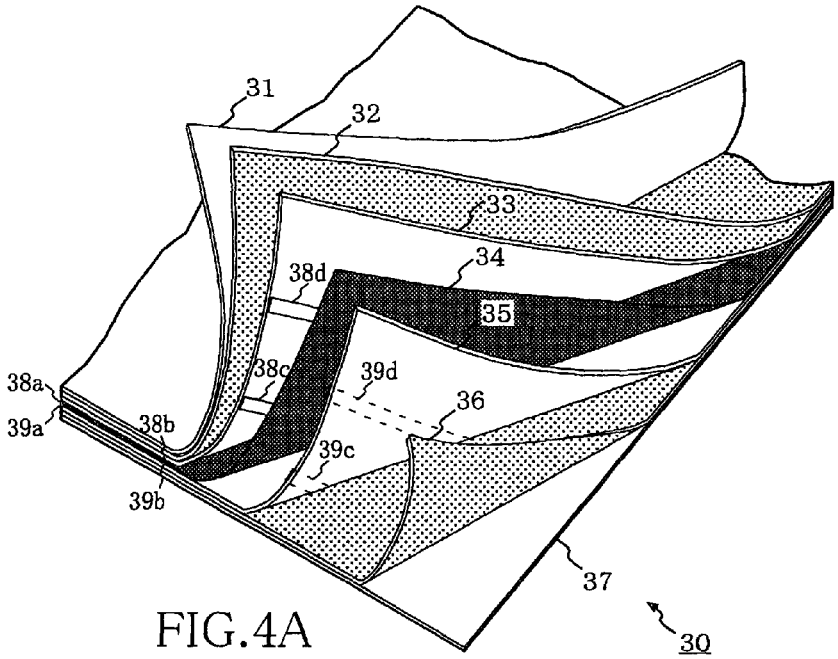
FIG. 4 is a structural view showing an electrostatic planar speaker having flexibility as one example of the planar speaker according to the first embodiment shown in FIG. 1.
Figure 4B:
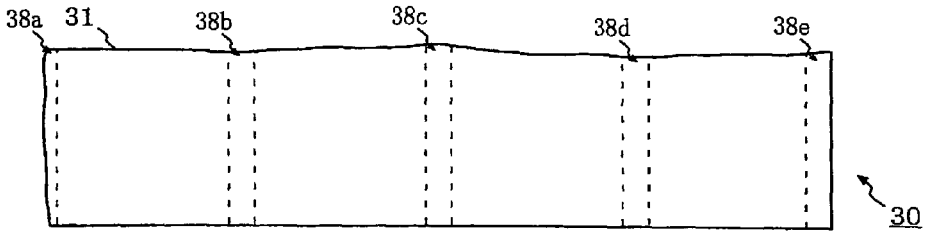
Figure 4C:
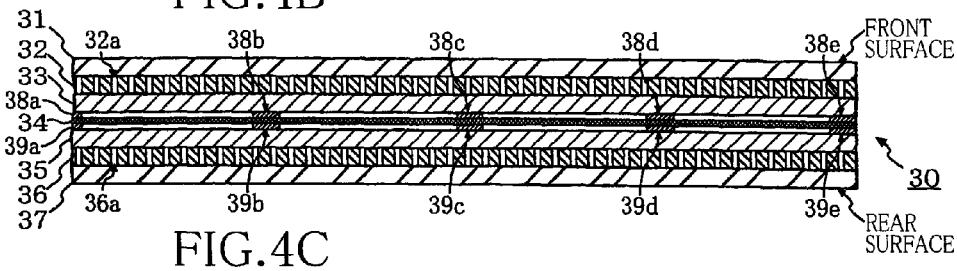
Figure 4D:
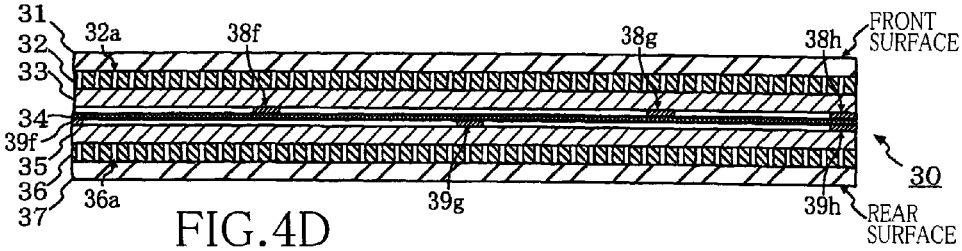

FIG. 4A is a schematic view in which a laminated structure of the planar speaker 30 is partially opened. FIG. 4B is a partial plan view of the planar speaker 30. FIG. 4C is a partial cross-sectional view of the planar speaker 30. FIG. 4D is a partial cross-sectional view of another example of the planar speaker 30.

Initially, a principal part of the laminated structure will be explained.

In FIGS. 4A-4C, a vibrating electrode sheet 34 which is particularly thin and has flexibility is interposed between a first fixed electrode sheet 32 having sound transmission property and a second fixed electrode sheet 36 having sound transmission property, via a first insulating sheet 33 having sound transmission property and a second insulating sheet 35 having sound transmission property, so as to provide the laminated structure.

Each of the first insulating sheet 33 and the second insulating sheet 35 is a buffer member (cushion member) which is thin and has flexibility. The first fixed electrode sheet 32 and the second fixed electrode sheet 36 are also thin and have flexibility.

The sound outputted from the front surface of the vibrating electrode sheet 34 permeates the first insulating sheet 33 and the first fixed electrode sheet 32, and is emitted from the front surface of this electrostatic speaker. The sound outputted from the rear surface of the vibrating electrode sheet 34 permeates the second insulating sheet 35 and the second fixed electrode sheet 36, and is emitted from the rear surface of this electrostatic speaker.

The reference numerals 31, 37 respectively denote third and fourth insulating sheets both having sound transmission property. These insulating sheets 31, 37 are provided for respectively protecting the front surface and the rear surface of the electrostatic speaker and for waterproofing, and function as covers for preventing an electrical shock. These insulating sheets 31, 37 also have flexibility.

Thus, the planar speaker 30, as a whole, is a thin flexible electrostatic speaker having flexibility.

Except the vibrating electrode sheet 34, the other sheets, namely, the first fixed electrode sheet 32, the second fixed electrode sheet 36, the first insulating sheet 33, the second insulating sheet 35, the third insulating sheet 31, and the fourth insulating sheet 37, are air permeable. It is noted that the third insulating sheet 31 and the fourth insulating sheet 37 may be eliminated.

The reference numerals 38*a*-38*e*, 39*a*-39*e* denote adhesive layers for partially supporting the vibrating electrode sheet 34 with the first insulating sheet 33 and the second insulating sheet 35. Each adhesive layer is flexible and has a small width of 4-10 mm and a small thickness of 0.1-0.5 mm, for instance. In the embodiment, the adhesive layer is in the form of a tape, more specifically, a double-faced tape is used as the adhesive layer.

The vibrating electrode sheet 34 is supported by the adhesive layers 38*a*-38*e*, 39*a*-39*e* at suitable intervals.

By the adhesive layers 38*a*-38*e*, 39*a*-39*e*, the vibrating electrode sheet 34 is supported, in its regions at which the adhesive layers 38*a*-38*e*, 39*a*-39*e* are not present, with a slight clearance existing with respect to the first insulating sheet 33 and the second insulating sheet 35.

Since the vibrating electrode sheet 34, the first insulating sheet 33, and the second insulating sheet 35 have flexibility, it doesn't matter even if these sheets are in contact with each other. The first insulating sheet 33 and the second insulating sheet 35 support the vibrating electrode sheet 34 and at the same time give suitable elastic stress to the vibrating electrode sheet 34.

The adhesive layers 38*a*-38*e*, 39*a*-39*e* are not essential for the electrostatic planar speaker. However, the vibrating electrode sheet 34 vibrates integrally with these adhesive layers while exerting interaction between the first insulating sheet 33 and the second insulating sheet 35.

Therefore, the adhesive layers 38, 39 have a function of stabilizing the interaction between: the vibrating electrode sheet 34; and the first insulating sheet 33 and the second insulating sheet 35, rather than functioning as spacers. Further, the adhesive layers 38, 39 have a function of preventing breakage of each layer of laminated sheets formed in a multi-layered fashion and preventing the layers from being wrinkled due to slipping or shifting of the layers relative to each other.

In FIG. 4C, the vibrating electrode sheet 34 is supported, with respect to the first insulating sheet 33, by the adhesive layers 38*a*-38*e* at equally spaced-apart first support positions. Also, the vibrating electrode sheet 34 is supported, with respect to the second insulating sheet 35, by the adhesive layers 39*a*-39*e* at the same first support positions. The interval of the first support positions is 1-10 cm, and was made equal to 3.6 cm in a specimen or prototype.

In another example of the planar speaker 30 shown in FIG. 4D, the vibrating electrode sheet 34 is supported, with respect to the first insulating sheet 33, by the adhesive layers 38*f*, 38*g* at equally spaced-apart first support positions. Also, the vibrating electrode sheet 34 is supported, with respect to the second insulating sheet 35, by the adhesive layers 39*f*-39*g* at equally spaced-apart second support positions. Since the first support positions and the second support positions are alternately arranged, the vibrating electrode sheet 34 is supported in an alternate fashion.

As shown in FIGS. 4B and 4C, one end of the planar speaker 30 (right-side end in FIGS. 4B and 4C) is preferably supported by the adhesive layers 38*e*, 39*e*, 38*h*, 39*h*. At the periphery of the planar speaker 30, any adjacent two layers are bonded by adhesive layers (double-faced tapes) similar to the adhesive layers 38*e*, 39*e*, 38*h*, 39*h* or bonded by applying an adhesive, so as to prevent separation of the layers. The periphery of the planar speaker 30 is seamed, put together by a synthetic resin, or attached to a frame not shown, for instance.

The above-indicated vibrating electrode sheet 34 is obtained by evaporating a conductive metal such as aluminum or by applying a conductive paste, onto one or both surfaces of a synthetic resin film of polyethylene terephthalate (PET) or polypropylene (PP). The vibrating electrode sheet 34 has a thickness of several to several tens of microns (μm).

Each of the above-indicated first and second fixed electrode sheets 32, 36 is a punching metal obtained by evaporating a conductive metal such as aluminum or by applying a conductive paste, onto one or both surfaces of polyethylene terephthalate, and by forming a multiplicity of through-holes 32*a*, 36*a* through its thickness. The thickness of this prototype is 0.5 mm.

As the first and second fixed electrode sheets 32, 36, a wire net or nonwoven fabric on which aluminum is evaporated may be used in place of the punching metal. In the latter case, the first insulating sheet 33 and the first fixed electrode sheet 32 may be made integral with each other, and the fourth insulating sheet 37 and the second fixed electrode sheet 36 may be made integral with each other.

Each of the above-indicated first insulating sheet 33 and second insulating sheet 35 is foamed synthetic resin or nonwoven fabric, for instance.

While each of the above-indicated third insulating sheet 31 and fourth insulating sheet 37 is also foamed synthetic resin or nonwoven fabric, for instance, a degree of freedom in selection of the material is high.

Figure 5:
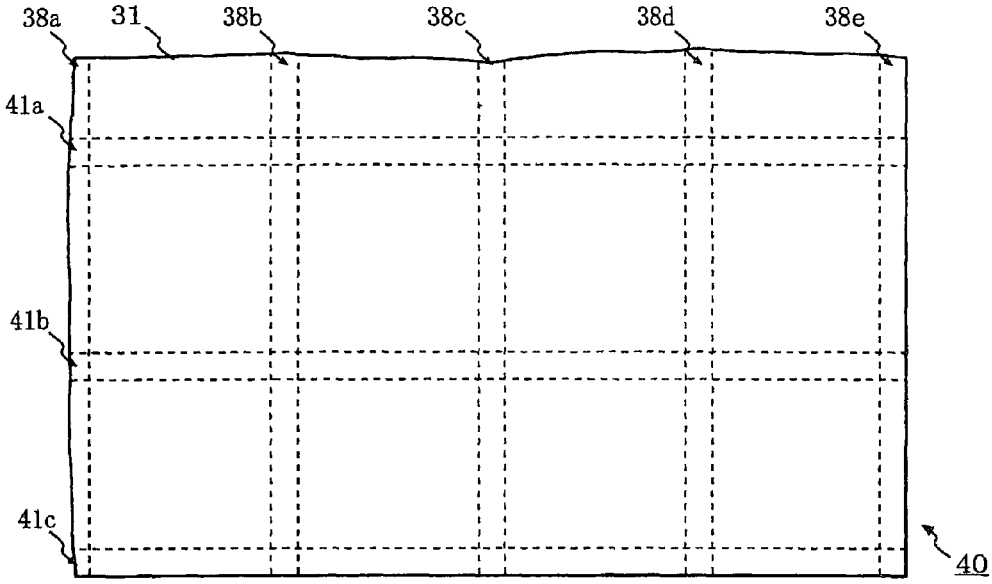
FIG. 5 is a partial plan view showing an electrostatic planar speaker having flexibility as another example of the planar speaker according to the first embodiment shown in FIG. 1.

FIG. 5 is a partial plan view of an electrostatic planar speaker 40 having flexibility, as another example of the planar speaker 7 according to the embodiment shown in FIG. 1.

In FIG. 4, the adhesive layers 38*a*-38*e*, 39*a*-39*e* are disposed in parallel with each other so as to extend in the up-down (vertical) direction in FIG. 4B. In FIG. 5, adhesive layers 41*a*, 41*b*, 41*c* are additionally disposed in parallel with each other so as to extend in the left-right (lateral) direction in FIG. 5.

The adhesive layers 41*a*, 41*b*, 41*c* are arranged at the same intervals as the adhesive layers 38*a*-38*d*, 39*a*-39*d*.

Where a single grid-like adhesive layer is used in place of the above-indicated two kinds of the adhesive layers arranged in the up-down direction and in the left-right direction, the thickness of the adhesive layer is made uniform.

The laminated cross-sectional structure of this planar speaker 40 is the same as that of FIGS. 4C and 4D except for the arrangement of the adhesive layers, and its illustration is omitted.

In the examples shown in FIGS. 4 and 5, owing to the adhesive layers 38*a*-38*h*, 39*a*-39*h*, 41*a*, 41*b*, 41*c*, the vibrating electrode sheet 34 and the first insulating sheet 33 are bonded to each other, and the vibrating electrode sheet 34 and the second insulating sheet 35 are bonded to each other.

In addition, any arbitrary two adjacent layers, such as: the third insulating sheet 31 and the first fixed electrode sheet 32; the first fixed electrode sheet 32 and the first insulating sheet 33; the second insulating sheet 35 and the second fixed electrode sheet 36; the second fixed electrode sheet 36 and the fourth insulating sheet 37, may be bonded by adhesive layers (double-faced tapes) not shown. In particular, at the peripheral portion of the planar speaker 40, all of adjacent two layers may be bonded by the adhesive layers (double-faced tapes).

Such an arrangement increases the unity as a laminated body, and prevents formation of a space between adjacent layers and shifting of the layers relative to each other. The bonding positions of the double-faced tapes not shown are preferably conformed to the support positions of the adhesive layers 38a-38h, 39a-39h, 41a, 41b, 41c, for the purpose of not lowering sound transmission efficiency.

However, the bonding positions may be made different for different combinations of two adjacent layers. Further, one-dimensional parallel arrangement in the vertical direction and one-dimensional parallel arrangement in the lateral direction orthogonal to the vertical direction may be changed selectively depending upon different combinations of two adjacent layers.

Figure 6A:
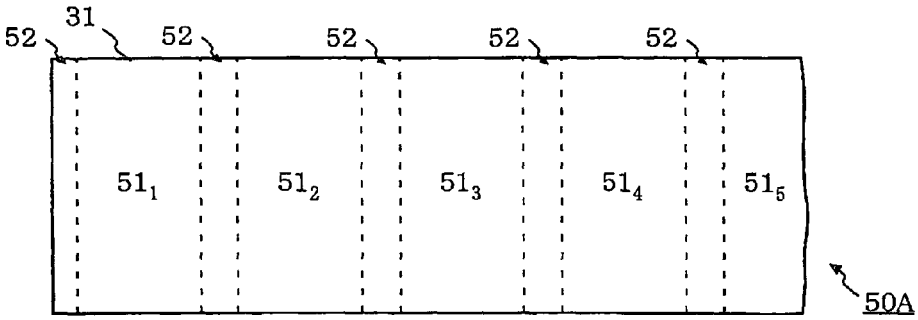
FIG. 6 is a partial plan view showing an electrostatic planar speaker having flexibility as still another example of the planar speaker according to the first embodiment shown in FIG. 1.
Figure 6B:
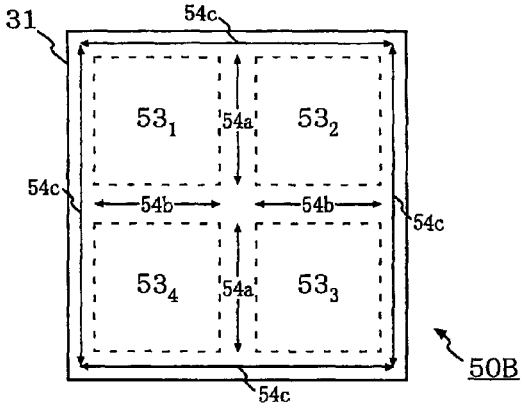

FIGS. 6A and 6B are partial plan views of electrostatic planar speakers 50A, 50B having flexibility, as still another example of the planar speaker 7 according to the embodiment shown in FIG. 1.

In the examples, a plurality of units, each being constituted by a single planar speaker 30 having the laminated cross-sectional structure shown in FIG. 4, are disposed at suitable intervals, so as to provide one planar speaker 50A and one planar speaker 50B, respectively.

That is, each planar speaker 50A, 50B is formed of laminated sheets including a plurality of units and continuous portions each of which connects adjoining two units.

In FIG. 6A, the plurality of planar speaker units are one-dimensionally arranged. In FIG. 6B, the plurality of planar speaker units are two-dimensionally arranged in the vertical and lateral directions.

In FIG. 6A, electrostatic planar-speaker units $\mathbf{51}_1$-$\mathbf{51}_5$ have the laminated cross-sectional structure shown in FIG. 4C or 4D and serves as a vibrating surface of the planar speaker 50A. At regions of the speaker unit corresponding to continuous portions 52, the conductive layers (the first fixed electrode sheet 32, the vibrating electrode sheet 34, the second fixed electrode sheet 36) shown in FIG. 4C or 4D are not present, and only the insulating layers (the third insulating sheet 31, the first insulating sheet 33, the second insulating sheet 35, and the fourth insulating sheet 37) are present. Accordingly, those insulating layers constitute each continuous portion 52.

At the region of each continuous portion 52, the first insulating sheet 33 and the second insulating sheet 35 may be further eliminated. In this case, there is initially formed, as each planar-speaker unit $\mathbf{51}_1$-$\mathbf{51}_5$, a laminated structure including the first fixed electrode sheet 32, the first insulating sheet 33, the vibrating electrode sheet 34, the second insulating sheet 35, the second fixed electrode sheet 36, and the adhesive layers 38a-38d, 39a-39h, 41a, 41b, 41c. The upper and lower surfaces of each planar-speaker unit $\mathbf{51}_1$-$\mathbf{51}_5$ are respectively covered with the third insulating sheet 31 and the fourth insulating sheet 37, whereby the planar speaker 7 is formed. In this instance, the third insulating sheet 31 and the fourth insulating sheet 37 constitute the continuous portions 52.

Where the planar speaker is manufactured according to the above-indicated process, it is possible to obtain the planar speaker 50A, 50B having a large area even where each planar-speaker unit $\mathbf{51}_1$-$\mathbf{51}_5$ has a small area.

Because the layers of the first and second fixed electrode sheets 32, 36 and the layer of the vibrating electrode sheet 34 are not present in the continuous portions 52, the electrode sheets are not damaged even where the planar speaker is bent or folded at the continuous portions 52.

The layers of the insulating sheets present in each continuous portion 52 extend continuously from the corresponding layers of the insulating sheets in the adjacent units. In other words, these layers are common to all units and all continuous portions 52. Accordingly, the arrangement eliminates separate connecting members for providing the continuous portions or eliminates a process of seaming or bonding each separate connecting member to the adjoining units for connection.

In FIG. 6B, each of planar speaker units $\mathbf{53}_1$-$\mathbf{53}_4$ has a laminated structure similar to that of each of the planar speaker units $\mathbf{51}_1$-$\mathbf{51}_5$ shown in FIG. 6A and serves as a vibrating surface of the planar speaker 50B.

In the planar-speaker units $\mathbf{53}_1$-$\mathbf{53}_4$ of this example, the units $\mathbf{53}_1$, $\mathbf{53}_2$ and the units $\mathbf{53}_4$, $\mathbf{53}_3$ are connected in the left-right (lateral) direction by respective continuous portions 54a while the units $\mathbf{53}_1$, $\mathbf{53}_4$ and the units $\mathbf{53}_2$, $\mathbf{53}_3$ are connected in the up-down (vertical) direction by respective continuous portions 54b. The laminated structure in each continuous portion 54a, 54b is similar to that of the continuous portion 52 shown in FIG. 6A. Further, peripheral portions 54c of the electrostatic speaker units $\mathbf{53}_1$-$\mathbf{53}_4$ have the laminated structure without the conductive layers similar to the continuous portions 54a, 54b, for permitting the peripheral portions 54c to function as regions to which a frame (not shown) is attached.

In the planar-speaker units $\mathbf{51}_1$-$\mathbf{51}_5$ shown in FIG. 6A and the planar-speaker units $\mathbf{53}_1$-$\mathbf{53}_4$ shown in FIG. 6B, lead wires are connected to the electrodes of the respective units, and the lead wires for the respective units are connected to a drive circuit independently of each other. Alternatively, the corresponding electrodes in adjacent units may be connected by short lead wires at the continuous portions 52, 54a, 54b, and the electrodes of the respective units may be connected to the drive circuit by a common lead wire.

Figure 7A:
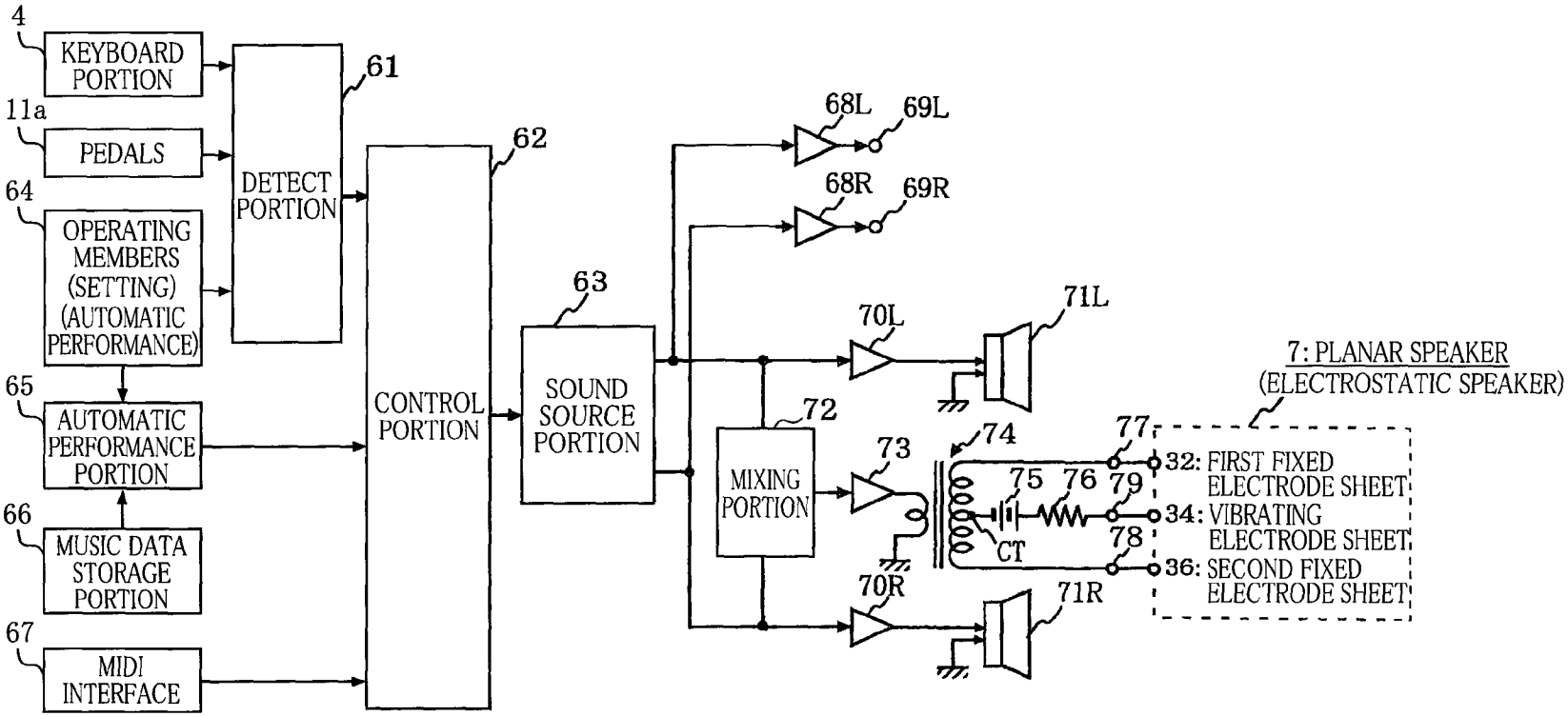
FIG. 7 is a functional block diagram of the electronic keyboard musical instrument according to the first embodiment shown in FIG. 1.

FIG. 7A is a functional block diagram of the electronic keyboard musical instrument according to the embodiment shown in FIG. 1.

Operations of the white keys and the black keys of the keyboard portion 4 and operations of the pedals 11a shown in FIG. 1 are detected by a detect portion 61, and detection signals are outputted to a control portion 62. The control portion 62 outputs performance data to a sound source portion 63. The performance data includes data relating to timing of key depression and key release, a note number (pitch) corresponding to a depressed or released key, a velocity (key depression velocity), an aftertouch amount, and so on. Further, data relating to a kind and an operation amount of the operated pedal 11a is also outputted. The control portion 62 indicated above is realized by permitting a CPU to execute instrument's built-in programs.

While not illustrated in the electronic keyboard musical instrument of FIG. 1, an operation panel portion of a drawer type is provided at a position of the bottom surface of the key bed 3 located below the keyboard portion 4. The operation panel portion has, on its upper surface, a plurality of operating members (buttons) 64. The operating members 64 include an operating switch for setting of instrument's sound color or timbre and a switch for controlling music selection, and reproduction starting and reproduction stopping, for automatic performance.

The operation of the operating members 64 is detected by the detect portion 61 and outputted to the control portion 62. The control portion 62 sets functions assigned to the operating members 64 with respect to the electronic keyboard musical instrument. Where the setting is made with respect to the sound source portion 63, sound source setting data is outputted to the sound source portion 63.

The above-indicted operation panel portion incorporates an automatic performance portion 65 and a music data storage portion 66. The automatic performance portion 65 reads out a music or tune stored in the music data storage portion 66 by the operation of the operating members 64, and outputs MIDI (Musical Instrument Digital Interface) performance data to the control portion 62. The above-indicated automatic performance portion 65 is also realized by permitting the CPU to execute the instrument's built-in programs.

MIDI interface 67 receives the MIDI performance data supplied from a personal computer or other electronic musical instruments, through terminals provided on the lower surface of the rear portion of the key bed 3, for instance, and outputs the data to the control portion 62.

On the basis of the performance data inputted from the control portion 62, the sound source portion 63 generates a musical sound signal for a stereo with two channels L and R having pitch and intensity in accordance with sound source setting such as the sound color and the key depression operation, and outputs the signal to amplifiers 68L, 68R, 70L, 70R and a mixing section (mixer) 72. The illustrated sound source portion 63 utilizes a left source and a right source for the stereo, for generating one musical sound. These sound sources are stored in a sound source waveform memory not shown.

The sound source portion 63 may be configured to utilize a monaural source and to control a volume ratio between the left channel and the right channel in accordance with the band zone of the operated key, and so on, namely, may be configured to perform a sound image localization control.

Outputs of the amplifiers 68L, 68R are respectively outputted to external terminals 69L, 69R for headphones. An output of the amplifier 70L is sent to a dynamic cone speaker 71L while an output of the amplifier 70R is sent to a dynamic cone speaker 71R. The dynamic cone speaker is hereinafter simply referred to as the "cone speaker".

The cone speakers 71L, 71R may be provided at a front plate portion that is hidden by the inner lid plate 8, the key bed 3, and the fall board 5 in FIG. 1.

The mixing portion 72 mixes and outputs the stereo outputs of the sound source portion 63 to an amplifier 73. An output of the amplifier 73 is sent to a primary coil of a booster transformer 74. To a secondary coil of the booster transformer 74, the flexible electrostatic speaker as one example of the planar speaker 7 shown in FIG. 1 is connected. The secondary coil of the booster transformer 74 includes a center tap CT to which is connected a series circuit of a high-voltage bias direct current (DC) power source 75 and a high-resistance resistor 76. Opposite ends of the secondary coil described above function as terminals 77, 78, and one end of the resistor 76 functions as a terminal 79.

The terminal 77 is connected to the first fixed electrode sheet 32, the terminal 78 is connected to the second fixed electrode sheet 36, and the terminal 79 is connected to the vibrating electrode sheet 34, shown in FIGS. 4C and 4D.

Here, the following explanation is made taking a potential of the vibrating electrode sheet 34 as a reference of potential. The first fixed electrode sheet 32 and the second fixed electrode sheet 36 are negatively charged at $E_0$=several hundred voltage [V] by the bias DC power source 75, and there are generated electrostatic attraction forces in mutually opposite directions between the vibrating electrode sheet 34 and the first fixed electrode sheet 32 and between the vibrating electrode sheet 34 and the second fixed electrode sheet 36.

In this state, where musical sound signals of ±e [V] (here, e is sufficiently smaller than Ed having mutually opposite phases are respectively applied to the first fixed electrode sheet 32 and the second fixed electrode sheet 36, the first fixed electrode sheet 32 and the second fixed electrode sheet 36 are negatively charged at $(E_0+e)$ [V] and $(E_0-e)$ [V], respectively. Consequently, the balance of the electrostatic attraction force between the vibrating electrode sheet 34 and the first fixed electrode sheet 32; and the electrostatic attraction force between the vibrating electrode sheet 34 and the second fixed electrode sheet 36 is broken. As a result, there is generated an electrostatic attraction force that is proportional to the musical sound signal e [V], and the vibrating electrode sheet 34 is push-pull driven depending upon whether the musical sound signal e [V] is positive or negative.

In the above explanation, the outputs of the amplifiers 70L, 70R are outputted directly to the respective cone speakers 71L, 71R. The cone speakers 71L, 71R are used for compensating for a decrease in the sound pressure on the lower frequency side of the planar speaker 7. Accordingly, speakers called woofer speakers are normally used. In view of this, it is preferable to insert a low-pass filter circuit to the input side or the output side of each amplifier 70L, 70R, for supplying the music sound signal in accordance with the frequency characteristic of the cone speakers 71L, 71R.

Similarly, a high-pass filter circuit or a middle and high-pass filter circuit may be inserted to the input side or the output side of the amplifier 73, for supplying the music sound signal in accordance with the frequency characteristic of the electrostatic speaker, to the booster transformer 74.

The characteristics of the above-indicated filter circuits are designed such that the sound outputted from the cone speaker 71L, 71R and the sound outputted from the planar speaker 7 are balanced in terms of the frequency characteristic.

Further, tweeter speakers for reproduction of the treble range (such as dome-type dynamic speakers) may be provided, and the amplifiers 70L, 70R may distribute the musical sound signal to the tweeter speakers. A switch may be provided for switching the planar speaker (the electrostatic speaker) 7 and the tweeter speakers for selective use thereof.

While not shown, a source exclusive for the planar speaker 7 shown in FIG. 1 may be prepared in the sound source portion 63. In this instance, the musical sound signal based on the exclusive source may be supplied to the booster transformer 74 after having been amplified by the amplifier 73.

Second Embodiment

Referring next to the external view of FIG. 8, there will be explained an electronic keyboard musical instrument of an upright piano type constructed according to a second embodiment of the present invention.

Figure 8:
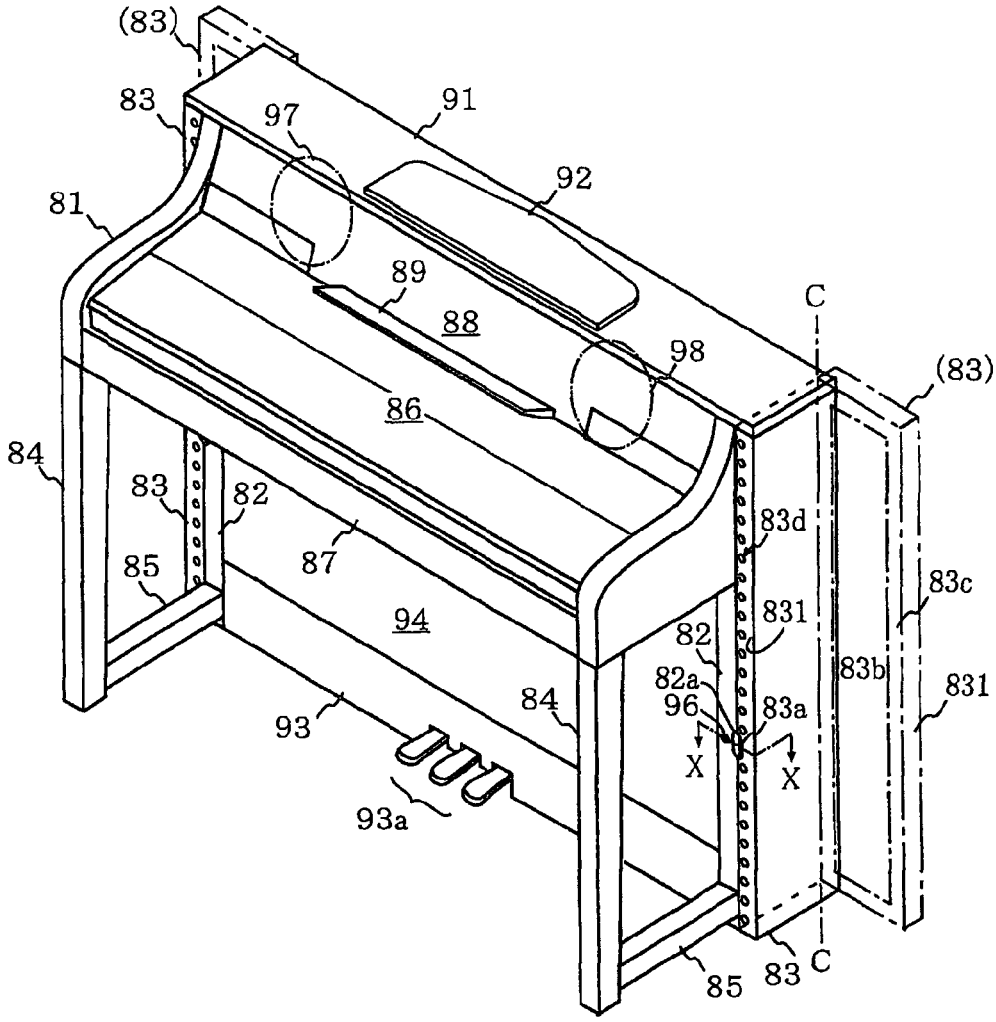
FIG. 8 is an external view of an electronic keyboard musical instrument of an upright piano type according to a second embodiment of the invention.

On the left side as viewed from the performer in FIG. 8, the reference numerals 81, 82, 83, 84, 85 respectively denote a side arm plate (side-surface portion), a side plate (side-surface portion), a side lid (side-surface portion), a front leg, and a stay connecting the front leg 84 and the side plate 82. A similar arrangement is provided on the right side in FIG. 8, and the same reference numerals are attached to the corresponding components.

While a keyboard portion is disposed between the left and right side arm plates 81, the keyboard portion is invisible because a fall board 86 is closed. The illustrated fall board 86 is of a two-part foldable type, and is accommodated, during performance, in the inside of the instrument main body from a lower part of an upper front plate 88 described below.

The front surface of the keyboard portion nearer to the performer is a key slip 87. The bottom surface of the keyboard portion is a key bed not shown. The upper part of the keyboard portion on the rear side remote from the performer is the upper front plate 88. At a central position of the upper front plate 88, a music rest 89 is provided. A top plate 91 is laid over the upper front plate 88, the left and right side plates 82, and the rear plate 90 (FIG. 9). At a central position of the top plate 91, a music rack 92 (in a fallen state in FIG. 8) is provided.

A pedal unit 93 is provided at a lower portion of the instrument, and pedals 93*a* accommodated therein protrude from a central portion of the pedal unit 93. A lower front plate 94 is provided so as to extend between the pedal unit 93 and the key bed which is located above the pedal unit 93. As shown in FIG. 9, a net 103 as a sound transmission member is attached to the surface of the lower front plate 94.

An instrument main body is constituted by the side arm plates 81, the side plates 82, the side lids 83, the top plate 91, the key bed (bottom-surface portion), the keyboard portion, the upper front plate 88, the lower front plate 94, the rear plate 90, the pedal unit 93, and an inner space. In the instrument main body, the inner space is defined by the side arm plates 81, the side plates 82, the side lids 83, the top plate 91, the key bed (bottom-surface portion), the upper front plate 88, the lower front plate 94, and the rear plate 90. The components that define the inner space constitute a casing of the instrument main body.

The instrument main body incorporates a musical-sound-signal generating portion configured to generate a musical sound signal in accordance with a user's key operation with respect to the keyboard portion 4.

As shown in FIG. 9, a planar speaker 95 in this embodiment is disposed at a part of the instrument main body and outputs a sound in accordance with the musical sound signal outputted from the above-indicated musical-sound-signal generating portion.

The planar speaker 95 is disposed at least one of (usually both of) the left and right side plates (left and right side-surface portions) 82, together with the side lid (lid body) 83 which is configured to open/close the planar speaker 95 with respect to the exterior. Further, the side lid (lid body) 83 opens/closes the side plate 82 at which the planar speaker 95 is disposed, with respect to the exterior.

The side plates 82 are plate members enclosing the inner space of the instrument main body. The four sides (periphery) of each side plate 82 is made as an attachment frame for the planar speaker. In this planar-speaker attachment frame, one side (one longer side) contacting the lower front plate 94 is indicated as a frame part 82*d* and another side (another longer side) contacting the rear plate 90 is indicated as a frame part 82*e*. The planar speaker 95 is disposed with respect to this planar-speaker attachment frame (the frame part 82*d*, the frame part 82*e*).

The planar speaker 95 is disposed such that one side (longer side) thereof extends along a height direction of the side plate 82. The side plate 82 has a height that is commensurate to the height of the performer. Accordingly, the area of the planar speaker 95 can be made large, thereby increasing the sound pressure in the bass range by an amount corresponding to the area of the planar speaker.

The planar speaker may be disposed at the upper front plate 88, the key bed (bottom-surface portion) or the rear plate 90. Further, the planar speaker may be disposed at a plurality of locations.

As shown in FIG. 8, cone speakers 97, 98 are provided at the upper front plate 88. On the surface of the upper front plate 88, a punching metal, a net, or a speaker grille, not shown, which protects the inner space but permits sound transmission, is provided at least at a front opening portion of each cone speaker 97, 98.

Where the planar speakers 95 are disposed on the left and right sides, respectively, output signals for the left and right channels for the stereo can be supplied, in place of supplying the same monaural output signal to the respective planar speakers. In this instance, in the functional block diagram of FIG. 7A, the output signals for the left and right channels of the sound source portion 63 may be amplified by respective amplifiers, without using the mixing portion 72, and may be boosted by respective booster transformers.

The above-indicated cone speakers 97, 98 respectively correspond to the cone speakers 71L, 71R. The cone speaker 71L and the left-side planar speaker 95 may commonly use the amplifier 70L while the cone speaker 71R and the right-side planar speaker 95 may commonly use the amplifier 70R.

As explained below, the planar speaker 95 is disposed at a position where the inner space of the instrument main body and the exterior are partitioned. In other words, the planar speaker 95 is disposed at any of the members (the side lid 83 in this embodiment) that define the inner space of the instrument main body with respect to the exterior. The sound outputted from the front surface of the planar speaker 95 propagates to the exterior while the sound outputted from the rear surface of the planar speaker 95 propagates to the inner space of the instrument main body, i.e., an acoustic propagation space 102 in the embodiment shown in FIG. 9.

The sound propagated to the acoustic propagation space 102 vibrates the casing and propagates to the exterior via sound holes that are open to the exterior from the inner space.

When the side lid (lid body) 83 is closed, the sound to propagate from the front surface of the planar speaker 95 directly to the exterior is shut off.

Referring to FIG. 9, the side plate 82 will be explained.

Figure 9A:
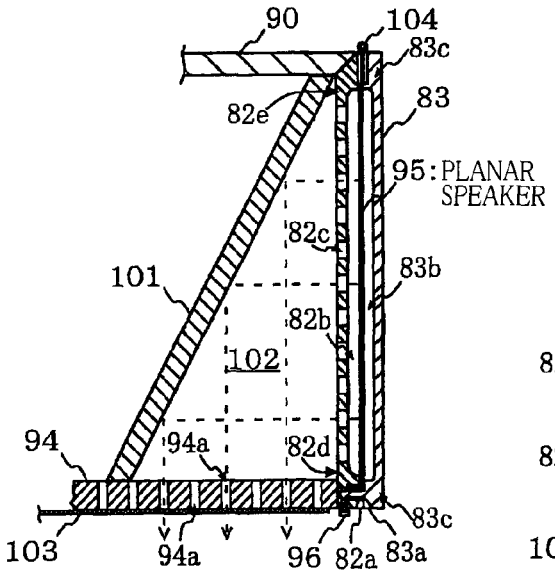
FIG. 9 is a partial cross-sectional view of the electronic keyboard musical instrument according to the second embodiment shown in FIG. 8.
Figure 9B:
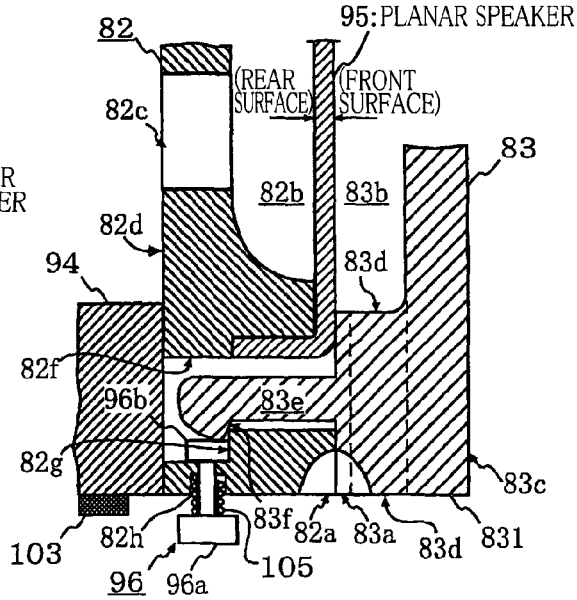

FIG. 9 is a cross-sectional view of a part of FIG. 8. FIG. 9A is a partial cross-sectional view taken in the direction of arrows X in FIG. 8 and showing cross sections of the side plate 82, the side lid 83, the lower front plate 87, the rear plate 90, etc., taken along line X-X. FIG. 9B is an enlarged cross-sectional view of a vicinity of a release button 96.

The side plate 82 is formed with a recess 82*b* in an inside thereof enclosed by the above-indicated the planar-speaker attachment frame (the frame part 82*d*, the frame part 82*e*). The planar speaker 95 is disposed on a surface of the planar-speaker attachment frame (the frame part 82*d*, the frame part 82*e*), which surface is opposed to the exterior, so as to cover the recess 82B from the exterior.

Accordingly, when the sound is emitted from the planar speaker 95 with the side lid (lid body) 83 being opened, the recess 82*b* functions as an air layer on the rear-surface side of the planar speaker 95.

The rear surface of the planar speaker 95 and the bottom surface of the recess 82*b* are disposed so as to be opposed to each other with the air layer interposed therebetween, whereby the resonance frequency by the vibrating plate of the planar speaker and the air layer shifts toward a lower side, as compared with an instance where no air layer exists.

As shown in FIG. 9A, the recess 82*b* is held in communication with the acoustic propagation space 102 via a multiplicity of through-holes (sound holes) 82*c* formed in the bottom surface of the recess 82*b*, thereby substantially increasing the thickness of the air layer and further lowering the resonance frequency.

Where the sound outputted from the rear surface of the planar speaker 95 need not propagate to the inner space of the instrument main body, the through-holes (sound holes) 82*c* are not necessary.

Next, the structure of the side lid 83 will be explained with reference to FIGS. 8 and 9.

The side lid 83 is attached, by a hinge 104 shown in FIG. 9A, with respect to one side (one longer side) of the side plate 82 that is adjacent to the rear plate 90, such that the side lid 83 is pivotable about a linear axis C-C. The side lid (lid body) 83 rotates or pivots about the straight line as the axis, whereby the side lid 83 opens and closes the side plate 82 (the left side-surface portion or the right side-surface portion) at which the planar speaker 95 is disposed, with respect to the exterior. The planar speaker 95 is exposed to the exterior when the side lid 83 is opened. The side lid 83 indicated by the long dashed short dashed line in FIG. 8 is in a state in which the side lid 83 is opened at right angle.

The side lid (lid body) 83 in the embodiment is a flat plate (rectangular parallelepiped) that conform to the shape of the side plate 82 to which the side lid 83 is attached. However, there may be employed a polygonal plate having a polygonal plane with a plurality of sides not smaller than three, or a semicircular plate. In this instance, the rotation or pivot axis of the side lid (lid body) 83 is one of the plurality of sides of the polygonal plate or one side of the semicircular plate, at which the polygonal plate or the semicircular plate is hinged to the side plate 82 (side-surface portion).

The reference numeral 82*a*, 83*a* denotes a grip recess into which the performer puts his/her fingers for opening or closing the side lid 83. The release button is denoted as 96.

In the state shown in FIG. 9B in which the side lid 83 is closed, an engaging portion 83*f* of an engaging protrusion (constituted by an elastic deform portion 83*e* and the engaging portion 83*f*) formed on a back surface of a frame 83 of the side lid 83 engages a corner portion of a retaining portion 82*g* of the side plate 82, whereby the engagement state is maintained.

A through-hole 82*f* is formed in the frame part 82*d* of the side plate 82. The through-hole 82*f* has a stepped surface and accordingly has a larger width on the back-surface side of the side plate 82. The stepped surface provides the retaining portion 82*g* described above.

A through-hole 82*h* is formed at a front-side section (on the performer's side) of the frame part 82*d*, so as to be parallel to the above-indicated stepped surface. The release button 96 is embedded in the through-hole 82*h*. The through-hole 82*h* has a larger width on its front side, and a return spring 105 is provided therein.

When a knob portion 96*a* of the release button 96 is pushed, an operating element 96*b* pushes the engaging portion 83*f*, so that the engaging portion 83*f* and the retaining portion 82*g* are disengaged. Accordingly, the side lid 83 can be opened by putting the performer's fingers into the grip recess 83*a*. When the knob portion 96*a* is released from pushing, the operating element 96*b* returns by the return spring 105. Accordingly, when the side lid 83 is again closed, the engaging portion 83*f* and the retaining portion 82*g* are brought into engagement with each other and the closed state of the side lid 83 is maintained.

As shown in FIGS. 8, 9A, and 9B, the side lid 83*a* has a recess 83*b* formed in its back surface, the periphery of which functions as the frame 83*c*.

Here, a multiplicity of through-holes (sound holes) 83*d* may be formed in at least one side surface (indicated at 831 in FIGS. 8 and 9B), among four side surfaces of the frame 83*c* of the side lid 83. The through-holes 83*d* extend from the recess 83*b* so as to penetrate through the above-indicated one side surface 831, thereby functioning as the sound holes connecting the recess 83*b* and the exterior.

Referring next to FIG. 9A, there will be explained a sound propagation path through which the sound outputted from the rear surface of the planar speaker 95 propagates to the inner space of the instrument main body.

Owing to the existence of the through-holes (sound holes) 82*c*, the planar speaker 9 is considered to be disposed at a position where the inner space of the instrument main body and the exterior is partitioned. The sound outputted from the rear surface of the planar speaker 95 propagates to the acoustic propagation space 102. It is noted that the multiplicity of through-holes 82*c* may be formed as a single large through-hole and the side plate 82 may be formed as a simple frame.

The left side-surface portion or the right side-surface portion 82 at which the planar speaker 95 is disposed is open to the acoustic propagation space (i.e., the inner space of the instrument main body) 102, and the acoustic propagation space 102 has an acoustic reflection plate 101. This acoustic reflection plate 101 may be disposed diagonally relative to the plane of the planar speaker 95.

Accordingly, at the left side-surface portion or the right side-surface portion 82, in addition to the sound emitted from the side surface of the electronic keyboard musical instrument, the sound outputted from the planar speaker 95 propagates to the acoustic propagation space 102 and is reflected by the acoustic reflection plate 101, so that the casing of the instrument main body is vibrated for permitting secondary emission of the sound to the exterior and for permitting emission of the sound to the exterior from portions at which the acoustic propagation space (the inner space) 102 is open to the exterior. Therefore, the level of the sound emitted from the entirety of the casing of the electronic keyboard musical instrument becomes high.

The acoustic propagation space 102 and the acoustic reflection plate 101 will be explained more specifically.

In the inner space of the instrument main body between the rear plate 90 and the lower front plate 94, the acoustic reflection plate 101 is installed diagonally with respect to the plane of the planar speaker 95 disposed at the side plate 82, in other words, installed so as to be inclined with respect to the plane of the planar speaker 95 such that an angle formed by the planar speaker 95 and the acoustic reflection plate 101 is larger than 0° and less than 90° in the illustrated embodiment. The acoustic reflection plate 101 defines the acoustic propagation space 102 in a part of the inner space, together with the lower front plate 94 and the side plate 82.

This acoustic reflection plate 101 is configured to reflect the sound outputted from the planar speaker 95 disposed at the side plate 82 and to thereby change the sound propagation direction from the leftward direction to the frontward direction. The lower front plate 94 is formed with a plurality of through-holes (sound holes) 94*a* through which the sound is emitted frontward. The reference numeral 103 denotes a net which covers the front surface of the lower front plate 94 and which permits transmission of the sound and prevents entry of foreign substances into the acoustic propagation space 102.

FIG. 9A is a view in transverse cross section at a position below the key bed of the keyboard portion. On the other hand, in a part of the inner space located above the key bed, there are accommodated components for a mechanism of accommodating the fall board 86, the electronic circuit block, and the like. This part of the inner space may be formed as an acoustic propagation space, and the sound may be emitted from the upper front plate 88, etc., to the exterior. However, it is difficult to extend upward the illustrated acoustic reflection plate 101 beyond the key bed.

In view of this, the side plate 82 may be formed not to have the through-holes 82*c* at a portion thereof above the key bed of the keyboard portion so as to eliminate the propagation path to the inner space. However, the recess 82*b* is preferably formed so as to extend continuously below and above the key bed.

At the left side-surface portion or the right side-surface portion 82 at which the planar speaker 95 is disposed, the planar speaker 95 may be operated with the side lid 83 closed.

In this instance, the planar speaker 95 emits the sound to the acoustic propagation space (the inner space) 102. On this occasion, the front surface of the planar speaker 95 and the back surface of the side lid (lid body) 83 are preferably disposed so as to be opposed to each other with an air layer interposed therebetween.

In such an arrangement, the resonance frequency by the vibrating plate of the planar speaker and the air layer is shifted toward the lower side, diminishing a decrease of the sound pressure in the bass range, as compared with an arrangement in which the air layer is not present.

As a first example for providing the air layer, a recess 83*b* is formed in the back surface of the side lid (lid body) 83, and this recess 83*b* functions as an air layer with a sufficient distance between the planar speaker 95 and the back surface of the side lid (lid body) 83.

Here, where the multiplicity of through-holes (sound holes) 83*d* are formed in the one side surface 831 of the frame 83*c* of the side lid 83, the thickness of the air layer given by the recess 83*b* of the side lid 83, which is relatively small, is complemented.

A second example, an illustration of which is omitted, will be next explained. The back surface of the side lid (lid body) 83 is made flat, namely, the side lid 83 does not have the recess 83*b*, unlike the side lid 83 shown in FIG. 9. The side-surface portion 82 at which the planar speaker 95 is disposed has the planar-speaker attachment frame (the frame part 82*d*, the frame part 82*e*). The recess 82*b* is formed inside the planar-speaker attachment frame, and the planar speaker 95 is disposed on the bottom surface of the recess 82*b* (namely, at a position of the plate surface of the side plate 82 of FIG. 9 in which the through-holes 82*c* are formed).

In other words, the planar speaker 95 is disposed so as to be retracted toward the acoustic propagation space 102 (the inner space of the instrument main body), from the surface (that faces the exterior) of the planar-speaker attachment frame (the frame part 82*d*, the frame part 82*e*). As a result, there is formed an air layer having a thickness corresponding to the distance between the surface (that faces the exterior) of the side plate 82 and the front surface of the planar speaker 95 which is retracted toward the acoustic propagation space 102. Thus, a sufficient distance is ensured between the front surface of the planar speaker 95 and the back surface of the side lid 83.

In this instance, the plate surface of the side plate 82 of FIG. 9 in which the through-holes 82*c* are formed is removed or retracted toward the acoustic propagation space 102 (the inner space of the instrument main body).

A third example is a combination of the first and second examples described above.

In the third example, both of the attachment position of the planar speaker and the back surface of the side lid (lid body) 83 are recessed so as to be opposed to each other. Accordingly, an air layer with a large thickness is ensured between the planar speaker 95 and the back surface of the side lid 83. Accordingly, this arrangement does not give the impression that the back surface of the side lid 83 is largely recessed apparently when viewed from above, during the use of the instrument.

The planar speaker 95 may be disposed on the back of at least one of the left and right side lids 83, in place of the side plate 82. In this case, the frame 83*c* of the side lid (lid body) 83 functions as the planar-speaker attachment frame.

The side lid 83 described above can be opened relative to the side plate 82 to an extent equal to 135° at the maximum. The performer adjusts the rotation angle (opening angle) of the lid body, thereby changing the propagation direction of the sound outputted from the front surface of the planar speaker 95.

In this case, too, the recess 83*b* of the side lid (lid body) 83 functions as an air layer on the rear-surface side of the planar speaker 95. Where the multiplicity of through-holes 83*d* are formed in the side surface of the side lid 83, the thickness of the air layer is complemented.

On the other hand, in an arrangement wherein the planar speaker 95 is provided on the back side of the side lid 83, the recess 82*b* and the through-holes 82*c* are formed in the side plate 82 and the sound outputted from the front surface of the planar speaker 95 can propagate to the acoustic propagation space 102, when the planar speaker 95 is operated with the side lid (lid body) 83 closed.

Lastly, there will be explained an example in which the side lid (lid body) 83 serves as the acoustic reflection plate. As shown in FIG. 9, the planar speaker 95 is attached to the planar-speaker attachment frame (the frame part 82*d*, the frame part 82*e*) of the left side-surface portion or the right side-surface portion.

Where the planar speaker 95 is operated with the side lid 83 opened, the back surface of the side lid (lid body) 83 can be utilized as an acoustic reflection surface. In this instance, the back surface of the side lid (lid body) 83 may be made flat.

The performer adjusts the rotation angle (opening angle) of the lid body, thereby changing the reflection direction of the sound outputted from the front surface of the planar speaker 95. Accordingly, the sound propagation direction after reflection can be changed.

Here, there may be provided, also at the rear plate 90 shown in FIG. 9, a planar speaker (functioning as a rear speaker). In this case, both of the front and back surfaces of the side lid 83 are utilized as the acoustic reflection plate. By adjusting the opening angle of the side lid 83, it is possible to allow the acoustic reflection plate to operate strongly with respect to any one of the planar speaker 95 (functioning as a side speaker) and the rear speaker or to operate with respect to both of the side speaker and the rear speaker.

Figure 9C:
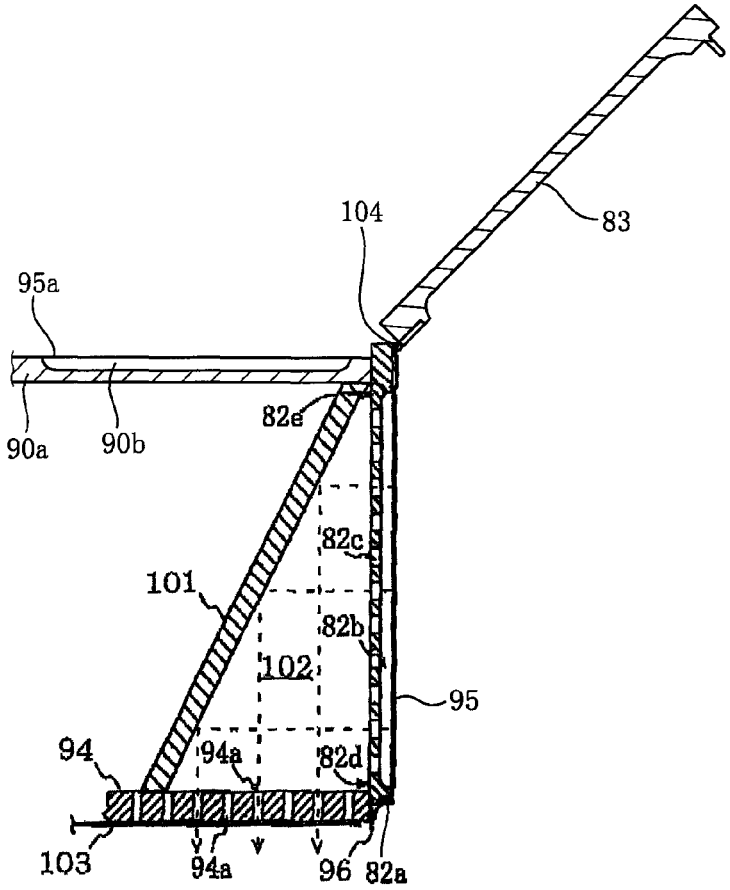

The above arrangement in which the planar speaker is provided at the rear plate 90 will be explained as a fourth example with reference to FIG. 9C. FIG. 9C is a cross-sectional view of a part of FIG. 8 and a partial cross-sectional view taken in the direction of arrows X in FIG. 8 and showing cross sections of the side plate 82, the side lid 83, and the rear plate 90*a*, etc., taken along line X-X. In this fourth example, a planar speaker 95*a* is disposed at a rear plate 90*a*. The planar speaker 95*a* is fixed, at its opposite ends, to a surface of the rear plate 90*a* facing the exterior. This surface of the rear plate 90*a* facing the exterior has a recess 90*b* The recess 90*b* is formed between the positions at which the opposite ends of the planar speaker 95 are fixed and which is recessed toward the inner space. The recess 90*b* functions as an air layer. In FIG. 9C, the side lid 83 is disposed at a position where the side lid 83 is opened relative to the side plate 82 by an angle of about 135° by means of a hinge 104. The angle formed by the side lid 83 and the side plate 82 may be arbitrarily changed by changing the structure of the side lid 83 and the hinge 104. For instance, the side lid 83 may be disposed at a position where the side lid 83 is opened relative to the side plate 82 by an angle exceeding 180°. Further, the side lid 83 may be disposed at a position where the side lid 83 is opened relative to the side plate 82 by an angle of 270°, namely, at a position where the planar speaker 95*a* is not exposed to the exterior. By thus providing the planar speaker 95*a* at the rear plate 90*a*, it is possible to output the sound on the back side of the electronic keyboard musical instrument. By adjusting the opening angle of the side lid 83, it is possible to allow the acoustic reflection plate (the side lid 83) to operate strongly with respect to any one of the planar speaker 95 (functioning as the side speaker) and the planar speaker 95*a* (functioning as the rear speaker) or to operate with respect to both of them. Further, the planar speaker 95*a* provided at the rear plate 90*a* may be made as a planar speaker disposed at a position where the inner space of the instrument main body and the exterior are partitioned, by forming a multiplicity of through-holes in the side surface of the rear plate 90*a* or by forming the rear plate 90*a* as a frame. In this instance, the side lid 83 may or may not be provided. In addition to the side lid 83 shown in FIG. 9C, there may be provided a rear lid which is different from and independent of the side lid 83. This rear lid may be utilized as a lid body which selectively realizes: a state in which the planar speaker 95 is not exposed to the exterior when the rear lid is closed; and a state in which the planar speaker 95 is exposed to the exterior when the rear lid is opened. In the arrangement, by closing both of the side lid 83 and the rear lid, the sound is not outputted directly to the exterior from the planar speaker 90 and the planar speaker 95*a*. Further, by arbitrarily adjusting an angle formed by the side lid 83 and the planar speaker 90 or an angle formed by the rear lid and the planar speaker 95*a*, it is possible to change, into a desired direction, the propagation direction of the sound after having been reflected on each lid body.

Third Embodiment

Referring next to the external view of FIG. 10, there will be explained an electronic keyboard musical instrument of a portable synthesizer type constructed according to a third embodiment of the present invention.

Figure 10A:
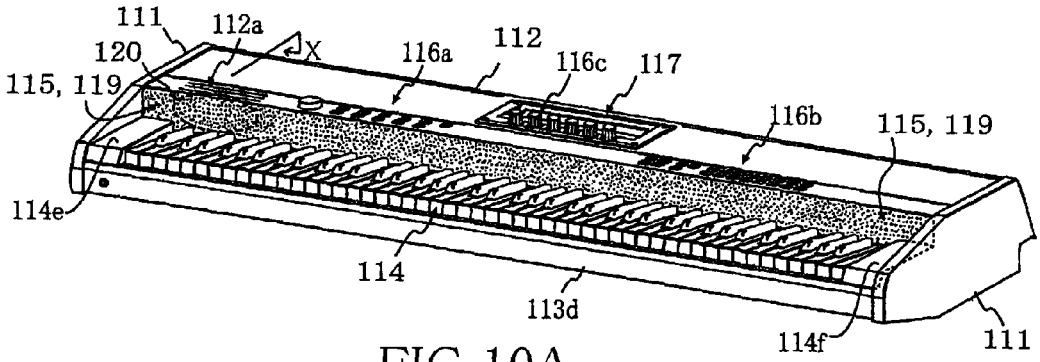
FIG. 10 is an external view of an electronic keyboard musical instrument of a portable synthesizer type according to a third embodiment of the invention.
Figure 10B:
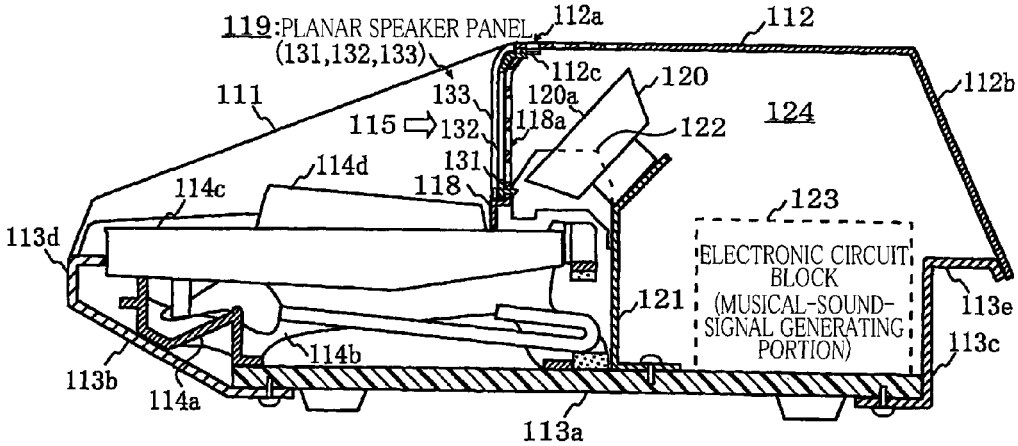

FIG. 10 A is a perspective view. FIG. 10B is a schematic view taken in the direction of the arrow X in FIG. 10A and showing a vertical cross section taken along line X.

In FIG. 10A, the reference numerals 111, 112, 113, 114 denote a side plate (side-surface portion), a top plate (roof portion), a bottom plate (bottom-surface portion), and a keyboard portion, respectively. The reference numeral 115 denotes an upper front portion. The side-surface portion includes the upper front portion 115, a rear inclined plate 112*b*, a rear plate 113*c*, and a lower front plate 113*d*, in addition to the side plate 111. The upper front portion 115 has an upper front plate 118.

The side plate (side-surface portion) 111, the top plate (roof portion) 112, the bottom plate (bottom-surface portion) 113, the keyboard portion 114, the upper front plate 118, and an inner space 124 constitute an instrument main body and also constitutes a casing of the electronic musical instrument. The instrument main body incorporates an electronic circuit block (musical-sound-signal generating portion) configured to generate a musical sound signal in response to a key operation by a performer with respect to the keyboard portion 114.

Here, the top plate 112 has one or a plurality of linear holes 112*a* in a front left region on its upper surface, namely, only in the bass range of the keyboard. Further, the top plate 112 has operation panels 116*a*, 116*b* disposed on opposite sides (left and right sides) of a front central portion thereof, and a display 117 and an operation panel 116*c* at a rear central portion thereof. As shown in FIG. 10B, the top plate 112 has the rear inclined plate 112*b* on its rear side.

The bottom plate 113 is obtained by assembling a front inclined plate 113*b* and the rear plate 113*c* to a base plate 113*a*. The front inclined plate 113*b* is formed integrally with the lower front plate 113*d*. An electronic circuit block 123 including the musical-sound-signal generating portion is placed at a rear region of the base plate 113*a*.

The side-surface portion of the instrument main body includes the upper front portion 115 between the roof portion (the top plate 112) and the keyboard portion 114, and a planar speaker 132 is disposed at the upper front portion 115.

As shown in FIG. 10B, a planar speaker panel 119 forms one surface of the casing. The planar speaker panel 119 is constituted by the planar speaker 132, a frame 131 to which the planar speaker 132 is attached, and a punching panel 133 which covers the planar speaker 132. The upper front plate 118 is disposed between the top plate 112 and the keyboard portion 114.

In this embodiment, the planar speaker panel 119 is installed on the front surface of the upper front plate 118, whereby the planar speaker 132 is disposed at a part of the instrument main body, such as the upper front portion 115.

Since the plane wave emitted from the planar speaker 132 has acute directivity, the location of the planar speaker 132 which permits the performer to listen well is the upper front portion 115. Therefore, even where a large area cannot be obtained due to the small height of the upper front portion 115, it is possible to ensure good propagation efficiency with respect to the performer owing to the acute directivity.

The upper front plate 118 is an elongate member extending in a left-right direction of the casing and has a grid-like framework in which one or a plurality of through-holes (sound holes) 118*a* are formed for sound transmission. The details will be later explained with reference to FIGS. 11 and 12. In the example later explained, a substantially entire surface of the upper front plate 118 is made as a grid portion 118*b*.

In addition, a cone speaker 120 is disposed in a left-side region of the instrument main body at the above-indicated upper front portion (side-surface portion) 115.

The planar speaker 132 is disposed at a position where the exterior and the inner space 124 of the casing of the electronic musical instrument are partitioned. The sound outputted from the planar speaker 132 propagates to both of the inner space 124 and the exterior.

The sound outputted from the front surface of the thus disposed planar speaker 132 is emitted to the exterior via the punching panel 133. In addition, the sound outputted from the rear surface of the planar speaker 132 propagates to the inner space 124 via the through-holes 118*a* formed in the upper front plate 118 and vibrates the casing portions such as the top plate 112 and the base plate 113*a*, thereby permitting secondary emission of the sound to the exterior or permitting emission of the sound via the linear holes 112*a* etc., through which the inner space 124 is open to the exterior.

A keyboard frame 114*a* of the keyboard portion 114 is fixed onto the base plate 113*a* and the front inclined plate 113*b*. The keyboard frame 114*a* is reinforced by a vertical rib 114*b* and supports white keys 114*c* and black keys 114*d*.

The cone speaker 120 is installed on a frame plate 121 that is erected on the base plate 113*a* and has a front opening portion 120*a* whose center axis is directed in a front oblique direction. Accordingly, the front opening portion 120*a* faces the back surface of the upper front plate 118 and the linear holes 112*a*. Further, a lower portion of the upper front plate 118 is supported by the frame plate 121 through a retainer 122.

The planar speaker panel 119 and the cone speaker 120 are disposed on opposite sides of the upper front portion 115, namely, on a front-surface side and a back-surface side of the upper front portion 115.

The cone speaker 120 is disposed such that its front opening portion 120*a* and a part of an opening region by the one or plurality of through-holes 118*a* are opposed to each other. In other words, the front opening portion 120*a* is opposed to a part of an acoustic transmission area which is a sum of the areas of the through-holes 118*a* formed in the upper front plate 118. In the illustrated embodiment, the cone speaker 120 is disposed such that its front opening portion 120*a* is located within a left end region of the instrument main body in a direction in which the keys of the keyboard portion 114 are arranged. This direction is hereinafter referred to as the "key arrangement direction" where appropriate.

On the other hand, the planar speaker 132 of the planar speaker panel 119 is disposed such that the vibrating surface of the planar speaker 132 and more than half of the opening region by the one or plurality of through-holes 118*a* are opposed to each other. In other words, the rear surface of the planar speaker 132 is opposed to more than half of the above-described sound transmission area.

In the illustrated embodiment, the vibrating surface of the planar speaker 132 extends in the longitudinal direction of the upper front plate 118 and is disposed on the front surface of the upper front plate 118 over substantially the same width of the keyboard portion 114 in the key arrangement direction.

Key blocks 114*e*, 114*f* are provided on opposite sides of keyboard portion 114. The width, in the key arrangement direction, of the keyboard portion 114 including the key blocks 114*e*, 114*f* is substantially the same as the width of the planar speaker 132. Accordingly, the area of the planar speaker 132 can be enlarged by increasing a breadth (the width in the key arrangement direction) of the planar speaker 132, so that the sound pressure in the bass range can be increased.

The planar speaker panel 119 and the cone speaker 120 overlap as viewed from the performer's side. Accordingly, the opening region by the one or plurality of through-holes 118*a* that is opposed to the front opening portion 120*a* of the cone speaker 120 and the opening region by the one or plurality of through-holes 118*a* that is opposed to the planar speaker 132 at least partially overlap. In the illustrated embodiment, the opening regions entirely overlap.

Each of the planar speaker 132 and the cone speaker 120 outputs a sound in accordance with a musical sound signal outputted from the electronic circuit block (the musical-sound-signal generating portion) 123.

The planar speaker 132 emits a sound from its front and rear surfaces. The one or plurality of through-holes 118*a* formed in the upper front plate 118 have a function of releasing the sound emitted from the rear surface of the planar speaker 132 toward the inner space 124 of the casing. Accordingly, even where the thickness of the air layer on the rear-surface side of the planar speaker 132 is small, the small thickness of the air layer is complemented and the resonance frequency by the vibrating plate of the planar speaker and the air layer does not become high.

The sound emitted from the front opening portion 120*a* of the cone speaker 120 is emitted frontward through the planar speaker 132 and is also emitted from the linear holes 112*a* of the top plate 112.

The planar speaker may be disposed at the front inclined plate 113*b* of the bottom plate (bottom-surface portion) or at the rear inclined plate 112*b*. The illustrated rear plate 113*c* has two sections (upper and lower sections) in the depth direction of the electronic keyboard musical instrument which are located at mutually different height positions. The planar speaker may be disposed at a rear upper bottom plate 113*e* as the upper section. The planar speaker may be disposed at a plurality of locations and accommodated in the casing of the electronic musical instrument.

In the embodiment of FIG. 1, the arrangement has been explained in which the multiplicity of through-holes (sound holes) are formed in the key bed 3 right below the keyboard portion 4, and the planar speaker is disposed on the key bed 3. Similar through-holes (sound holes) may be formed in the above-indicated front inclined plate 113*b*, rear inclined plate 112*b*, or rear upper bottom plate 113*e*, and the planar speaker may be disposed thereon.

On the other hand, the cone speaker 120 may be disposed at the base plate (key bed) 113*a*. The cone speaker 120 may be disposed at a plurality of locations of the electronic musical instrument.

FIG. 11 is a first explanatory view showing an installation structure of the planar speaker panel 119 shown in FIG. 10.

Figure 11A:
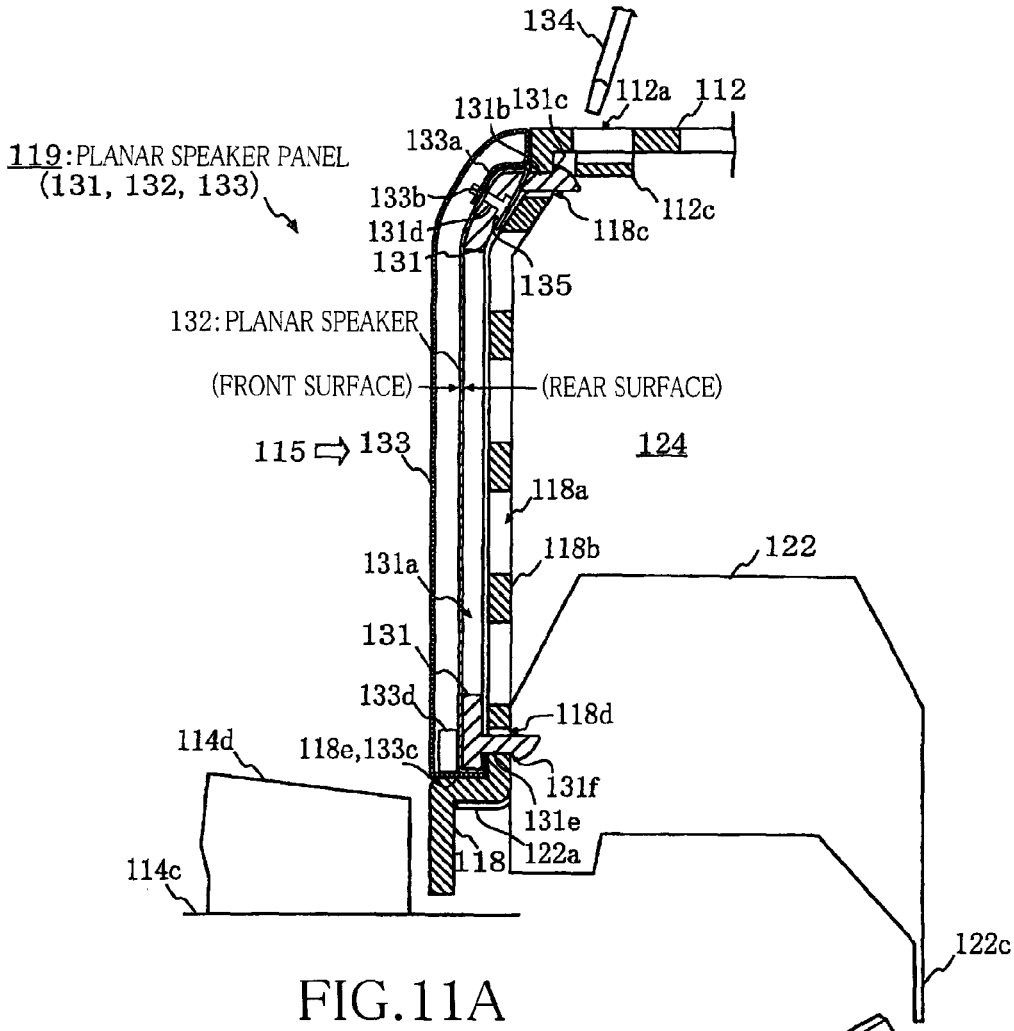
FIG. 11 is a first explanatory view showing an installation structure of a planar speaker in the third embodiment shown in FIG. 10.
Figure 11B:
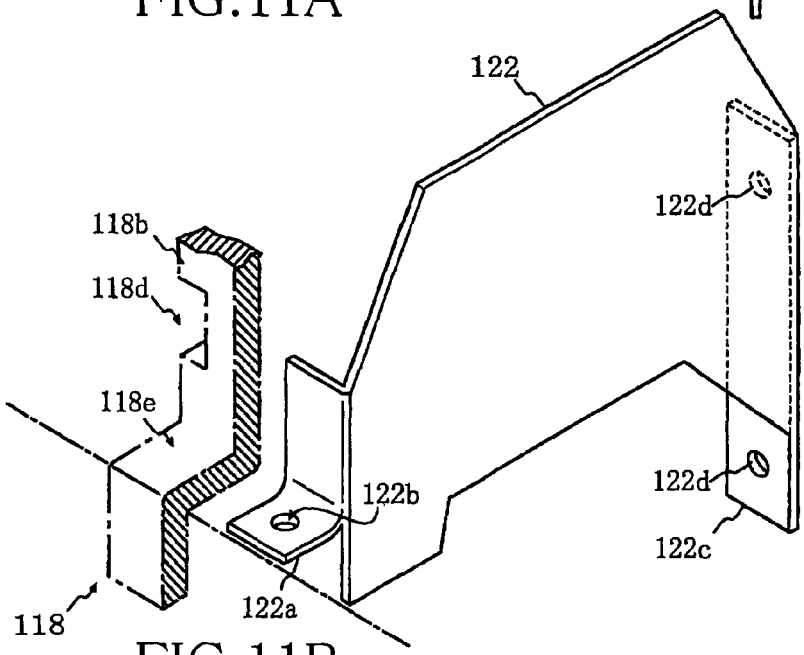

FIG. 11A is an enlarged view of a part of FIG. 10B in vertical cross section. FIG. 11B is a perspective view showing an installation structure of the retainer 122.

In the illustrated embodiment, the upper front plate 118 is formed integrally with the top plate 112. A plurality of elongate linear holes 112*a* are formed in the top plate 112. One of the linear holes which is located at the closest position with respect to the performer's side is defined by a linear plate 112*c* which is located at a height position lower than that of the top plate 112.

The plurality of through-holes 118*a* are formed over the entirety of the upper front plate 118, so as to provide a grid portion 118*b*. Attachment holes 118*c*, 118*d* are formed at a peripheral region of the grid portion 118*b*.

A lower part of the upper front plate 118 is bent frontward so as to provide a stepped portion 118*e*. The stepped portion 118*e* is attached, at its lower surface, to the retainer 122 by a screw not shown.

As shown in FIG. 11B, a front part of the retainer 122 is bent at right angle along the vertical line. A lower section of the bent portion is cut and bent upward so as to be horizontal, thus providing an attachment portion 122*a* in which is formed a screw hole 122*b* for attachment of the upper front plate 118.

As shown in FIG. 11B, a rear part of the retainer 122 is bent at right angle along the vertical line, so as to provide an attachment portion 122*c* in which is formed an attachment hole 122*d* for attachment of the retainer 122 to the frame plate 121 shown in FIG. 10B.

The frame 131 of the planar speaker panel 119 is a support member for the planar speaker 132 and has a large rectangular opening 131*a* at its central portion. Engaging protrusions are formed on the back surface of the frame 131, so as to be located at least two positions of each of an upper edge portion and a lower edge portion of the frame 131 in the key arrangement direction of the keyboard portion 114. Each engaging protrusion is constituted by a combination of an elastic deform portion 131*b* and an engaging portion 131*c* or a combination of an elastic deform portion 131*e* and an engaging portion 131*f*.

The planar speaker 132 covers a front surface of the frame 131, extends so as to enclose the upper and lower edge portions of the frame 131, and reaches the back surface of the frame 131, so that the planar speaker 132 is fixed to the frame 131 by an adhesive or the like.

An upper end portion 133*a* of the punching panel 133 is initially curved following a curved surface of an upper portion of the frame 131, is then bent at right angle along the front end surface of the top plate 112, and is finally bent so as to be in contact with the front surface of the upper portion of the frame 131. A screw 135 is inserted into an attachment hole 131*d* of the frame 131 and is screwed into a screw hole 133*b* formed through the planar speaker 132 and the bent portion of the punching panel 133.

Figure 12:
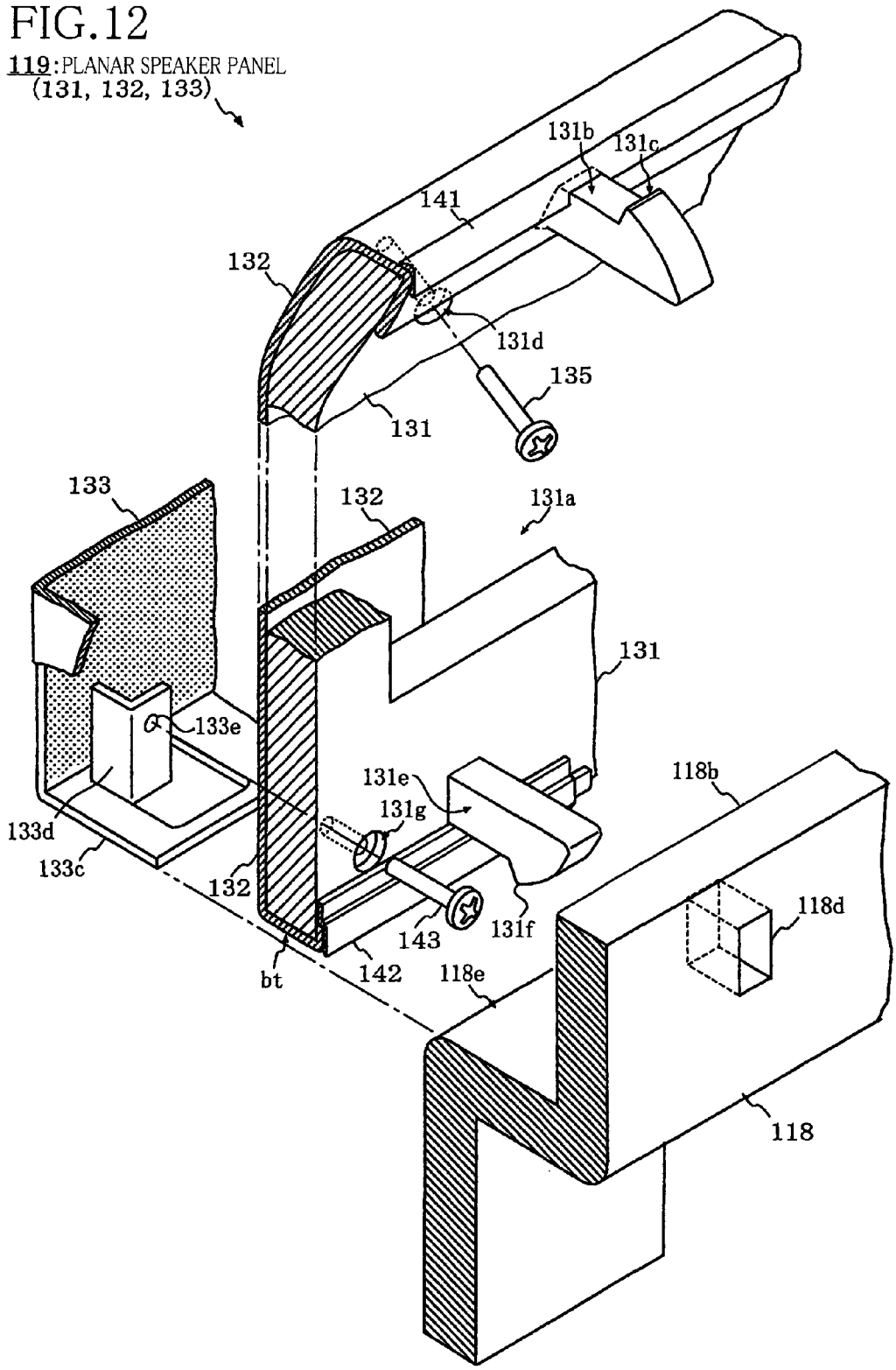
FIG. 12 is a second explanatory view showing the installation structure of the planar speaker in the third embodiment shown in FIG. 10.

As shown in FIG. 12, a lower end portion 133*c* of the punching panel 133 is bent at right angle with respect to the front surface of the frame 131 to which the planar speaker 132 is fixed. An upper surface of the lower end portion 133*c* overlaps a bottom surface bt of the planar speaker 132 in a state in which an attachment portion 133*d* formed at the lower end portion 133*c* of the punching panel 133 is held in contact with the planar speaker 132.

FIG. 12 is a second explanatory view of an installation structure of the planar speaker panel 119 shown in FIG. 10.

The frame 131 and the planar speaker 132 are fixed to the upper end portion 133*a* of the punching panel 133 shown in FIG. 11 by the screw 135.

A part of the lower end portion 133*c* of the punching panel 133 is cut and bent upward, so as to provide the above-described attachment portion 133*d* in which a screw hole 133*e* is formed. A screw 143 is inserted into an attachment hole 131*g* and is screwed into the screw hole 133*e* of the punching panel 133 through the frame 131 and the planar speaker 132. Accordingly, the lower end portion 133*c* of the punching panel 133 serves as the bottom surface of the planar speaker panel 119.

The above-indicated punching panel 133 is for protecting the planar speaker 132 and for permitting sound transmission therethrough. The punching panel 133 may be obtained by attaching a net to a frame not shown or may be a speaker grille provided by a synthetic resin plate in which a plurality of linear through-holes (sound holes) are formed.

In the planar speaker panel 119 described above (FIG. 12), each engaging protrusion (constituted by the elastic deform portion 131*b* and the engaging portion 131*c* or by the elastic deform portion 131*e* and the engaging portion 131*f*) is inserted into a corresponding one of attachment holes 118*c* (FIG. 11), 118*d*, as retaining portions, formed in the upper front plate 118. The engaging portion 131*c*, 131*f* is pushed into the attachment hole (retaining portion) 118*c*, 118*c*1, and the elastic deform portion 131*b*, 131*e* undergoes flexural deformation. After the engaging portion 131*c*, 131*f* has been inserted through the attachment hole 118*c*, 118*d*, the elastic deform portion 131*b*, 131*e* slightly recovers from the flexural deformation, so that the engaging portion 131*c*, 131*f* is brought into engagement with corner portions on the back of the attachment hole 118*c*, 118*d*. The lower end portion 133*c* of the punching panel 133 as the bottom surface of the planar speaker panel 119 is placed on the stepped portion 118*e* of the upper front plate 118.

In this way, the planar speaker panel 119 can be easily installed on and fixed to the upper front plate 118.

In the illustrated embodiment, the elastic deform portion 131*b*, 131*e* is provided on an engaging portion which is to be retained by a retaining portion, so as to constitute the engaging protrusion. However, the elastic deform portion may be provided on the retaining portion which is to retain the engaging portion. For instance, there may be formed, on the upper front plate 118, an engaging protrusion (constituted by an elastic deform portion and an engaging portion) similar to the above-indicated engaging protrusion (constituted by the elastic deform portion 131*b* and the engaging portion 131*c* or by the elastic deform portion 131*e* and the engaging portion 131*f*) while there may be formed, on the frame 131, an attachment hole having a configuration similar to the above-indicated attachment hole 118*c*, 118*d*. The elastic deform portion may be provided on both of the engaging portion and the retaining portion.

At one side of the planar speaker panel 119 at which its rear surface and its upper surface is contiguous to each other, a vibration damping member 141 is provided so as to extend in the key arrangement direction on the end portion of the planar speaker 132. Similarly, at one side of the planar speaker panel 119 at which its rear surface and its bottom surface is contiguous to each other, a vibration damping member 142 is provided so as to extend in the key arrangement direction on the end portion of the planar speaker 132. Each of the vibration damping members 141, 142 is a vibration damping rubber member, for instance. After the planar speaker panel 119 has been installed on the upper front plate 118, the vibration damping members 141, 142 exist in a clearance therebetween, so as to prevent the planar speaker panel 119 from being accidentally vibrated and detached from the upper front plate 118.

The planar speaker panel 119 described above may be detachably arranged. As shown in FIG. 11, a slight clearance is formed between the linear hole 112*a* and the linear plate 112*c* in the vicinity of the above-described engagement location of the engaging portion 131*c* and the attachment hole 118*c* (in the vicinity to such a extent that a force for releasing the engagement can be applied). Into this clearance, a slim and narrow tool such as a flat-head screwdriver 134 is inserted to push down the engaging portion 131*c* of the engaging protrusion, thereby causing flexural deformation of the elastic deform portion 131*b* and disengaging the engaging portion 131*c* and the attachment hole 118*c*. Subsequently, the engaging portion 131*c* is pulled out from the attachment hole 118*c*.

Thereafter, the planar speaker panel 119 is lifted above, whereby the engaging portion 131*f* and the attachment hole 118*d* of the lower engaging protrusion are disengaged. In this way, the engaging protrusions of the frame 131 are removed out of the attachment holes 118*c*, 118*d*, so that the planar speaker panel 119 can be detached from the upper front plate 118.

In the above explanation, a drive current is supplied to the planar speaker 132 by electrically connecting input lines drawn from the planar speaker 132 and output lines of the drive circuit in the electronic circuit block 123, using connecters such as plugs and sockets.

Alternatively, while not shown, an electric contact member may be provided in each of the above-indicated engaging protrusions (constituted by the elastic deform portion 131*b* and the engaging portion 131*c* or by the elastic deform portion 131*e* and the engaging portion 131*f*) and in each of the attachment holes 118*c*, 118*d*. Thus, the engaging protrusion and the attachment hole may be formed as not only mechanical coupling members, but also electric connectors (plug and socket).

The above-described planar speaker 132 may be configured to receive a monaural signal, like the planar speaker 7 shown in FIG. 7. Since the planar speaker 132 is long in the key arrangement direction, a planar speaker 132L for the left channel and a planar speaker 132R for the right channel may be installed as the planar speaker panel 119 on the upper front plate 118. Further, the planar speaker panel 119 per se may be divided for the left channel and the right channel, and may be installed on the upper front plate 118. In this instance, the cone speaker 120 disposed in the left-side region shown in FIG. 10A may also be disposed in the right-side region of the upper front portion (side-surface portion) 115, so as to provide stereo speakers.

In the second embodiment illustrated above, the propagation direction of the sound outputted from the planar speaker 95 is changed by utilizing the side lid 83. The second embodiment may be modified not to utilize the side lid 83. Further, the side plate 82 in the second embodiment may be configured not to have the through-holes 82*c* formed therein. In the second embodiment, the side lid 83 is configured to pivot about the axis. The side lid 83 may be configured to be attachable to and detachable from the side plate 82.

In the illustrated first through third embodiments, the planar speaker 7, 95, 132 is connected to the amplifier 73 via the booster transformer 74, the bias DC power source 75, and the resistor 76 (which constitute a circuit called "booster device"), as shown in FIG. 7A. The booster device is provided for permitting the planar speaker to generate the musical sound with a sufficient volume. Where the planar speaker has a sufficiently large surface area (e.g., 0.4 $m^2$ or more), the planar speaker is capable of generating the sound with a sufficient volume without the booster device. In the illustrated first through third embodiments, however, the planar speaker is connected to the amplifier 73 via the booster device for generating the sound with a sufficient volume when performance is carried out in a concert hall or a relatively large room.

Figure 7B:
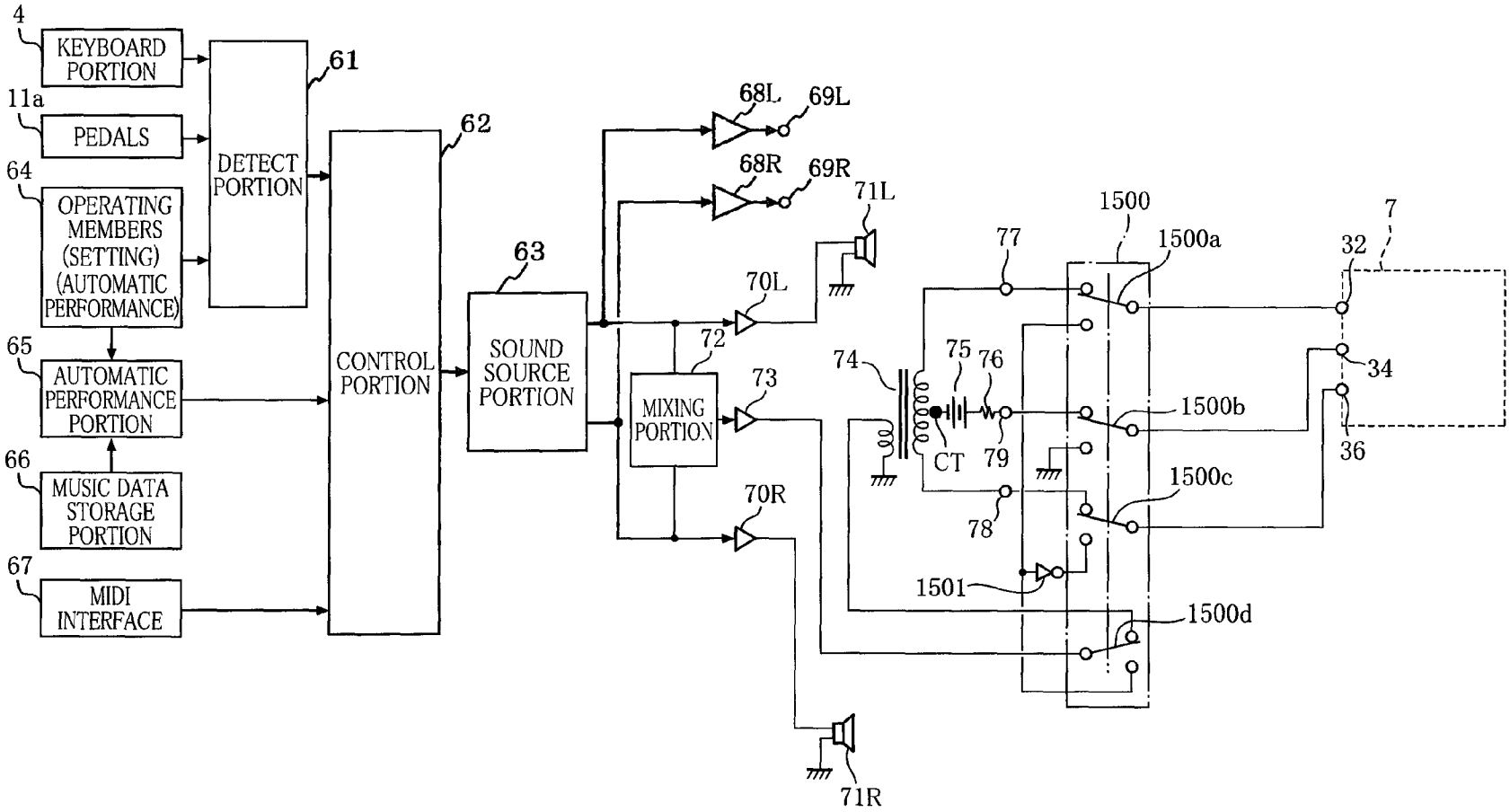

The above structure in which the planar speaker is connected to the amplifier 73 (the sound source portion 63) via the booster device is not an essential structure. Instead, where the planar speaker is connected to the amplifier 73 (the sound source portion 63) without the booster device, it is possible to generate the musical sound with a small volume having the directivity in a direction perpendicular to the plane of the planar speaker. In FIG. 7B, an interlock-type switch 1500 (a switching mechanism) is employed in the circuit of FIG. 7A. An analog inverter 1501 is configured to invert an analog signal from the amplifier 73 and is an inverting amplifier whose gain is 1. The interlock-type switch 1500 is capable of switching a connection state of the planar speaker 7 between: a state in which the planar speaker 7 is connected to the amplifier 73 via the booster device; and a state in which the planar speaker 7 is connected to the amplifier 73 without the booster device. The interlock-type switch 1500 is configured to switch four switch portions 1500*a*-1500*d* in an interlocking manner. When the interlock-type switch 1500 is in a state shown in FIG. 7B, the musical sound signal is inputted to the planar speaker via the booster device, so that the planar speaker 7 generates the musical sound with a relatively large volume. When the state of the interlock-type 1500 is changed from the state shown in FIG. 7B, the musical sound signal is inputted to the planar speaker without passing through the booster device, so that the planar speaker 7 generates the musical sound with a small volume optimum for performance at night. Because the musical sound generated from the planar speaker has a high degree of straight-line or rectilinear transmission property, the planar speaker generates the musical sound which can be heard well for the performer but is relatively hard to be heard for surroundings. It is possible to reduce power consumption by providing a mechanism for automatically turning off the booster device or a switch for turning off the booster, when the planar speaker 7 is connected to the amplifier without the booster device. The interlock-type switch may be an analog gate circuit formed of a semiconductor or the like.

The planar speaker may be divided into a plurality of regions (a plurality of planar speaker portions), and the magnitude of the musical sound generated from the planar speaker may be adjusted by determining from which one or ones of the planar speaker portions the musical sound is to be generated, depending upon situations. For instance, the planar speaker is divided into four regions in the horizontal direction, and there may be provided an on-off switch (switching mechanism) for switching a state of each of the planar speaker portions in the respective regions between an on state in which the musical sound is generated; and an off state in which the musical sound is not generated. According to the arrangement, it is possible to place all planar speaker portions in the four regions of the planar speaker into the on state, to place outermost two planar speaker portions (located at opposite ends of the planar speaker) into the on state, or to place only one of the four planar speaker portions into the on state. Therefore, the volume of the musical sound generated from the planar speaker can be adjusted, and the position of the planar speaker at which the musical sound is generated can be made optimum for the position of the performer.

Fourth Embodiment

Referring next to the external view of FIG. 13, there will be explained an electronic keyboard musical instrument of a portable synthesizer type constructed according to a fourth embodiment of the present invention.

Figure 13A:
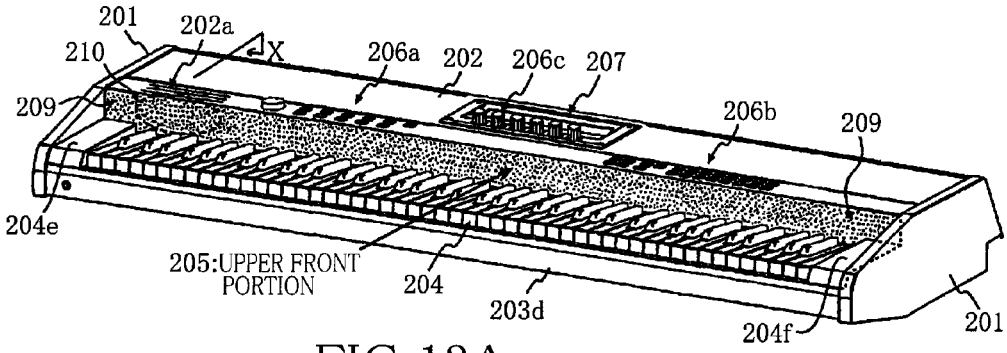
FIG. 13 is an external view of an electronic keyboard musical instrument of a portable synthesizer type according to a fourth embodiment of the invention.
Figure 13B:
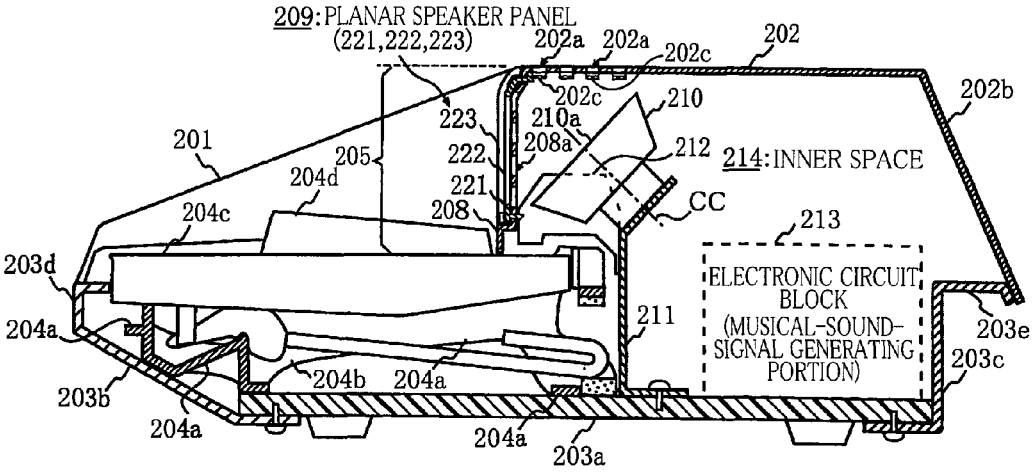

FIG. 13 A is a perspective view. FIG. 13B is a schematic view taken in the direction of the arrow X in FIG. 13A and showing a vertical cross section taken along line X.

In FIG. 13A, the reference numerals 201, 202, 203, 204 denote a side plate (side-surface portion), a top plate (roof portion), a bottom plate (bottom-surface portion), and a keyboard portion, respectively. The reference numeral 205 denotes an upper front portion. The side-surface portion includes the upper front portion 205, a rear inclined plate 202*b*, a lower rear plate 203*c*, and a lower front plate 203*d*, in addition to the side plate 201. The upper front portion 205 has an upper front plate 208.

The side plate (side-surface portion) 201, the top plate (roof portion) 202, the bottom plate (bottom-surface portion) 203, and the upper front plate 208 constitute a casing of the electronic musical instrument. Further, an instrument main body is constituted by those components and the keyboard portion 204 and an inner space 214.

The instrument main body incorporates an electronic circuit block (musical-sound-signal generating portion) 213 configured to generate a musical sound signal in response to a key operation by a user or performer with respect to the keyboard portion 204.

Here, the top plate 202 has one or a plurality of elongate, linear holes 202*a* in a front left region on its upper surface, namely, only in the bass range of the keyboard. Each linear hole 202*a* forms a pair with a corresponding linear plate 202*c* located at a lower position than the linear hole 202*a* and functions as a through-hole (sound hole). More strictly, a clearance between each linear hole 202*a* and each linear plate 202*c* functions as the through-hole (sound hole). The top plate 202 has operation panels 206*a*, 206*b* disposed on opposite sides (left and right sides) of a front central portion thereof, and a display 207 and an operation panel 206*c* at a rear central portion thereof. The display 207 displays musical sound parameters, music titles and scores of automatic performance, for operation settings of the electronic keyboard musical instrument.

As shown in FIG. 13B, the top plate 202 has the rear inclined plate 202*b* on its rear side. The bottom plate 203 is obtained by assembling a front inclined bottom plate 203*b* and a lower rear plate 203*c* to a base plate 203*a*. The front inclined bottom plate 203*b* is formed integrally with a lower front plate 203*d*.

The side-surface portion of the instrument main body includes the upper front portion 205 between the top plate 202 (roof portion) and the keyboard portion 204, and a planar speaker 222 is disposed at the upper front plate 208 of the upper front portion 205.

As shown in FIG. 13B, a planar speaker panel 209 is disposed in contact with an outer (front) surface of the upper front plate 208, as a member separate from the upper front plate 208, though the planar speaker panel 209 forms one surface of the casing. The planar speaker panel 209 is constituted by the planar speaker 222, a frame 221 to which the planar speaker 222 is attached, and a punching panel 223 which covers the planar speaker 222.

In this embodiment, the planar speaker panel 209 is installed on the front surface of the upper front plate 208, whereby the planar speaker 222 is disposed at a part of the instrument main body.

Since the plane wave emitted from the planar speaker 222 has acute directivity, the location of the planar speaker 222 which permits the performer to listen well is on the upper front portion 205. Therefore, even where a large area cannot be obtained due to the small height of the upper front portion 205, it is possible to ensure a good propagation efficiency with respect to the performer.

In other words, the planar speaker 222 (the planar speaker panel 209) is disposed outside the casing constituted by the side plate 201, the top plate 202, the bottom plate 203, and the upper front plate 208. Here, "the planar speaker 222 (the planar speaker panel 209) is disposed outside the casing" means that the planar speaker is not disposed inside the casing. Examples of disposing the planar speaker outside the casing independently of the casing include: an arrangement of a fourth embodiment described below in which the planar speaker is constituted as a member separate from the casing though the planar speaker constitutes one surface of the casing and in which the planar speaker is disposed at a position where the planar speaker is capable of outputting a sound directly outside the casing; and arrangements of fifth and sixth embodiments described below in which the planar speaker per se is disposed separately from the casing and outside the casing.

The upper front plate 208 is an elongate member extending in a left-right direction of the casing and has a grid-like framework in which one or a plurality of through-holes (sound holes) 208*a* are formed for sound transmission. The details will be later explained with reference to FIGS. 14 and 15. In the example later explained, a substantially entire surface of the upper front plate 208 is made as a grid portion 208*b*.

In addition, a dynamic (electrodynamic) cone speaker 210 (hereinafter simply referred to as "cone speaker") is disposed in a left-side region of the instrument main body at the above-indicated upper front portion 205.

The planar speaker 222 is disposed at a position where the exterior and the inner space 214 of the casing of the electronic musical instrument are partitioned. The sound outputted from the planar speaker 222 propagates to both of the inner space 214 and the exterior.

The sound outputted from the front surface of the thus disposed planar speaker 222 is emitted to the exterior via the punching panel 223. In addition, the sound outputted from the rear surface of the planar speaker 222 propagates to the inner space 214 via the through-holes 208*a* formed in the upper front plate 208 and vibrates the casing portions such as the top plate 202 and the base plate 203*a*, thereby permitting secondary emission of the sound to the exterior or permitting propagation of the sound via the linear holes 202*a* etc., through which the inner space 214 is open to the exterior.

A keyboard frame 204*a* of the keyboard portion 204 is fixed onto the base plate 203*a* and the front inclined bottom plate 203*b*. The keyboard frame 204*a* is reinforced by a vertical rib 204*b* provided below the keyboard between a predetermined key and its adjacent key and supports white keys 204*c* and black keys 204*d*.

The cone speaker 210 is installed on a frame plate 211 that is erected on the base plate 203*a* and has a front opening portion 210*a* whose center axis CC is directed in a front oblique direction. Accordingly, the front opening portion 120*a* faces the back surface of the upper front plate 208 and the linear holes 202*a*. Further, a lower portion of the upper front plate 208 is supported by the frame plate 211 through a retainer 212.

In the illustrated embodiment, the center axis CC of the front opening portion 210*a* is directed upward at an angle of about 45° with respect to the horizontal line. As the center axis CC gets closer to the vertical direction, a sound outputted from the back surface of the cone speaker 210 (i.e., a sound in an opposite phase to a sound outputted from the front opening portion 210*a*) is also outputted from the upper front portion 205 and interferes in phase with the sound outputted from the front opening portion 210*a*. This is not desirable because the output of the sound to propagate directly to the performer is reduced. In this respect, the sound outputted from the back surface of the cone speaker 210 and outputted through the linear holes 202*a* does not give a substantial influence at the position of the performer.

The planar speaker panel 209 and the cone speaker 210 are disposed on opposite sides of the upper front portion 208, namely, on a front-surface side and a back-surface side of the upper front portion 208.

The cone speaker 210 is disposed such that its front opening portion 210*a* and a part of an opening region by the one or plurality of through-holes 208*a* are opposed to each other. In other words, the front opening portion 210*a* is opposed to a part of an acoustic transmission area which is a sum of the areas of the through-holes 118*a* formed in the upper front plate 208. In the illustrated embodiment, the cone speaker 210 is disposed such that its front opening portion 210*a* is located within a left end region of the instrument main body in a direction in which keys of the keyboard portion 204 are arranged. This direction is hereinafter referred to as the "key arrangement direction" where appropriate.

On the other hand, the planar speaker 222 of the planar speaker panel 209 is disposed such that the vibrating surface of the planar speaker 222 and more than half of the opening region by the one or plurality of through-holes 208*a* are opposed to each other. In other words, the rear surface of the planar speaker 222 is opposed to more than half of the above-described sound transmission area.

In the illustrated embodiment, the planar speaker 222 has a shape which is long in the longitudinal direction of the upper front plate 208 and is disposed on the front surface of the upper front plate 208 over substantially the same width of the keyboard portion 204 in the key arrangement direction. Key blocks 204*e*, 204*f* are provided on opposite sides of keyboard portion 204. The width, in the key arrangement direction, of the keyboard portion 204 including the key blocks 204*e*, 204*f* is substantially the same as the width of the planar speaker 222.

Accordingly, the area of the planar speaker 222 can be enlarged by increasing a breadth (the width in the key arrangement direction) of the planar speaker 222, so that the sound pressure in the bass range is increased, thereby lowering a degree of reduction of the sound pressure in the bass range.

The planar speaker panel 209 and the cone speaker 210 overlap as viewed from the performer's side. Accordingly, the opening region by the one or plurality of through-holes 208*a* that is opposed to the front opening portion 210*a* of the cone speaker 210 and the opening region by the one or plurality of through-holes 208*a* that is opposed to the planar speaker 210 at least partially overlap. In the illustrated embodiment, the opening regions entirely overlap. The electrostatic planar speaker 222 is like a film and has sound transmission property. Accordingly, even where the opening regions overlap, the sound outputted from the cone speaker 210 is also outputted frontward.

Each of the planar speaker 222 and the cone speaker 210 outputs a sound in accordance with a musical sound signal outputted from the electronic circuit block (the musical-sound-signal generating portion) 213.

The planar speaker 222 emits a sound from its front and rear surfaces. In the planar speaker 222, an air spring by an air layer on its rear-surface side and the vibrating plate resonate, and the sound pressure is lowered at a frequency lower than the resonance frequency. Here, the resonance frequency becomes higher with an increase in the thickness of the air layer on the rear-surface side. Accordingly, where the planar speaker 222 is disposed outwardly of a plate body (the illustrated upper front plate 208), an air layer with a sufficiently large thickness needs to be formed on the rear-surface side of the planar speaker 222. The thickness of the air layer may be 1 cm and may be 3 cm at most.

Where the one or plurality of through-holes 208*a* are formed in the plate body (the upper front plate 208), the through-holes 208*a* offer a function of releasing the sound outputted from the rear surface of the planar speaker 222 toward the inner space 214 of the casing. Accordingly, even where the thickness of the air layer on the rear-surface side of the planar speaker 222 is small, the small thickness of the air layer is complemented and the resonance frequency indicated above does not become too high.

The sound emitted from the front opening portion 210*a* of the cone speaker 210 is emitted frontward through the planar speaker 222 and is also emitted from the linear holes 202*a* of the top plate 202.

The planar speaker may be disposed at the front inclined bottom plate 203*b* of the bottom plate (bottom-surface portion) or at the rear inclined plate 202*b*. The illustrated lower rear plate 203*c* has two sections (upper and lower sections) in the depth direction of the electronic keyboard musical instrument which are located at mutually different height positions. The planar speaker may be disposed at a rear upper bottom plate 203*e* as the upper section. By forming a multiplicity of through-holes (sound holes) in the front inclined bottom plate 203*b*, the rear inclined plate 202*b*, or the rear upper bottom plate 203*e*, the planar speaker may be disposed at those plates. The planar speaker may be disposed at a plurality of locations. Further, the planar speaker may be disposed outside the casing or inside the casing.

On the other hand, the cone speaker 210 may be disposed at the base plate (the key bed) 203*a* or may be disposed at a plurality of locations of the electronic musical instrument.

FIG. 14 is a first explanatory view showing an installation structure of the planar speaker shown in FIG. 13.

Figure 14A:
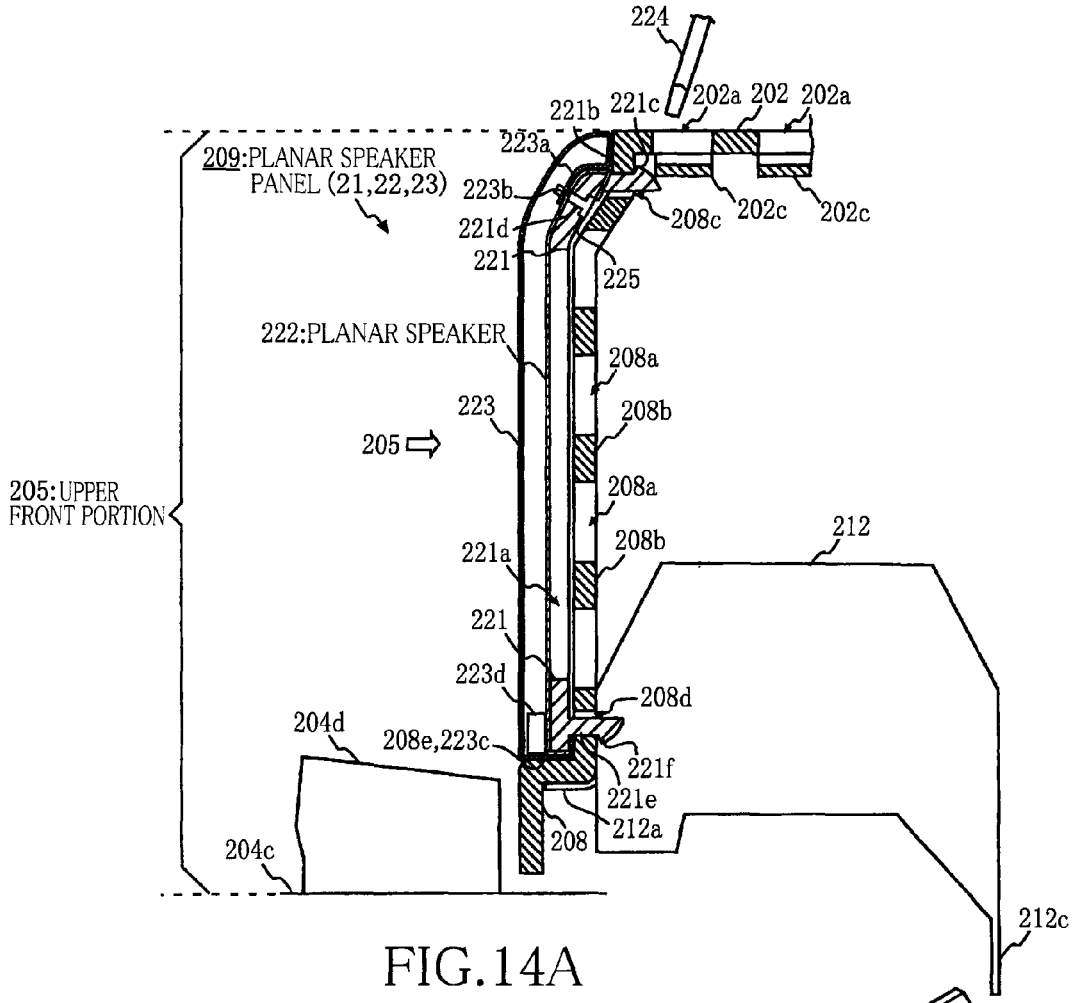
FIG. 14 is a first explanatory view showing an installation structure of a planar speaker in the fourth embodiment shown in FIG. 13.
Figure 14B:
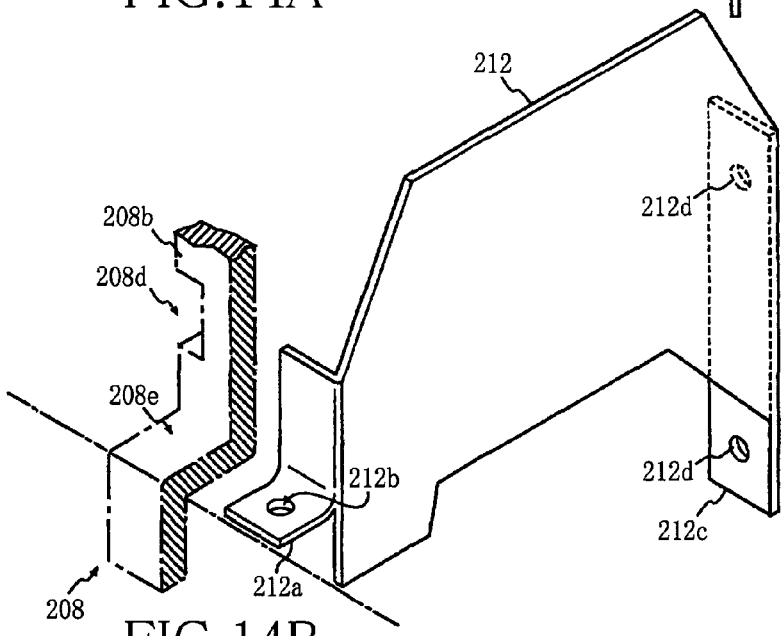

FIG. 14A is an enlarged view of a part of FIG. 13B in vertical cross section. FIG. 14B is a perspective view showing an installation structure of the retainer 212.

In the illustrated embodiment, the upper front plate 208 is formed integrally with the top plate 202. The plurality of through-holes 208*a* are formed over the entirety of the upper front plate, so as to provide a grid portion 208*b*. Attachment holes 208*c*, 208*d* are formed at a peripheral region of the grid portion 208*b*.

A lower part of the upper front plate 208 is bent frontward so as to provide a stepped portion 208*e*. The stepped portion 208*e* is attached, at its lower surface, to the retainer 212 by a screw not shown.

As shown in FIG. 14B, a front part of the retainer 212 is bent at right angle along the vertical line. A lower section of the bent portion is cut and bent upward so as to be horizontal, thus providing an attachment portion 212*a* in which is formed a screw hole 212*b* for attachment of the upper front plate 208.

As shown in FIG. 14B, a rear part of the retainer 212 is bent at right angle along the vertical line, so as to provide an attachment portion 212*c* in which is formed an attachment hole 212*d* for attachment of the retainer 212 to the frame plate 211 shown in FIG. 13B.

The frame 221 of the planar speaker panel 209 is a support member for the planar speaker 222 and has a large rectangular opening 221*a* at its central portion. Engaging protrusions are formed on the back surface of the frame 221, so as to be located at least two positions of each of an upper edge portion and a lower edge portion of the frame 221 in the key arrangement direction of the keyboard portion 204. As shown in enlargement in FIG. 15, each engaging protrusion is constituted by a combination of an elastic deform portion 221*b* and an engaging portion 221*c* or a combination of an elastic deform portion 221*e* and an engaging portion 221*f*.

The planar speaker 222 covers a front surface of the frame 221, subsequently extends so as to enclose the upper and lower edge portions of the frame 221, and finally reaches the back surface of the frame 221, so that the planar speaker 222 is fixed to the frame 221 by an adhesive or the like.

An upper end portion 223*a* of a punching panel 223 is initially curved following a curved surface of an upper portion of the frame 221, is then bent at right angle along the front end surface of the top plate 202, and is finally bent so as to be in contact with the front surface of the upper portion of the frame 221. A screw 225 is inserted into an attachment hole 221*d* of the frame 221 and is screwed into a screw hole 223*b* formed through the planar speaker 222 and the bent portion of the punching panel 223.

Figure 15:
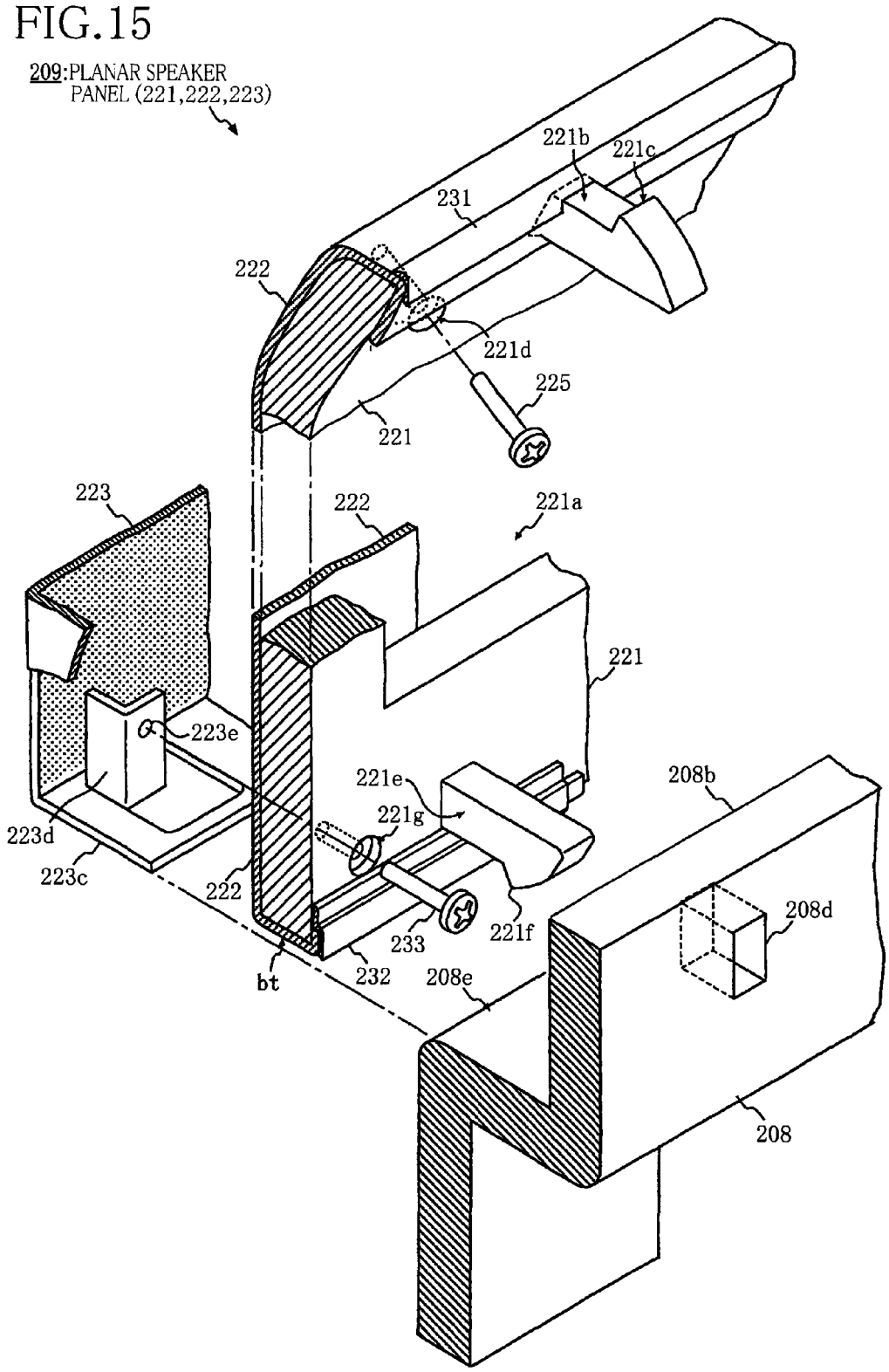
FIG. 15 is a second explanatory view showing the installation structure of the planar speaker in the fourth embodiment shown in FIG. 13.

As shown in FIG. 15, a lower end portion 223*c* of the punching panel 223 is bent at right angle with respect to the front surface of the frame 221 to which the planar speaker 222 is fixed. An upper surface of the lower end portion 223*c* overlaps a bottom surface bt (FIG. 15) of the planar speaker 222 in a state in which an attachment portion 223*d* formed at the lower end portion 223*c* of the punching panel 223 is held in contact with the planar speaker 222.

FIG. 15 is a second explanatory view of an installation structure of the planar speaker panel 209 shown in FIG. 13.

The frame 221 and the planar speaker 222 are fixed to the upper end portion 223*a* of the punching panel 223 shown in FIG. 14 by the screw 225.

A part of the lower end portion 223*c* of the punching panel 223 is cut and bent upward, so as to provide the above-described attachment portion 223*d* in which a screw hole 223*e* is formed. A screw 233 is inserted into an attachment hole 221*g* and is screwed into the screw hole 223*e* of the punching panel 223 through the frame 221 and the planar speaker 222. Accordingly, the lower end portion 223*c* of the punching panel 223 serves as the bottom surface of the planar speaker panel 209.

The above-indicated punching panel 223 is for protecting the planar speaker 222 and for permitting sound transmission therethrough. The punching panel 223 may be obtained by attaching a net to a frame not shown or may be a speaker grille provided by a synthetic resin plate in which a plurality of linear through-holes (sound holes) are formed.

In the planar speaker panel 209 described above (FIG. 15), each engaging protrusion (constituted by the elastic deform portion 221*b* and the engaging portion 221*c* or by the elastic deform portion 221*e* and the engaging portion 221*f*) is inserted into a corresponding one of attachment holes 208*c* (FIG. 14), 208*d* (FIGS. 14 and 15), as retaining portions, formed in the upper front plate 208. The engaging portion 221*c*, 221*f* is pushed into the attachment hole (retaining portion) 208*c*, 208*d*, and the elastic deform portion 221*b*, 221*e* undergoes flexural deformation. After the engaging portion 221*c*, 221*f* has been inserted through the attachment hole 208*c*, 208*d*, the elastic deform portion 221*b*, 221*e* slightly recovers from the flexural deformation, so that the engaging portion 221*c*, 221*f* is brought into engagement with corner portions on the back of the attachment hole 208*c*, 208*d*. The lower end portion 223*c* of the punching panel 223 as the bottom surface of the planar speaker panel 209 is placed on the stepped portion 208*e* of the upper front plate 208.

In this way, the planar speaker panel 209 can be easily installed on the upper front plate 208. Further, the elasticity of the elastic deform portion 221*b*, 221*e* prevents the frame 221 from rattling due to vibration of the planar speaker 222.

Here, the engaging portion 221*c*, 221*f* means an engagement member provided on a component to be attached to the casing while the retaining portion (the attachment hole 208*c*, 208*d*) means an engagement member provided on a component of the casing. The attachment hole 208*c*, 208*d* indicated above is one example of the retaining portion and is not limited to the attachment hole.

In the illustrated embodiment, the elastic deform portion 221*b*, 221*e* is provided on an engaging portion which is to be retained by a retaining portion, so as to constitute the engaging protrusion. However, the elastic deform portion may be provided on the retaining portion which is to retain the engaging portion. For instance, there may be formed, on the upper front plate 208, an engaging protrusion (constituted by an elastic deform portion and an engaging portion) similar to the above-indicated engaging protrusion (constituted by the elastic deform portion 221*b* and the engaging portion 221*c* or by the elastic deform portion 221*e* and the engaging portion 221*f*) while there may be formed, on the frame 221, an attachment hole having a configuration similar to the above-indicated attachment hole 208*c*, 208*d*. The elastic deform portion may be provided on both of the engaging portion and the retaining portion.

At one side of the planar speaker panel 209 at which its rear surface and its upper surface is contiguous to each other, a vibration damping member 231 is provided so as to extend in the key arrangement direction on the end portion of the planar speaker 222. Similarly, at one side of the planar speaker panel 209 at which its rear surface and its bottom surface is contiguous to each other, a vibration damping member 232 is provided so as to extend in the key arrangement direction on the end portion of the planar speaker 222. Each of the vibration damping members 231, 232 is a vibration damping rubber member, for instance. After the planar speaker panel 209 has been installed on the upper front plate 208, the vibration damping members 231, 232 exist in a clearance therebetween, so as to prevent the planar speaker panel 209 from being accidentally vibrated and detached from the upper front plate 208.

The planar speaker panel 209 described above is detachably arranged.

As shown in FIG. 14, a slight clearance is formed between the linear hole 202*a* and the linear plate 202*c* in the vicinity of the above-described engagement location of the engaging portion 221*c* and the attachment hole 208*c* (in the vicinity to such an extent that a force for releasing the engagement can be applied). Into this clearance, a slim and narrow tool such as a flat-head screwdriver 224 is inserted to push down the engaging portion 221*c* of the engaging protrusion, thereby causing flexural deformation of the elastic deform portion 221*b* and disengaging the engaging portion 221*c* and the attachment hole 208*c*. Subsequently, the engaging portion 221*c* is pulled out from the attachment hole 208*c*.

Thereafter, the planar speaker panel 209 is lifted above, whereby the engaging portion 221*f* and the attachment hole 208*d* of the lower engaging protrusion are disengaged. In this way, the engaging protrusions of the frame 221 are removed out of the attachment holes 208*c*, 208*d*, so that the planar speaker panel 209 can be detached from the upper front plate 208.

The planar speaker panel 209 has the engagement locations at a plurality of locations in the key arrangement direction. Accordingly, at the engagement location(s) where the above-described linear holes 2*a* are not formed, a through-hole(s), not shown, into which the tool is to be inserted, is formed in the top plate 202.

The above-described planar speaker 222 may be configured to receive a monaural signal. Since the planar speaker 222 is long in the key arrangement direction, a planar speaker 222L for the left channel and a planar speaker 222R for the right channel may be installed as the planar speaker panel 209 on the upper front plate 208. Further, the planar speaker panel 209 per se may be divided for the left channel and the right channel, and may be installed on the upper front plate 208. In this instance, the cone speaker 210 disposed in the left-side region shown in FIG. 13A may also be disposed in the right-side region of the upper front portion 205, so as to provide stereo speakers.

In the above explanation, a drive current is supplied to the planar speaker 222 by electrically connecting input lines drawn from the planar speaker 222 and output lines of the drive circuit in the electronic circuit block 213, using connecters such as plugs and sockets.

In this instance, apart from the above-described engaging protrusions (the elastic deform portions 221*b*, 221*e*, the engaging portions 221*c*, 221*f*), a plurality of plugs for electric connection may be provided on the frame 221. Further, apart from the above-described attachment holes (the retaining portions) 208*c*, 208*d*, a plurality of sockets for electric connection may be provided on the upper front plate (support body) 208. In this case, in a state in which the engaging protrusions and the attachment holes are held in mechanical engagement with each other, each electric contact element of the plurality of plugs and each electric contact element of the plurality of sockets are held in contact with each other for electric connection.

Alternatively, as explained below, an electric contact member may be provided in each of the above-indicated engaging protrusions (constituted by the elastic deform portion 221*b* and the engaging portion 221*c* or by the elastic deform portion 221*e* and the engaging portion 221*f*) and in each of the attachment holes 208*c*, 208*d*. Thus, the engaging protrusion and the attachment hole may be formed as not only mechanical coupling members, but also electric connectors (plug and socket).

The planar speaker 222 has three electrodes. Accordingly, where the planar speaker panel 209 is monaural, at least three engaging protrusions are formed as plugs. Where the planar speaker panel 209 is stereo, at least six engaging protrusions are formed as plugs.

FIGS. 16 and 17 are explanatory views showing another specific example of an installation structure of the planar speaker in the embodiment shown in FIG. 13. In FIGS. 16 and 17, the same reference numerals as used in FIGS. 13-15 are used to identify the corresponding components.

Figure 16A:
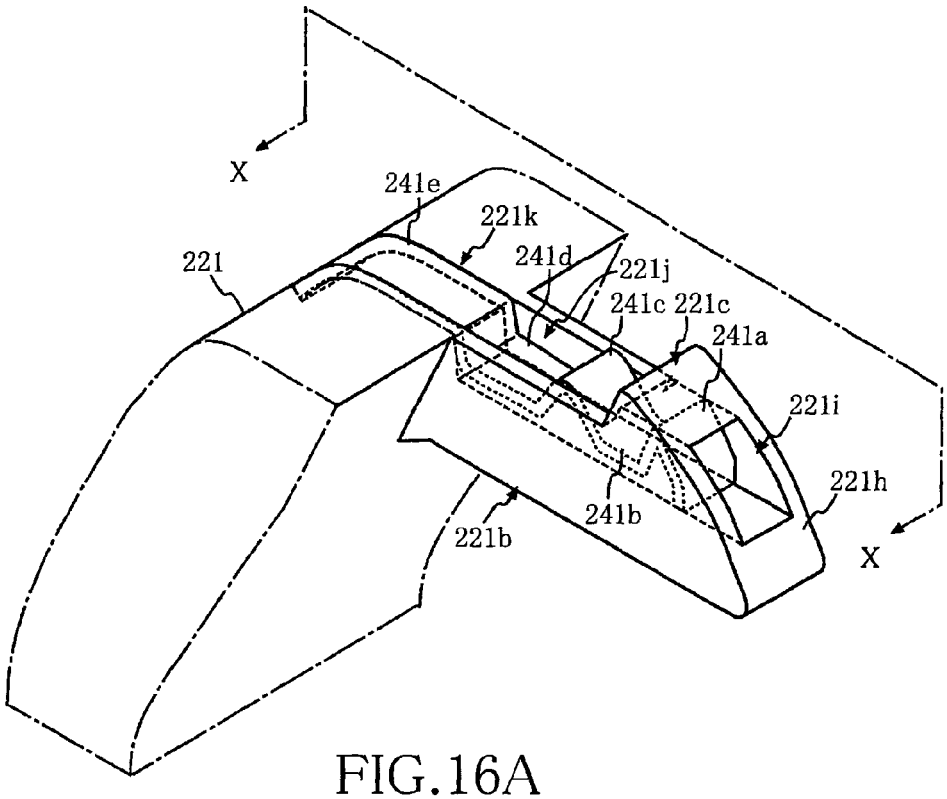
FIG. 16 is a first explanatory view showing another specific example of the installation structure of the planar speaker in the fourth embodiment shown in FIG. 13.
Figure 16B:
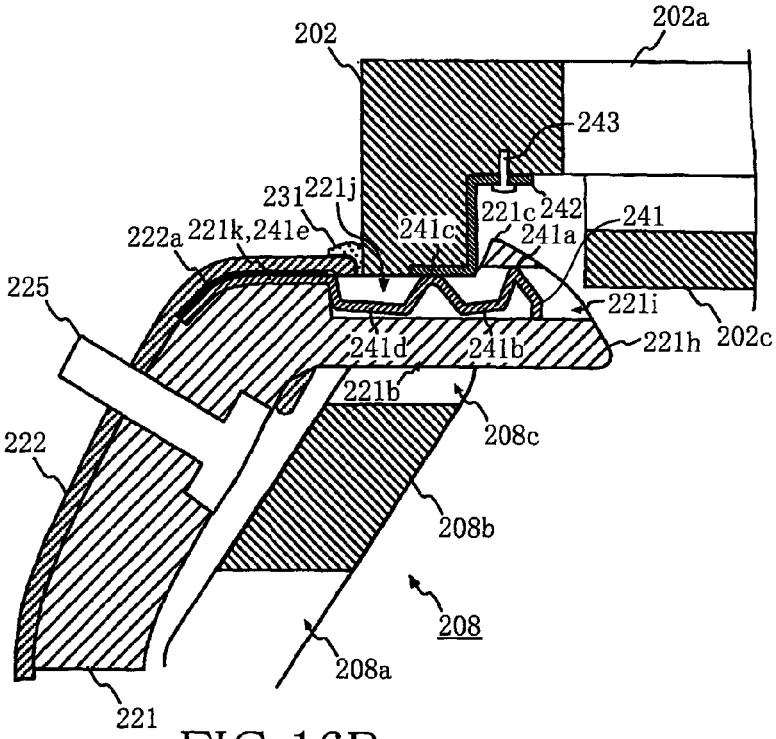

FIG. 16A is an enlarged view of an upper part of the frame 221 shown in FIG. 15. The illustration of the planar speaker 222 is omitted. FIG. 16B is a vertical cross-sectional view of FIG. 16A, showing a vertical cross section in the direction of arrows X. The planar speaker 222, the top plate 202, and the upper front plate 208 are partially illustrated.

In FIG. 16A, the engaging protrusion (the elastic deform portion 221*b*, the engaging portion 221*c*) functions as a plug. A through-hole 221*i* is formed in an inclined surface 221*h* of the engaging portion 221*c* and communicates with a groove 221*j* of the elastic deform portion 221*b*. The groove 221*j* communicates with a shallow groove 221*k* formed in an upper end surface of the frame 221.

The reference numeral 241 denotes a conductive elastic member. The conductive elastic member 241 is a plate member with bends, including: convex portions 241*a*, 241*c*, 241*e*; and a concave portion 241*b* between the convex portions 241*a*, 241*c* and a concave portion 241*d* between the convex portions 241*c*, 241*e*. Each of the convex portions 241*a*, 241*c* has a triangular shape, each of the concave portions 241*b*, 241*d* is flat, and the convex portion 241*e* is curved.

In the conductive elastic member 241, the convex portion 241*c* is inserted into the groove 221*j*, the convex portion 241*e* is fitted in the shallow groove 221*k*, and the convex portion 241*a* is press-fitted in the through-hole 221*i*. A clearance is present between the concave portions 241*b*, 241*d* and the bottom surface of the groove 221*j*.

On the other hand, the attachment hole 208*c* of the upper front plate 208 shown in FIG. 16B is made as a socket. A conductive member 242 is provided at an upper corner portion on the back surface of the attachment hole 208*c*. This conductive member 242 is bent at right angle twice and is fixed to the back surface of the top plate 202 by a screw 243.

When the engaging portion 221*c* of the engaging protrusion engages the attachment hole 208*c*, the second convex portion 241*c* of the conductive elastic member 241 comes into contact with the conductive member 242 and presses the same 242 owing to its elastic force. As a result, when the upper part of the frame 221 engages the upper front plate 208, a pair of connection terminals are electrically connected at the above-indicated one engagement portion.

The convex portion 241*e* of the conductive elastic member 241*e* comes into surface contact with a connection terminal 22*a* of the planar speaker 222, thereby being connected to one electrode of the planar speaker 222. On the other hand, the conductive member 242 is connected to the electronic circuit block 213 shown in FIG. 13B by a connect line not shown.

The elastic deform portion 221*b* keeps the elastic force during engagement, and the upper surface of the elastic deform portion 221*b* (in which the groove 221*j* is formed) is pressing the upper surface of the attachment hole 208*c* (the lower surface of the top plate 202).

In this respect, there may be designed such that the upper surface of the elastic deform portion 221*b* does not contact the upper surface of the attachment hole 208*c* during engagement, thereby permitting the conductive elastic member 241 to press only the conductive member 242. In this case, the engaged state is maintained by elastic forces of both of the elastic deform portion 221*b* and the conductive elastic member 241.

Further, the conductive elastic member 241 may be replaced with a mere conductive member whose elastic deformation is ignorable, and the mere conductive member may contact and press the conductive member 242 by only the elasticity of the elastic deform portion 221*b*.

Figure 17A:
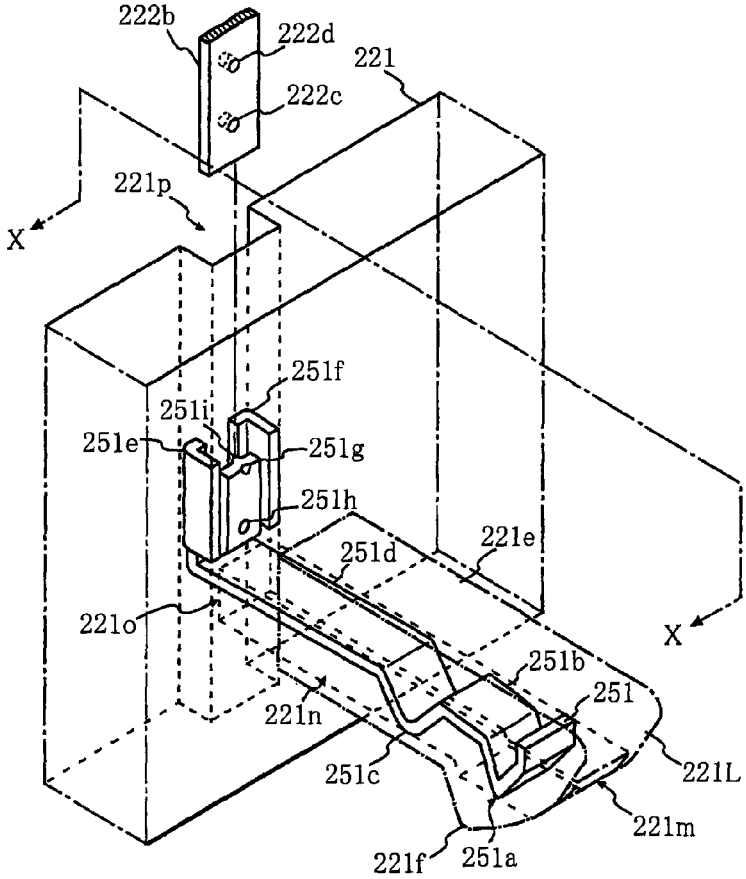
FIG. 17 is a second explanatory view showing another specific example of the installation structure of the planar speaker in the fourth embodiment shown in FIG. 13.

FIG. 17A is an enlarged view of a lower part of the frame 221 shown in FIG. 15. The illustration of the planar speaker 222 is omitted. For clearly illustrating a conductive elastic member 251 described below, an outline of the engaging protrusion (the elastic deform portion 221*e*, the engaging portion 221*f*) is indicated by long dashed and short dashed line, and an outline of the conductive elastic member 251*d* hidden by this engaging protrusion is indicated by solid line.

Figure 17B:
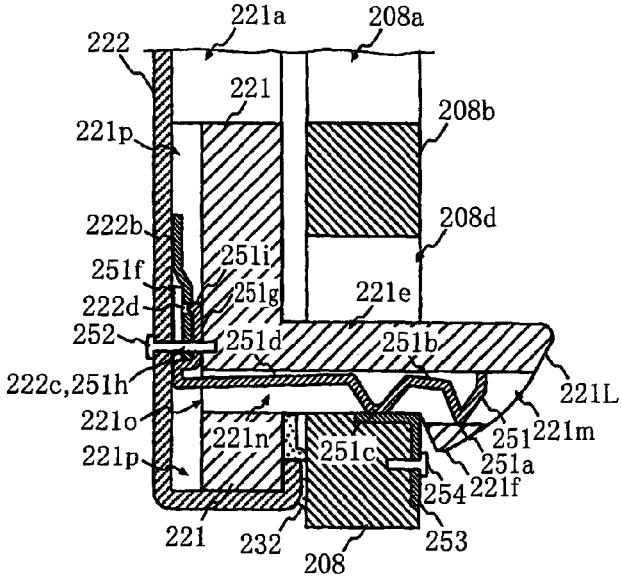

FIG. 17B is a vertical cross-sectional view of FIG. 17A, showing a vertical cross section in the direction of arrows X. The planar speaker 222 and the upper front plate 208 are partially illustrated.

The same reference numerals as used in FIG. 15 are used in FIG. 17 to identify the corresponding components.

In FIG. 17A, the engaging protrusion (the elastic deform portion 221*e*, the engaging portion 221*f*) functions as a plug. A through-hole 221*m* is formed in an inclined surface 221L of the engaging portion 221*f* and communicates with a groove 221*n* of the elastic deform portion 221*e*. The groove 221*n* communicates with a through-hole of the frame 221, and an opening 221*o* is formed on the front surface of the frame 221.

The reference numeral 251 denotes a conductive elastic member and has a contact section and a terminal section. The contact section includes: concave portions 251*a*, 251*c*; a convex portion 251*b* between the concave portions 251*a*, 251*c* and a convex portion 251*d* extending from the concave portion 251*c*. Each of the concave portions 251*a*, 251*c* has a triangular shape, and each of the convex portions 251*b*, 251*d* is flat. One end of the convex portion 251*d* is perpendicularly bent and is connected to the terminal section.

The terminal section is formed to have a width larger than the width of the convex portion 251*d*. Widthwise opposite end portions 251*e*, 251*f* of the terminal section are bent toward the contact section described above so as to form a U shape, and a widthwise central portion of the terminal section is cut and bent upward toward the contact section, so as to provide a rectangular piece 251*g*. An attachment hole 251*h* is formed in the rectangular piece 251*g*, and an engaging protrusion 251*i* is formed on the rectangular piece 251*g*.

The conductive elastic member 251 is inserted from the opening 221*o*. The concave portion 251*a*, the convex portion 251*d*, the concave portion 251*c*, and the convex portion 251*b* are inserted into the groove 221*n* of the elastic deform portion 221*e*, and the concave portion 251*a* is press-fitted in a through-hole 221*m*. A clearance is present between the convex portions 251*b*, 251*d* and a ceiling surface of the groove 221*n*.

The widthwise opposite end portions 251*e*, 251*f* are fitted in a longitudinal groove 221*p* of the frame 221. The conductive elastic member 251 is fixed to the frame 221 by screwing a screw 252 with respect to the frame 221 through an attachment hole 251*h*.

In the meantime, the attachment hole 208*d* of the upper front plate 208 shown in FIG. 17B is made as a socket. A conductive member 253 is provided at a lower corner portion on the back surface of the attachment hole 208*d*. This conductive member 253 is bent at right angle and is fixed to the back surface of the upper front plate 208 by a screw 254.

When the engaging portion 221*f* of the engaging protrusion engages the attachment hole 208*d*, the second concave portion 251*c* of the conductive elastic member 251 comes into contact with the conductive member 253 and presses the same 253 owing to its elastic force. In this way, when the lower part of the frame 221 of the planar speaker panel 209 engages the upper front plate 208, a pair of connection terminals are electrically connected at the above-indicated one engagement portion.

The elastic deform portion 221*e* of the engaging protrusion keeps the elastic force during engagement, and the lower surface of the elastic deform portion 221*e* (in which the groove 221*n* is formed) is pressing the lower surface of the attachment hole 208*d*.

In this respect, there may be designed such that the lower surface of the elastic deform portion 221*e* does not contact the lower surface of the attachment hole 208*d* during engagement, thereby permitting the conductive elastic member 251 to press only the conductive member 253.

In this case, the engaged state is maintained by elastic forces of both of the elastic deform portion 221*e* and the conductive elastic member 251.

Further, the conductive elastic member 251 may be replaced with a mere conductive member whose elastic deformation is ignorable, and the mere conductive member may contact and press the conductive member 253 by only the elasticity of the elastic deform portion 221*e*.

In the terminal section, the connection terminal 222*b* of the planar speaker 222 is inserted into a clearance between the widthwise opposite end portions 251*e*, 251*f* and the rectangular piece 251*g*. In the connection terminal 222*b*, there are formed an attachment hole 222*c* and an engagement hole (or an engagement recess) 222*d* shown in FIG. 17A.

By positioning the engagement hole 222*d* and the engaging protrusion 251*i* relative to each other, the attachment hole 222*c* and the attachment hole 251*h* can be easily positioned relative to each other. By screwing the screw 252 with respect to the frame 221 through the planar speaker 222, the attachment hole 222*c*, and the attachment hole 251*h*, the conductive elastic member 251 is fixed to the frame 221. At the same time, by bringing the connection terminal 222*b* of the planar speaker 222 into contact with the rectangular piece 251*g* of the conductive elastic member 251, the conductive elastic member 251 is connected to one electrode of the planar speaker 222.

On the other hand, the conductive member 253 is connected to the electronic circuit block 213 shown in FIG. 13B by a connect line not shown.

The structure of the planar speaker 222 of the electronic keyboard musical instrument of the portable synthesizer type according to the fourth embodiment is identical with the structure of the planar speaker according to the illustrated first embodiment. That is, a specific example of the planar speaker 222 is shown in FIGS. 4A-4D, FIG. 5, and FIGS. 6A and 6B.

FIG. 18 is a plan view showing a fourth specific example of the electrostatic planar speaker with flexibility, shown in FIG. 4.

Figure 18C:
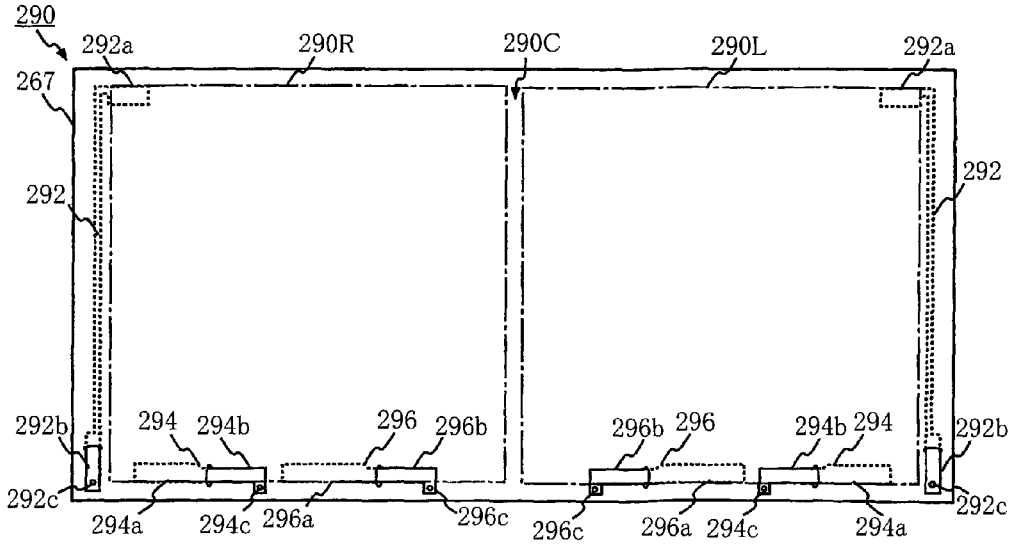
FIG. 18 is a partial plan view showing a fourth specific example of the electrostatic planar speaker shown in FIG. 4.
Figure 18C:
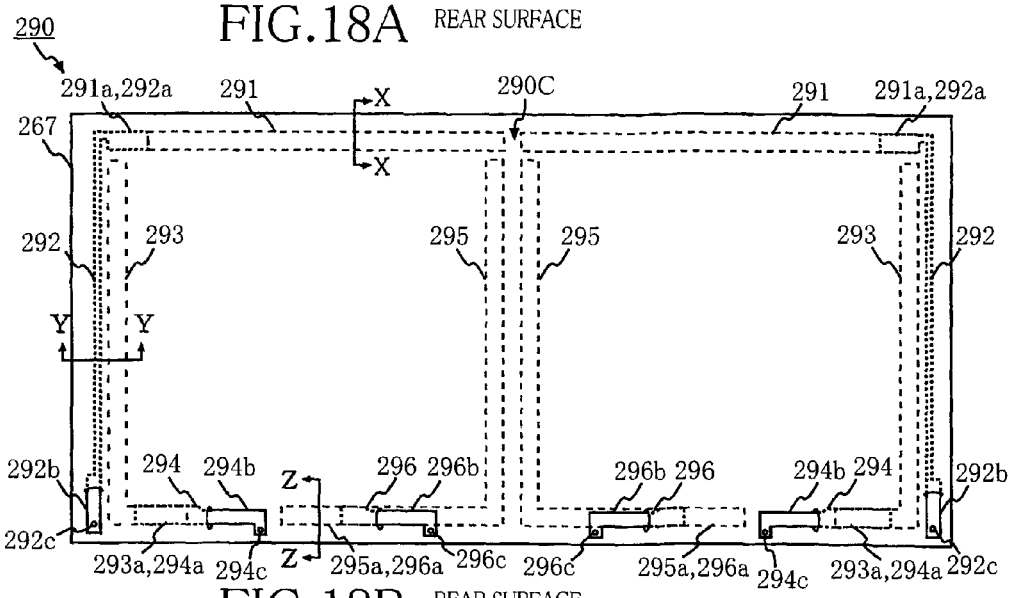
Figure 18C:
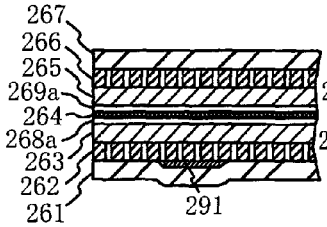
Figure 18D:
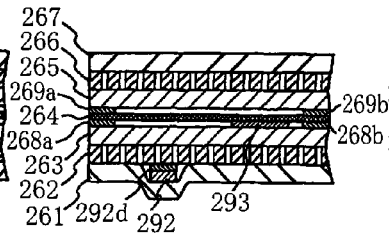
Figure 18E:
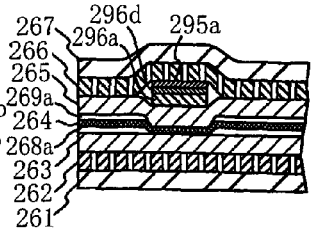

FIG. 18A is a plan view showing a rear surface of a planar speaker 290. FIG. 18B is a plan view showing the rear surface, in which conductive adhesive layers in the planar speaker are additionally illustrated in FIG. 18A. FIGS. 18C, 18D, 18E are cross-sectional views in directions of arrows X-X, Y-Y, and Z-Z in FIG. 18B, respectively.

The structure of the planar speaker (planar-speaker units 290L, 290R) according to the fourth specific example is identical with the structure of the planar speaker of FIG. 4 according to the first embodiment. In FIG. 18, the reference numerals 261, 262, 263, 264, 265, 266, 267 denote a third insulating sheet, a first fixed electrode sheet, a first insulating sheet, a vibrating electrode sheet, a second insulating sheet, a second fixed electrode sheet, and a fourth insulating sheet, respectively. Further, the reference numerals 268*a*, 268*b*, 269*a*, 269*b* denote adhesive layers. The adhesive layers 268*a*, 268*b*, 269*a*, 269*b* extend in the up-down (vertical) direction, as in FIG. 4.

As shown in FIG. 18A, the planar speaker 290 has two planar-speaker units for a stereo, namely, a left-side planar-speaker unit 290L and a right-side planar-speaker unit 290R. Because the planar speaker 290 has a left-right symmetrical structure, the same reference numerals are assigned to the identical components and only the right-side planar-speaker unit 290R will be explained. Since FIG. 18 shows the rear surface of the planar speaker, the right-side planar-speaker unit 290R is illustrated on a left side in FIG. 18. A region between the planar-speaker units 290R, 290L is a continuous portion 290 similar to the continuous portion shown in FIG. 5. A peripheral portion of the planar speaker 290 (the planar-speaker units 290R, 290L) is a region to which is attached a frame not shown.

The reference numeral 291 in FIGS. 18B and 18C denotes a strip-like first conductive adhesive layer. The first conductive adhesive layer 291 exists between the first fixed electrode sheet 262 and the third insulating sheet 261 and is located so as to extend in a left-half part on an upper edge of the planar speaker 290, for bonding the first fixed electrode sheet 262 and the third insulating sheet 261. The conductive adhesive layer is realized by a conductive adhesive per se or a metal foil tape whose opposite surfaces are coated with a conductive adhesive.

The reference numeral 292 in FIGS. 18A, 18B, 18D denotes a first Flexible Printed Circuit Board (hereinafter referred to as "FPC") which is formed by attaching a conductive foil 292*d* to a back surface (an upper surface in the drawing) of an insulating film. The FPC may be replaced with a copper foil tape.

Like the first conductive adhesive layer 291 (FIG. 18C), the first FPC 292 (FIG. 18D) exists between the first fixed electrode sheet 262 and the third insulating sheet 261 and is located so as to extend from one end portion of the upper edge of the planar-speaker unit 290R along a left edge in the up-down (vertical) direction. One end 291*a* of the first conductive adhesive layer 291 and the conductive foil 292*d* at one end 292*a* of the first FPC 292 overlap and are bonded to each other at a portion of the upper edge of planar-speaker unit 290R. The other end of the first FPC 292 extends downward and penetrates through the sheets 262-267, serving as a first connection terminal 292*b*. The reference numeral 292*c* denotes a connection hole for connection with a terminal of a plug.

The reference numeral 293 in FIGS. 18B and 18D denotes a strip-like second conductive adhesive layer. The second conductive adhesive layer 293 exists between the first insulating sheet 263 and the vibrating electrode sheet 264 and is located so as to extend along the left edge of the planar-speaker unit 290R (on the right side of the first FPC 292) in the up-down (vertical) direction and reach a lower edge, for bonding the first insulating sheet 263 and the vibrating electrode sheet 264.

The reference numeral 294 denotes a second FPC which is formed by attaching a conductive foil (not shown) to a back surface (an upper surface in the drawing) of an insulating film. Like the second conductive adhesive layer 293, the second FPC 294 exists between the first insulating sheet 263 and the vibrating electrode sheet 264 and is located at a part of the lower edge of the planar-speaker unit 290R. One end 293*a* of the second conductive adhesive layer 293 and the conductive foil at one end 294*a* of the second FPC 294 overlap and are bonded to each other at a part of the lower edge of the planar-speaker unit 290R. The other end of the second FPC 294 penetrates through the sheets 264-267, serving as a second connection terminal 294*b*.

One end of the second connection terminal 294*b* extends downward, and a connection hole is formed at the extended end. Here, for preventing a short-circuit of the second FPC 294 and the second fixed electrode sheet 266 at a time when the second FPC 294 penetrates through the sheets described above, the conductive foil of the second FPC 294 is subjected to insulating coating.

The reference numeral 295 denotes a strip-like third conductive adhesive layer. The third conductive adhesive layer 295 exists between the fourth insulating sheet 265 and the second fixed electrode sheet 266 and is located so as to extend along a right edge of the planar-speaker unit 290R in the up-down (vertical) direction and reach a part of the lower edge, for bonding the fourth insulating sheet 265 and the second fixed electrode sheet 266.

The reference numeral 296 denotes a third FPC. Like the third conductive adhesive layer 295, the third FPC 296 exists between the fourth insulating sheet 265 and the second fixed electrode sheet 266 and is located at the lower edge of the planar-speaker unit 90R. As shown in FIG. 18E, one end 295*a* of the third conductive adhesive layer 295 and a conductive foil 296*d* at one end 296*a* of the third FPC 296 overlap and are bonded to each other at a part of the lower edge of the planar-speaker unit 290R.

The other end of the third FPC 296 penetrates through the second fixed electrode sheet 266 and the fourth insulating sheet 267, serving as a third connection terminal 296*b*. One end of the third connection terminal 296*b* extends downward, and a connection hole 296*c* is formed at the extended end.

These first through third conductive adhesive layers 291, 293, 295 and the first through third FPCs 292, 294, 296 are disposed at the peripheral portion of the planar-speaker unit 290R, so as not to hinder vibration of the planar-speaker unit 290R. The first through third connection terminals 292*b*, 294*b*, 296*b* are equally spaced apart from each other at the lower edge of the planar-speaker unit 290R.

The engaging protrusion (the engaging portion 221*f*, the elastic deform portion 221*e*) and the attachment hole 208*d* shown in FIG. 17 is disposed at six locations at the lower part of the frame 221. Each of the first through third connection terminals 292*b*, 294*b*, 296*b* serves as the connection terminal 222*b* to be inserted into a clearance between the opposite end portions 251*e*, 251*f* of the conductive elastic member 251 and the rectangular piece 251*g*, and is fixed by screwing to the rectangular piece 251*g* of the conductive elastic member 251 shown in FIG. 17.

The planar speaker 290 shown in FIG. 18 uses the engaging protrusion (the elastic deform portion 221*b*, the engaging portion 221*c*) shown in FIG. 15 as the engaging protrusion provided at the upper part of the frame 221, and it is not necessary to use the engaging protrusion functioning as the plug.

Figure 19:
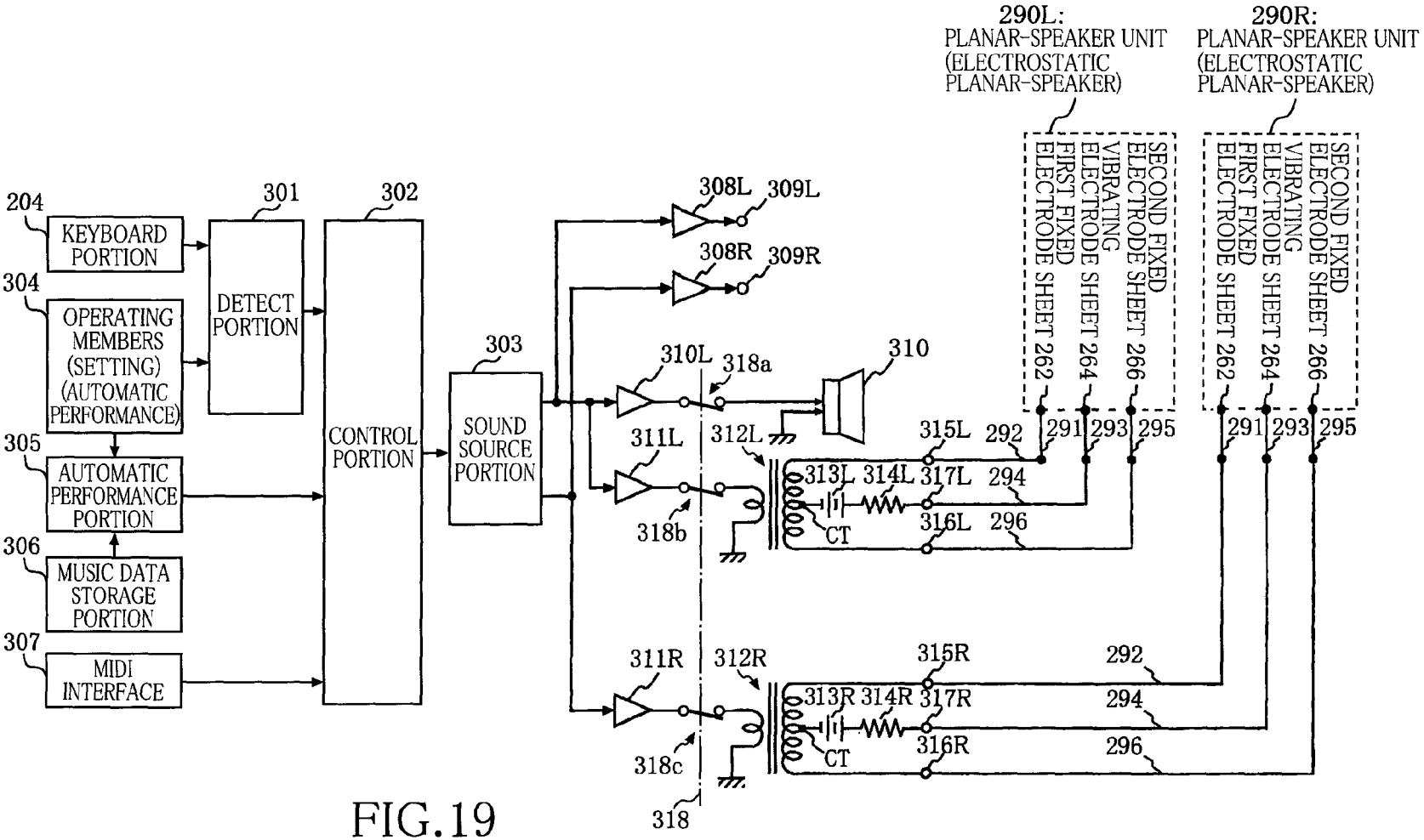
FIG. 19 is a functional block diagram of the electronic keyboard musical instrument according to the fourth embodiment shown in FIG. 13.

FIG. 19 is a functional block diagram of the electronic keyboard musical instrument according to the embodiment shown in FIG. 13.

Operations of the white keys and the black keys of the keyboard portion 204 shown in FIG. 13 are detected by a detect portion 301 and detection signals are outputted to a control portion 302. The control portion 302 outputs performance data to a sound source portion 303. The performance data includes data relating to timing of key depression and key release, a note number (pitch) corresponding to a depressed or released key, a velocity (key depression velocity), an aftertouch amount, and so on. The control portion 302 indicated above is realized by permitting a CPU to execute instrument's built-in programs.

The electronic keyboard musical instrument shown in FIG. 13 has operation panels 206*a*, 206*b*, 206*c* in which are provided a plurality of operating members (such as buttons and knobs) 304. The operating members 304 include an operating switch for setting of instrument's sound color or timbre and a switch for controlling music selection, and reproduction starting and reproduction stopping, for automatic performance.

The operation of the operating members 304 is detected by the detect portion 301 and outputted to the control portion 302. The control portion 302 sets functions assigned to the operating members with respect to the electronic keyboard musical instrument. Where the setting is made with respect to the sound source portion 303, sound source setting data is outputted to the sound source portion 303.

The above-indicted electronic keyboard musical instrument incorporates an automatic performance portion 305 and a music data storage portion 306. The automatic performance portion 305 reads out music or tune stored in the music data storage portion 306 by the operation of the operating members, and outputs MIDI (Musical Instrument Digital Interface) performance data to the control portion 302. The above-indicated automatic performance portion 305 is also realized by permitting the CPU to execute the instrument's built-in programs.

MIDI interface 307 receives, through terminals provided on the lower rear plate 203*c*, the MIDI performance data supplied from a personal computer or other electronic musical instruments, and outputs the data to the control portion 302.

On the basis of the performance data inputted from the control portion 302, the sound source portion 303 generates a musical sound signal for a stereo with two channels L and R having pitch and intensity in accordance with sound source setting such as the sound color and the key depression operation, and outputs the signal to amplifiers 308L, 308R, 310L, 311L, 311R. The illustrated sound source portion 303 utilizes a left source and a right source for the stereo, for generating one musical sound. These sound sources are stored in a sound source waveform memory not shown.

The sound source portion 303 may be configured to use a monaural source and to control a volume ratio between the left channel and the right channel in accordance with the band zone of the operated key, and so on, namely, may be configured to perform a sound image localization control.

Outputs of the amplifiers 308L, 308R are respectively outputted to the external output terminals for headphones (headphone jacks) 309L, 309R. An output of the amplifier 310L is outputted to the cone speaker 210 shown in FIG. 13 via a switch 318*a*. Where the cone speaker 210 disposed at the left-side region in FIG. 13 is also disposed at the right-side region of the upper front portion 205, an output of the R channel of the sound source portion 303 is outputted to the cone speaker disposed at the right-side region via an amplifier (310R) not shown and a switch (318*d*) not shown.

Outputs of the amplifiers 311L, 311R are respectively outputted to primary coils of respective booster transformers 312L, 312R via respective switches 318*b*, 318*c*. To secondary coils of the respective booster transformers 312L, 312R, the planar speaker 222 which has flexibility and which constitutes the planar speaker panel 209 shown in FIG. 13 is connected.

In the illustrated embodiment, the planar speaker 290 divided into the planar-speaker unit 290L for the left channel and the planar-speaker unit 290R for the right channel shown in FIG. 18 is used as the planar speaker 222.

The secondary coil of the booster transformer 312L includes a center tap CT to which is connected a series circuit of a high-voltage bias direct current (DC) power source 313L and a high-resistance resistor 314L. Opposite ends of the secondary coil described above function as terminals 315L, 316L, and one end of the resistor 314L functions as a terminal 317L.

As each of the terminals 315L, 316L, 317L, there is used the mechanical coupling structure (the engaging portion 221*f*, the elastic deform portion 221, the attachment hole 208*d*) explained above with respect to FIG. 17 which functions also as a connector for electric connection (the conductive elastic member 251, the conductive member 253).

The terminal 315L is connected to the first fixed electrode sheet 262 shown in FIG. 18 via the first conductive thin plate 292 (the first FPC 292) and the conductive adhesive layer 291. Similarly, the terminal 316L is connected to the second fixed electrode sheet 266, and the terminal 317L is connected to the vibrating electrode sheet 264.

Where three connecters (including plugs and sockets) which are independent of and spaced apart from each other are used such that each connector is provided for one terminal (one circuit), i.e., for a corresponding one of the terminals 315L-317L, this arrangement reduces a risk of touching of worker's fingers with output lines of a plurality of circuits at the same time in a connecting work of the plugs and the sockets.

As a matter of course, a high voltage is applied to the output lines only in a state in which the planar speaker panel is attached to the support body. However, even if a high voltage should be outputted among the output lines in the connecting work, it would be possible to protect the worker from an electric shock.

There may be used a common connector (including a plug and a socket) which has three terminals (three circuits) respectively for the terminals 315L, 316L, 317L of the planar-speaker unit 290L. Further, there may be used a common connector (including a plug and a socket) which has six terminals (six circuits) respectively for the terminals 315L, 316L, 317L of the planar-speaker unit 290L and the terminals 315R, 316R, 317R for the planar-speaker unit 290R.

The above-indicated switches 318*a*-318*c* (, 318*d*) are formed as an interlock-type switch 318, and are normally placed at ON. The user manually operates the interlock-type switch 318 between ON and OFF. Alternatively, the interlock-type switch 318 may be configured such that the interlock-type switch 318 is automatically plated at OFF when the user inserts a headphone plug into the external output terminals (headphone jacks) 309L, 309R for headphones and such that the interlock-type switch 318 is automatically plated at ON when the user pulls out the headphone plug.

When the interlock-type switch 318 is placed at OFF, all of the switches 318*a*-318*c* (, 318*d*) are placed at OFF, so that the cone speaker 210 and the planar-speaker units 290L, 290R do not output any sound.

Where the user practices the electronic keyboard musical instrument shown in FIG. 13 alone in a room of an apartment house at night, for instance, the interlock-type switch 318 shown in FIG. 19 is placed at OFF and the external output terminals 309L, 309R for headphones are used as external output terminals of an external electrostatic planar speaker such as a planar speaker panel 371 that will be later explained with reference to FIG. 22.

Since the number of input terminals of a push-pull type electrostatic planar speaker is three for one channel, the number is different from the number of terminals of the external output terminals 309L, 309R for the headphones. Accordingly, by using a terminal-terminal conversion adapter, a plug of the push-pull type electrostatic planar speaker is inserted into a socket of the conversion adapter, and a plug of the conversion adapter is inserted into the external output terminals 309L, 309R for the headphones. By placing the interlock-type switch 318 at OFF, the cone speaker 210 and the planar-speaker units 290L, 200R as internal speakers of the electronic keyboard musical instrument do not output any sound.

This conversion adapter is used such that two terminals for the R channel of the stereo headphones are connected to the vibrating electrode sheet 264 and the first fixed electrode sheet 262 of the R channel of the external electrostatic planar speaker, for instance. Two terminals for the L channel are similarly connected. Where the electrostatic planar speaker is monaural, the conversion adapter is used such that two terminals of 309R for the R channel as one of the two channels of the headphones are connected to the vibrating electrode sheet 264 and the first fixed electrode sheet 262 of the external electrostatic planar speaker, for instance.

As a result, the external electrostatic planar speaker is driven without the booster transformers and the bias DC power source and outputs a sound with a small volume. Accordingly, there is no need of adjusting a volume to reduce the volume. Where the thus arranged external electrostatic planar speaker is used so as to be directed or oriented in a direction in which sound conduction to the user's neighboring room is poor, the user does not receive a complaint from a person in the neighboring room that the sound is noisy, along with good straight-line or rectilinear transmission property of the plane wave.

Where a circuit is arranged such that the interlock-type switch 318 is placed at OFF and the power source for the amplifiers 310L, 311L, 311R is shut off, the circuit becomes energy-saving one. In the illustrated embodiment, while the interlock-type switches 318*a*-318*c* are provided respectively at output-sides of the amplifiers 310L, 311L, 311R, the interlock-type switches 318*a*-318*c* may be provided respectively at input sides thereof. In this instance, the amplifiers 310L, 311L, 311R may be grounded at the input sides thereof when the interlock-type switches 318*a*-318*c* are placed at OFF, for preventing noise inflow.

Here, there will be explained an operation principle of the electrostatic planar speaker, taking a potential of the vibrating electrode sheet 264 as a reference of potential. The first fixed electrode sheet 262 and the second fixed electrode sheet 266 are negatively charged at $E_0$=several hundred voltage [V] by the bias DC power source 213L, and there are generated electrostatic attraction forces in mutually opposite directions between the vibrating electrode sheet 264 and the first fixed electrode sheet 262 and between the vibrating electrode sheet 264 and the second fixed electrode sheet 266.

In this state, where musical sound signals of ±e [V] (here, e is sufficiently smaller than $E_0$) having mutually opposite phases are respectively applied to the first fixed electrode sheet 262 and the second fixed electrode sheet 266, the first fixed electrode sheet 262 and the second fixed electrode sheet 266 are negatively charted at ($E_0$+e) [V] and ($E_0$−e) [V], respectively. Consequently, the balance of the electrostatic attraction force between the vibrating electrode sheet 264 and the first fixed electrode sheet 262; and the electrostatic attraction force between the vibrating electrode sheet 264 and the second fixed electrode sheet 266 is broken. As a result, there is generated an electrostatic attraction force that is proportional to the musical sound signal e [V], and the vibrating electrode sheet 264 is push-pull driven depending upon whether the musical sound signal e [V] is positive or negative.

While the above explanation has been made for the planar-speaker unit 290L, the explanation is applicable to the planar-speaker unit 290R and therefore an explanation for the planar-speaker unit 290R is dispensed with.

In the above explanation, the output of the amplifier 310L is outputted directly to the cone speaker 210. However, for supplying the music sound signal in accordance with the frequency characteristic of the cone speaker 210, it is preferable to insert a low-pass filter circuit to the input side or the output side of the amplifier 310L.

Similarly, a high-pass filter circuit or a middle and high-pass filter circuit may be inserted to the input side or the output side of the amplifier 311L, for supplying the music sound signal in accordance with the frequency characteristic of the planar-speaker unit 290L, to the booster transformer 312L.

The characteristics of the above-indicated filter circuits are designed such that the sound outputted from the cone speaker 210 and the sound outputted from the planar-speaker unit 290L are balanced in terms of the frequency characteristic.

Further, tweeter speakers for reproduction of the treble range (such as dome-type dynamic speakers) may be provided, and the amplifier 310L may distribute the musical sound signal to the tweeter speakers. A switch may be provided for switching the planar-speaker unit 290L and the tweeter speakers for selective use thereof.

While not shown, a source (with two systems for R and L) exclusive for the plan-speaker units 290L, 290R may be prepared in the sound source portion 303. In this instance, the musical sound signal based on the exclusive source may be supplied to the booster transformers 312L, 312R via the switches 318*b*, 318*c* after having been amplified by the amplifiers 311L, 311R.

Where the above-described planar speaker 290 is not divided for the left and right channels, a monaural signal is supplied from the sound source portion 303, is amplified, and is outputted to the booster transformer via the switch 318*b*. Alternatively, a mixing portion for mixing the stereo outputs of the sound source portion 303 is provided, and an output of the mixing portion is outputted to the booster transformer via the switch 318*b* after having been amplified.

The interlock-type switch 1500 explained above with respect to FIG. 7B may be employed in the circuit of FIG. 19. More specifically, in the embodiment to which FIG. 19 is applied, there may be employed: (a) an interlock-type switch configured to switch a connection state of the planar speaker 290R between: a state in which the planar speaker 290R is connected to the amplifier 311R with a booster device (constituted by the booster transformer 312R, the bias DC power source 313R, and the resistor 314R) interposed therebetween; and a state in which the planar speaker 290R is connected to the amplifier 311R without the booster device interposed therebetween; and (b) an interlock-type switch configured to switch a connection state of the planar speaker 290L between: a state in which the planar speaker 290L is connected to the amplifier 311L with a booster device (constituted by the booster transformer 312L, the bias DC power source 313L, and the resistor 314L) interposed therebetween; and a state in which the planar speaker 290L is connected to the amplifier 311L without the booster device interposed therebetween. These interlock-type switches may be configured to switch the connection states of the respective planar speakers 290L, 290R at the same timing, whereby the two planar speakers 290R, 290L can be placed in mutually the same connection state (i.e., the connection state in which the planar speaker is connected to the amplifier via the booster device or the connection state in which the planar speaker is connected to the amplifier without the booster device). Further, these interlock-type switches may be configured to switch the connection states of the respective planar speakers 290L, 290R independently of each other, whereby the connection states of the respective planar speakers 290L, 290R may be made into arbitrary ones.

Fifth Embodiment

Referring next to the external view of FIG. 20A, there will be explained an electronic keyboard musical instrument 320 equipped with an external planar speaker panel 337 according to a fifth embodiment of the invention. This electronic keyboard musical instrument 320 is of an upright piano type. FIG. 20B shows a modified example of the fifth embodiment.

Figure 20A:
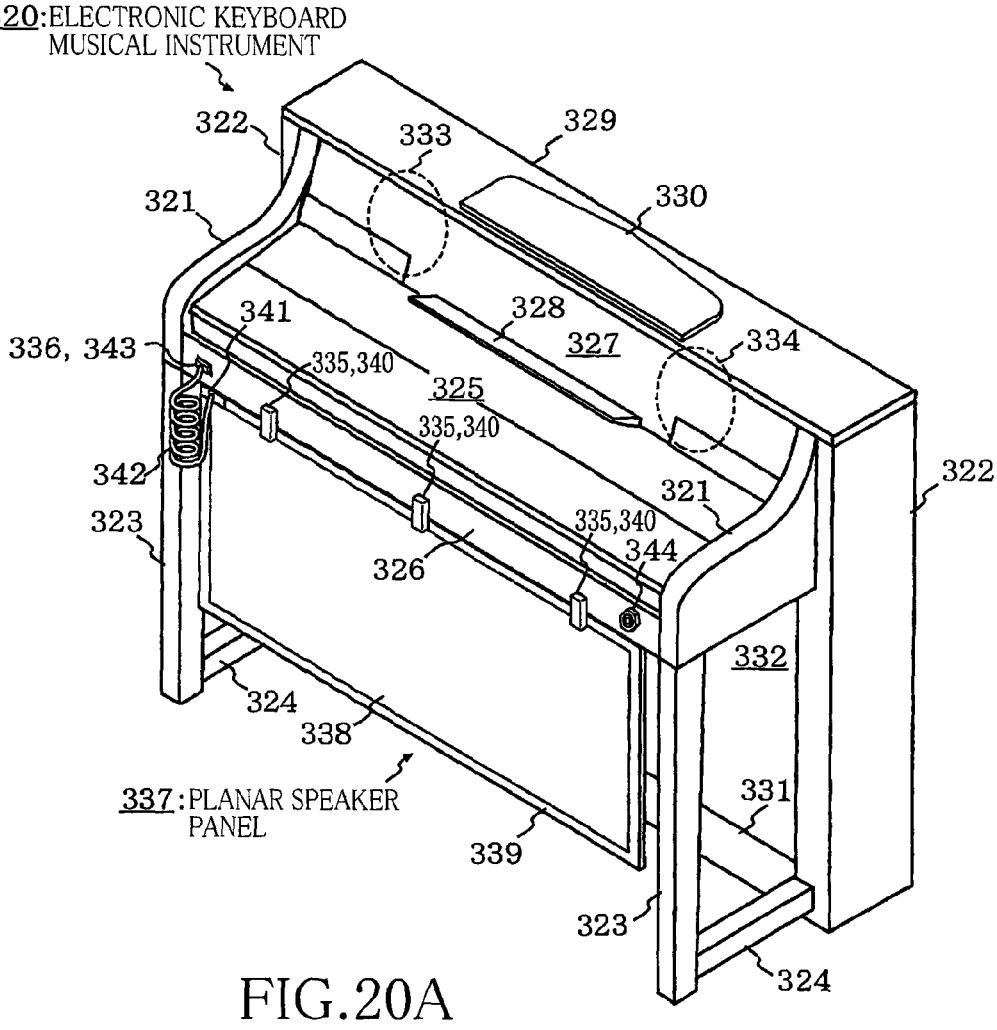
FIG. 20 is an external view of an electronic keyboard musical instrument equipped with an external planar speaker panel according to a fifth embodiment of the invention.
Figure 20B:
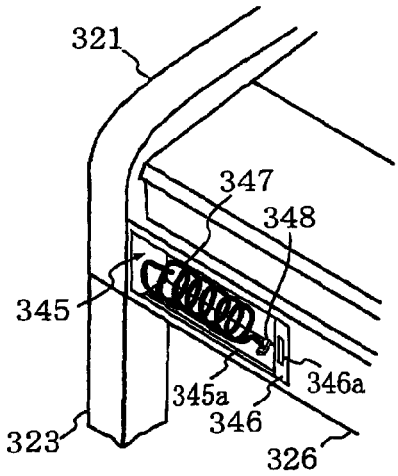

On the right side as viewed from the performer in FIG. 20A, the reference numerals 321, 322, 323, 324 respectively denote a side arm plate (side-surface portion), a side plate (side-surface portion), a front leg, and a stay connecting the front leg 323 and the side plate 322. A similar arrangement is provided on the left side in FIG. 20A, and the same reference numerals are attached to the corresponding components.

While a keyboard portion is disposed between the left and right side arm plates 321, the keyboard portion is invisible because a fall board 325 is closed. The illustrated fall board 325 is of a two-part foldable type and is accommodated, during performance, in an inside of the instrument main body from a lower part of an upper front plate 327 described below.

The front surface of the key board portion nearer to the performer is a key slip 326. The bottom surface of the keyboard portion is a key bed not shown. The upper part of the keyboard portion on the rear side remote from the performer is the upper front plate 327. At a central position of the upper front plate 327, a music rest 328 is provided. A top plate 329 is laid over the upper front plate 327, the left and right side plates 322, and a rear plat 329 not shown. At a central position of the top plate 329, a music rack 330 (in a fallen state in FIG. 20A) is provided.

A pedal unit 331 is provided at a lower portion of the instrument, and pedals not shown accommodated therein protrude from a central portion of the pedal unit 331 towards the performer's side. A lower front plate 332 is provided so as to extend between the pedal unit 331 and the key bed located above the pedal unit 331.

The above-indicated side arm plates 321, side plates 322, top plate 329, key bed (bottom-surface portion), key slip 326, upper front plate 327, lower front plate 332, and a rear plate constitute a casing of the musical instrument. Further, an instrument main body of the electronic keyboard musical instrument is constituted by those components, the keyboard portion, and an inner space. The electronic keyboard musical instrument is constituted by the instrument main body, the front legs 323, the stays 324, the pedal unit 331, and the planar speaker panel 337.

The instrument main body incorporates a musical-sound-signal generating portion configured to generate a musical sound signal in accordance with a user's key operation with respect to the keyboard portion.

Cone speakers 333, 334 are disposed on a left-side region and a right-side region of the upper front plate 327 as a baffle plate. On the surface of the upper front plate 327, a punching metal, a net or a speaker grille, not shown, is provided, which protects the inner space but permits transmission of a sound outputted from front opening portions of the cone speakers 333, 334.

A stereo drive signal is supplied to the cone speakers 333, 334. The right cone speaker 334 may be eliminated, and only the left cone speaker may be provided. While the cone speakers 333, 334 are provided at the upper front plate 327 in the illustrated embodiment, the cone speakers 333, 334 may be provided at the key bed just below the keyboard portion or the lower front plate 332, such that the front opening portions of the cone speakers 333, 334 are directed downward.

The planar speaker panel 337 is an external speaker which is disposed independently of the casing of the electronic keyboard musical instrument 320. In the illustrated embodiment, attachment portions 335 (a plurality of retaining portions) such as hooks, holes, and grooves are provided at three locations of the key slip 326, for attaching the planar speaker panel 337.

The planar speaker panel 337 is formed by a planar speaker 338 and a frame 339 which supports a peripheral portion of the planar speaker 338. The frame 339 may be formed of a material having rigidity, such as wood or hard synthetic resin, or a material having substantially the same degree of flexibility as the planar speaker 338, such as soft synthetic resin.

At an upper edge portion of the frame 339 in FIG. 20A, attaching components (engaging portions) 340, such as protuberances, through-holes, and rings, are fixed. The attaching components 340 are brought into engagement with the above-described attachment portions 335, whereby the planar speaker panel 337 is installed on the instrument main body.

The planar speaker panel 337 is disposed separately from and outside the casing of the instrument main body which is constituted by the side arm plates 321, the side plates 322, the top plate 329, the key bed, the key slip 326, the upper front plate 327, the lower front plate 332, and the rear plate. Accordingly, the planar speaker panel 337 is disposed independently of and outside the casing of the instrument main body.

In a left-side region of the key slip 326, a socket (a second output terminal) 336 is provided. The socket 336 is a dedicated terminal for the planar speaker panel 337 and outputs a drive signal for driving the planar speaker 338 to an outside of the electronic keyboard musical instrument 320. This socket 336 is an external output terminal corresponding to the terminals 315L, 316L, 317L, 315R, 316R, 317R of the internal circuit in FIG. 19.

There is provided, on the frame 339 of the planar speaker panel 337, a code draw-out portion 341 from which an input cord 342 is drawn. The input cord 342 is connected to fixed electrodes and a movable electrode of the planar speaker 338, and has a plug 343 at its leading end. When this plug 343 is inserted into the socket 336, a drive signal is supplied to the planar speaker panel 337, so that the planar speaker 338 outputs a sound in accordance with the musical sound signal outputted from the musical-sound-signal generating portion.

On the other hand, in a right-side region of the key slip 326, a headphone terminal (a first output terminal) 344 is provided. This headphone terminal 344 is for amplifying a musical sound signal and outputting the signal to the exterior. The headphone terminal 344 is an output terminal which has relatively low impedance and on which a bias voltage is not applied. The headphone terminal 344 corresponds to the external output terminals 309L, 309R for the headphones in FIG. 19.

Besides, as conventional output terminals for amplifying a musical sound signal and outputting the signal to the exterior, there are an output terminal (a first output terminal) for supplying a musical sound signal to a monitor speaker and an output terminal (a first output terminal) for supplying a musical sound signal to an external amplifier. These conventional output terminals are provided on the rear plate not shown.

In FIG. 20A, the planar speaker panel 337 is provided with the input cord 342 and the plug 343. In the modified example shown in FIG. 20B, the electronic keyboard musical instrument 320 is provided with an output cord 347 and a plug 348. In this arrangement, the planar speaker panel 337 is provided with a socket to be connected to the plug 348. The key slip 326 has a recess which functions as an accommodation box 345. When the planar speaker panel 337 is detached from the electronic keyboard musical instrument 320 and the instrument 320 is used, the user accommodates the output cord 347 and the plug 348 in the accommodation box 345, and closes a slide-type lid 346 which is slidable on a groove 345*a*. The output cord 347 is drawn out from an inner wall of the accommodation box 345. The lid 346 is formed with a recess functioning as a grip portion 346*a*. Accordingly, the appearance of the electronic keyboard musical instrument 320 is not deteriorated by the output cord 347 and the plug 348.

As explained with reference to FIG. 19, the external output terminals 309L, 309R for the headphones may be used as external output terminals of the external electrostatic speaker such as the planar speaker panel 337.

The plug 343 of the planar speaker panel 337 is inserted into the above-described terminal-terminal conversion adapter, and the plug of the conversion adapter is inserted into the external output terminal 344 for the headphones. As a result, the planar speaker panel 337 is driven without the booster transformers and the bias DC power source and outputs a sound with a small volume. On this occasion, the cone speakers 333, 334 do not output any sound owing to the interlock-type switch shown in FIG. 19.

FIG. 21 is a plan view showing a specific example of the electrostatic planar speaker having flexibility, in the embodiment of FIG. 20.

Figure 21A:
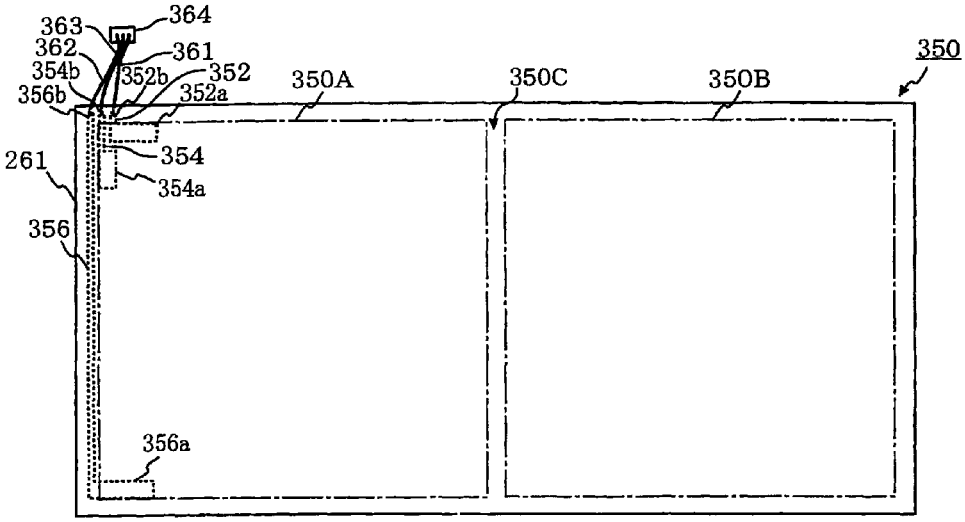
FIG. 21 is a plan view showing a specific example of the electrostatic planar speaker in the fifth embodiment shown in FIG. 20.
Figure 21B:
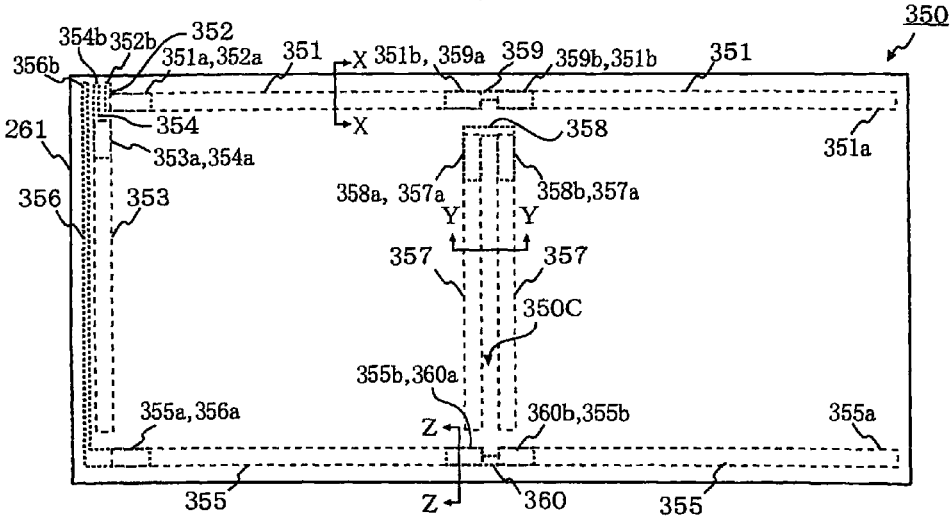

FIG. 21A is a plan view of the planar speaker, in which fixed electrode sheets in the planar speaker are additionally illustrated. FIG. 21B is a plan view, in which conductive adhesive layers in the planar speaker are additionally illustrated in FIG. 21A.

Figures 21C, 21D, 21E:
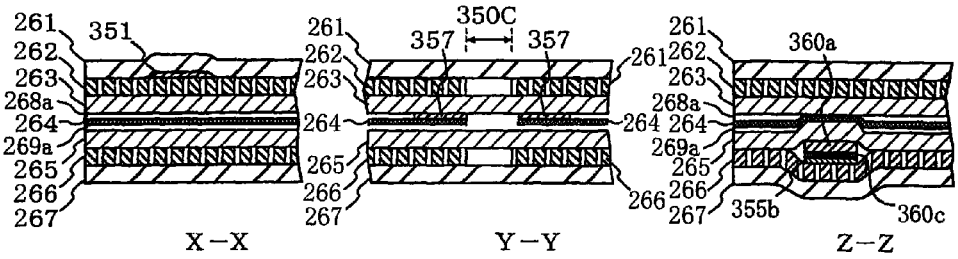

FIGS. 21C, 21D, 21E are cross-sectional views in directions of arrows X-X, Y-Y, Z-Z in FIG. 21B, respectively. While the structure of each of planar-speaker units 350A, 350B shown in FIG. 21 is the same as the planar speaker of FIG. 4 according to the first embodiment, reference numerals assigned to components of the planar-speaker units 350A, 350B are changed as follows. That is, the references numerals 261, 262, 263, 264, 265, 266, 267 denote a third insulating sheet, a first fixed electrode sheet, a first insulating sheet, a vibrating electrode sheet, a second insulating sheet, a second fixed electrode sheet, and a fourth insulating sheet, respectively. Further, the reference numerals 268*a*, 268*b*, 269*a*, 269*b* denote adhesive layers.

This planar speaker 350 is arranged, for monaural (a single channel), such that two planar-speaker units, namely, left-side and right-side planar-speaker units 350A, 350B, are disposed so as to be bendable at a central continuous portion 350C. Because the planar speaker 350 has a substantially left-right symmetrical structure, the same reference numerals are assigned to the identical components and only the left-side planar-speaker unit 350A will be explained. A region between the two planar-speaker units 350A, 350B is the continuous portion 350C. A peripheral portion of the planar speaker 350 (the planar-speaker units 350A, 350B) is a region to which is attached a frame not shown.

The reference numeral 351 in FIGS. 21B and 21C denotes a strip-like first conductive adhesive layer. The first conductive adhesive layer 351 exists between the first fixed electrode sheet 362 and the third insulating sheet 361 and is located so as to extend in a left-half part on an upper edge of the planar speaker 350, for bonding the first fixed electrode sheet 362 and the third insulating sheet 361.

The reference numeral 352 in FIGS. 21A and 21B denotes a first Flexible Printed Circuit Board (hereinafter referred to as "FPC") which is formed by attaching a conductive foil (not shown) to a back surface of an insulating film.

Like the first conductive adhesive layer 351, the first FPC 352 exist between the first fixed electrode sheet 362 and the third insulating sheet 361 and is located at one end portion of the upper edge of the planar-speaker unit 350A. One end 351*a* of the first conductive adhesive layer 351 and the conductive foil at one end 352*a* of the first FPC 352 overlap and are bonded to each other at a portion of the upper edge of the planar-speaker unit 350A.

The other end of the first FPC 352 functions as a first connection terminal 352*b* with a small width. A conductive foil is attached also to the back surface of the first connection terminal 352*b*. The first connection terminal 352*b* is formed with a hole in which one end of an input line 361 is to be inserted. A tip end of the inserted input line 361 is soldered to the conductive foil.

The reference numeral 353 in FIG. 21B denotes a strip-like second conductive adhesive layer. The second conductive adhesive layer 353 exists between the vibrating electrode sheet 364 and the first insulating sheet 363 and is located such that the second conductive adhesive layer 353 extends along a left edge of the planar-speaker unit 350A in the up-down (vertical) direction and reaches a part of a lower edge, for bonding the vibrating electrode sheet 364 and the first insulating sheet 363.

The reference numeral 354 denotes a second FPC which is formed by attaching a conductive foil (not shown) to a back surface of an insulating film. Like the second conductive adhesive layer 353, the second FPC 354 exists between the vibrating electrode sheet 364 and the first insulating sheet 363 and is located at an upper part of the left edge of the planar-speaker unit 350A. One end 353*a* of the second conductive adhesive layer 353 and the conductive foil at one end 354*a* of the second FPC 354 overlap and are bonded to each other at a part of the left edge of the planar-speaker unit 350A.

The other end of the second FPC 354 functions as a second connection terminal 354*b* with a small width. The second connection terminal 354*b* is formed with a hole in which one end of an input line 362 is to be inserted. A tip end of the inserted input line 362 is soldered to the conductive foil.

The reference numeral 355 denotes a strip-like third conductive adhesive layer. The third conductive adhesive layer 355 exists between the second insulating sheet 365 and the second fixed electrode sheet 366 and is located so as to extend along the lower edge of the planar-speaker unit 350A, for bonding the second insulating sheet 365 and the second fixed electrode sheet 366.

The reference numeral 356 denotes a third FPC. Like the third conductive adhesive layer 355, the third FPC 356 exists between the second insulating sheet 365 and the second fixed electrode sheet 366 and is located such that the third FPC 356 extends from a part of the lower edge of the planar-speaker unit 350A, and is directed upward in FIG. 21B so as to extend along the left edge (on the left side of the second conductive adhesive layer 353) in the up-down (vertical) direction in FIG. 21B, for bonding the second insulating sheet 365 and the second fixed electrode sheet 366. One end 355*a* of the third conductive adhesive layer 355 and the conductive foil (not shown) at one end 356*a* of the third FPC 356 overlap and are bonded to each other at a part of the lower edge of the planar-speaker unit 350A.

The other end of the third FPC 356 functions as a third connection terminal 356*b* with a small width. The third connection terminal 356*b* is formed with a hole in which one end of an input line 363 is to be inserted. A tip end of the inserted input line 363 is soldered to the conductive foil.

As shown in FIGS. 21B and 21D, the continuous portion 350C includes the third insulating sheet 261, the first insulating sheet 263, the second insulating sheet 265, and the fourth insulating sheet (rear-surface protective sheet) 267, which are integral respectively with the third insulating sheet (front-surface protective sheet) 261, the first insulating sheet 263, the second insulating sheet 265, and the fourth insulating sheet (rear-surface protective sheet) 267 of each of the planar-speaker units 350A, 350B that are adjacent to the continuous portion 350C, and the continuous portion 350C does not include the first fixed electrode sheet 262, the vibrating electrode sheet (vibrating film or diaphragm) 264, and the second fixed electrode sheet 266 of each of the planar-speaker units 350A, 350B.

The continuous portion 350C may be arranged not to have the first insulating sheet 263 and the second insulating sheet 265. Because the vibrating electrode sheet (vibrating film or diaphragm) 264 does not exist in the continuous portion (bending portion) 350C, an advantage is ensured that the vibration generated when the planar speaker 350 is used in a bent state is not hindered.

Accordingly, like the continuous portion 52 shown in FIG. 6, the insulating layers in the continuous portion 350C extend continuously from the corresponding insulating layers in the adjacent planar-speaker units 350A, 350B and are common to all planar-speaker units and the continuous portion. Even where the planar speaker is bent or folded at the continuous portion 350C, the electrode sheets are not damaged.

Next, there will be explained an electric coupling structure between the left-side and right-side planar-speaker units 350A, 350B. The reference numeral 357 in FIGS. 21B and 21D denotes a strip-like fourth conductive adhesive layer. Like the third conductive adhesive layer 353 explained above, the fourth conductive adhesive layer 357 exists between the vibrating electrode sheet 364 and the first insulating sheet 363 and is located so as to extend along the right edge of the planar-speaker unit 350A in the up-down (vertical) direction in FIG. 21B, for bonding the vibrating electrode sheet 364 and the first insulating sheet 363.

Similarly, in the right-side planar-speaker unit 350B, the fourth conductive adhesive layer 357 is provided which is disposed symmetrically with respect to the above-indicated fourth conductive adhesive layer 357 of the left-side planar-speaker unit 350A, namely, disposed so as to extend along a left edge of the planar-speaker unit 350B in the up-down (vertical) direction in FIG. 21B, and to which the same reference numeral is assigned.

The reference numeral 358 denotes a fourth FPC which is formed by attaching a conductive foil (not shown) to a back surface of an insulating film. One end 358*a* and the other end 358*b* of the fourth FPC 358 have a strip-like shape extending in the up-down direction in FIG. 21B and are connected to each other at upper portions thereof in the up-down direction by a small-width connect portion.

Like the fourth conductive adhesive layer 357, the fourth FPC 358 exists between the vibrating electrode sheet 364 and the first insulating sheet 363 and is located at an upper part of the right edge of the planar-speaker unit 350A and the left edge of the planar-speaker unit 350B. One end 357*a* of the left-side fourth conductive adhesive layer 357 and the conductive foil at one end 358*a* of the fourth FPC 358 overlap and are bonded to each other at a part of the right edge of the planar-speaker unit 350A.

Similarly, one end 357*a* of the right-side fourth conductive adhesive layer 357 and the conductive foil at the other end 358*b* of the fourth FPC 358 overlap and are bonded to each other at a part of the left edge of the planar-speaker unit 350B.

In the right-side planar-speaker unit 350B, the first conductive adhesive layer 351 is provided which is disposed symmetrically with respect to the above-indicated first conductive adhesive layer 351, namely, disposed so as to extend along the upper edge of the planar-speaker unit 350B, and to which the same reference numeral is assigned.

The reference numeral 359 denotes a fifth FPC which is formed by attaching a conductive foil (not shown) to a back surface of an insulating film. One end 359*a* and the other end 359*b* of the fifth FPC 359 have a strip-like shape extending in the left-right (lateral) direction in FIG. 21B and are connected to each other by a small-width connect portion extending in the left-right (lateral) direction.

Like the first conductive adhesive layer 351, the fifth FPC 359 exists between the first fixed electrode sheet 262 and the third insulating sheet 261 and is located on the upper edges of the planar-speaker units 350A, 350B. One end 351*b* of the left-side first conductive adhesive layer 351 and the conductive foil at one end 359*a* of the fifth FPC 359 overlap and are bonded to each other at a part of the upper edge of the planar-speaker unit 350A.

Similarly, the other end 351*b* of the right-side first conductive adhesive layer 351 and a conductive foil 359*c* (not shown) at the other end 359*b* of the fifth FPC 359 overlap and are bonded to each other at a part of the upper edge of the planar-speaker unit 350B.

In the right-side planar-speaker unit 350B, the third conductive adhesive layer 355 is provided which is disposed symmetrically with respect to the above-indicated third conductive adhesive layer 355, namely, disposed so as to extend along the lower edge of the planar-speaker unit 350B, and to which the same reference numeral is assigned.

The reference numeral 360 in FIGS. 21B and 21E denotes a sixth FPC which is formed by attaching a conductive foil 360*c* to a back surface of an insulating film. The sixth FPC 360 has an up-down symmetric structure with respect to the above-described fifth FPC 359.

Like the third conductive adhesive layer 355, the sixth FPC 360 exists between the second insulating sheet 265 and the second fixed electrode sheet 266 and is located on the lower edges of the planar-speaker units 350A, 350B. The other end 355*b* of the left-side third conductive adhesive layer 355 and the conductive foil 360*c* at one end 360*a* of the sixth FPC 360 overlap and are bonded to each other at a part of the lower edge of the planar-speaker unit 350A. Similarly, the other end 355*b* of the right-side third conductive adhesive layer 355 and the conductive foil 360*c* at the other end 360*b* of the sixth FPC 360 overlap and are bonded to each other at a part of the lower edge of the planar-speaker unit 350B.

By the above-described fourth through sixth FPCs 358, 359, 360, the corresponding electrodes of the planar-speaker units 350A, 350B are electrically connected.

The above-described fourth through sixth FPCs 358, 359, 360 has a small width at the continuous portion 350C between the planar-speaker unit 350A and the planar-speaker unit 350B, thereby rendering the continuous portion 350C easily bendable.

The first through fourth conductive adhesive layers 351, 353, 355, 357 described above and the first through sixth FPCs 352, 354, 356, 358, 359, 360 described above are disposed at the peripheral portions or outside the peripheral portions of the planar-speaker units 350A, 350B, so as not to hinder vibrations of the planar-speaker units 350A, 350B. Each of the first through third connection terminals 352*b*, 354*b*, 356*b* is connected to a corresponding one of the input lines 361, 362, 363 between the corresponding layers. In the illustrated embodiment, the input lines 361, 362, 363 are connected to a common plug 364.

Where the above-described monaural planar speaker 350 is used, a mixing portion for mixing the stereo outputs of the sound source portion 303 shown in FIG. 19 is provided, and the stereo outputs are mixed. An output of the mixing portion is amplified and is outputted to a primary coil of a booster transformer similar to the booster transformers 312L, 312R shown in FIG. 19. An output terminal of a secondary coil of the booster transformer is connected to the socket 336 shown in FIG. 20. The plug 364 of the planar speaker 350 corresponds to the plug 343 shown in FIG. 20.

In the above-described planar speaker 350, where the planar-speaker unit 350B is configured to have a symmetric structure with respect to the planar-speaker unit 350A and the planar-speaker unit 350B is also provided with the input lines 361, 362, 363, instead of using the fourth through sixth FPCs 358, 359, 360, the planar speaker 350 becomes a stereo speaker.

The following explanation will be made referring back to FIG. 20.

As the planar speaker 338, there may be used the planar speakers 30, 40, 50A, 50B of FIGS. 4-6 according to the first embodiment and the planar speaker 290 of FIG. 18 according to the fourth embodiment.

While the planar speaker panel 337 is hung from the key slip 326, the planar speaker panel 337 may be hung from the bottom surface of the key bed. The lower front plate 332 and the rear plate may be removed between the left and right side plate 322 to form an open space in which no components or members exist between the front side (the performer's side) and the back side of the musical instrument. The planar speaker panel 337 may be disposed in this open space.

The attachment portions (the plurality of retaining portions) 335 and the socket 336 which are provided on the key slip 326 as mutually independent or separate members may be formed integrally with each other while the attaching components (the engaging portions) 340 and the plug 343 which are provided on the planar speaker panel 337 as mutually independent or separate members may be formed integrally with each other.

By permitting the plane speaker panel 337 to be attached to and held by the electronic keyboard musical instrument 320, there is established electric connection therebetween.

In this instance, a combination of a retaining portion-cum-socket; and an attaching component-cum plug is provided for each of the electrodes (i.e., three electrodes for monaural, six electrodes for stereo), such that the retaining portion-cum-socket and the attaching component-cum plug for any one electrode are disposed independently of and separately from those of other electrodes. This arrangement reduces a risk that worker's fingers touch the output lines of a plurality of circuits at the same time when the worker installs the planar speaker panel 337, thereby protecting the worker from suffering from a possible electric shock.

Sixth Embodiment

FIG. 22 is an external view of an external planar speaker panel 371 constructed according to a sixth embodiment of the invention, which is to be installed on an electronic keyboard musical instrument. As the electronic keyboard musical instrument on which the external planar speaker panel 371 is to be installed, the electronic keyboard musical instrument shown in FIG. 13 or the instrument main body of the electronic keyboard musical instrument shown in FIG. 20 may be used, for instance.

Figure 22A:
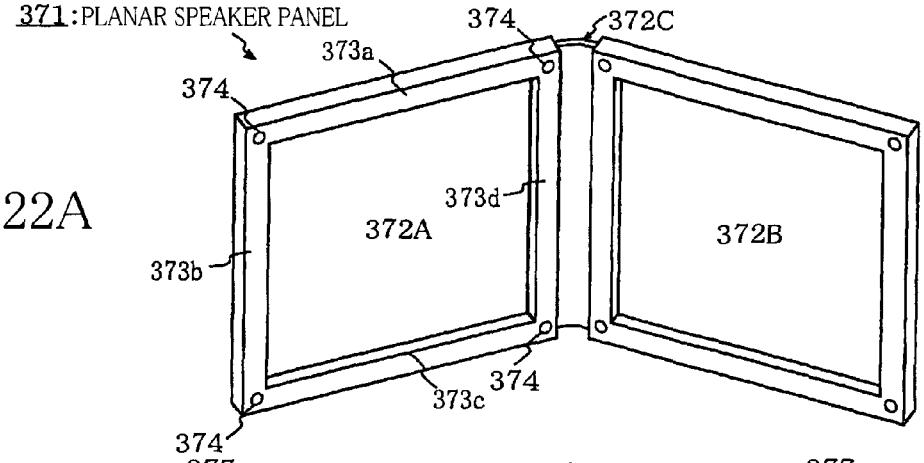
FIG. 22 is an external view of an external planar speaker panel according to a sixth embodiment of the invention, which is to be installed on an electronic keyboard musical instrument.
Figure 22B:
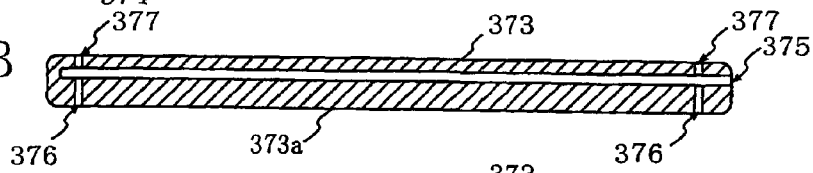
Figure 22C:
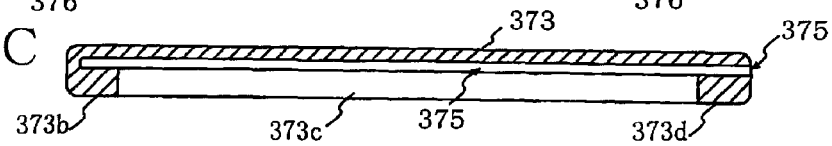

FIG. 22A is a perspective view. FIG. 22B is a horizontal cross-sectional view at an upper edge portion 373*a* of a frame 373. FIG. 22C is a horizontal cross-sectional view of the frame 373 at a position which is intermediate in the height direction of the frame 373.

The planar speaker panel 371 is configured to output a sound in accordance with a musical sound signal, independently of and outside the casing of the electronic keyboard musical instrument shown in FIG. 13 or 20.

In other words, the plane speaker panel 371 is disposed separately from and outside the casing of the electronic keyboard musical instrument shown in FIG. 13 or 20. Accordingly, the planar speaker panel 371 is capable of outputting a sound in accordance with a musical sound signal, independently of and outside the casing. Further, the planar speaker panel 371 is disposed independently of and outside the casing of the instrument main body.

The planar speaker 372 in FIG. 22 is constituted by a left-side planar-speaker unit 372A and a right-side planar-speaker unit 372B which are connected by a continuous portion 372C. The frame 373 is divided into two parts, namely, a left-side frame for holding the planar-speaker unit 372A and a right-side frame for holding the planar-speaker unit 372B. Because the frame 373 has a left-right symmetric structure, namely, because the left-side frame and the right-side frame are symmetric with each other, only the left-side frame 373 will be explained assigning reference numerals to its components. Each reference numeral 374 denotes a screw.

As the planar speaker 372, the planar speaker 350 shown in FIG. 21 may be used. In this instance, the continuous portion 372C may have a structure of the continuous portion 350C shown in FIG. 21 or a structure of a continuous portion 380C shown in FIG. 23.

A narrow groove 375 with a predetermined depth is formed in the upper edge portion 373*a* of the frame 373, as shown in FIG. 22B. A similar narrow groove 375 is formed in a left edge portion 373*b*, a right edge portion 373*d*, and a lower edge portion 373*c* of the frame 173, as shown in FIG. 22C. The left-side planar-speaker unit 372A is inserted from the narrow groove 375 formed in the right edge portion 373*d*. The four screws 374 are inserted from respective four attachment holes 376 and screwed in respective four screw holes 377 through the peripheral portion of the planar-speaker unit 372A.

By folding the frame 373 (the left-side and right-side frames 373) as illustrated in FIG. 22A, the planar speaker panel 371 having an independent structure is obtained. The directivity of the sound outputted from the planar speaker panel 371 can be changed by changing the folding angle and the directions in which the planar-speaker units 372A, 372B are respectively oriented.

In the illustrated embodiment, the number of the planar-speaker units is two (i.e., two planar-speaker units 372A, 372B) and the number of the frames 373 that hold the respective planar-speaker units is two. The number of the planar-speaker units which are connected to each other may be increased and the number of the frames 373 may be accordingly increased, whereby the planar speaker panel 371 may become a planar speaker panel of a foldable-screen type.

FIG. 23 is a partial cross-sectional view showing a specific example of the electrostatic planar speaker with flexibility, according to the embodiment shown in FIG. 22.

Figure 23A:
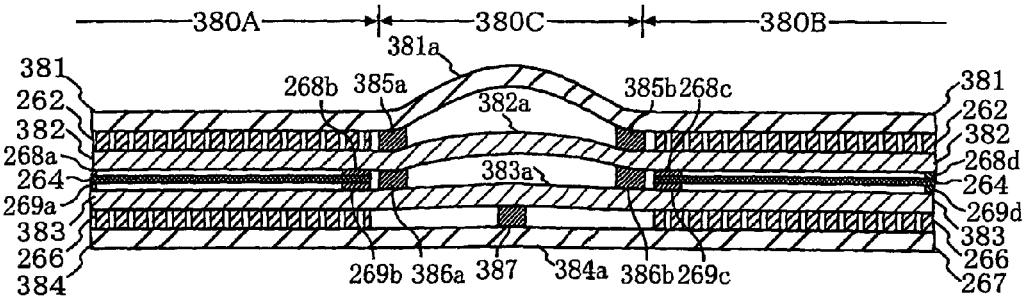
FIG. 23 is a partial cross-sectional view showing a specific example of the electrostatic planar speaker in the sixth embodiment shown in FIG. 22.
Figure 23B:
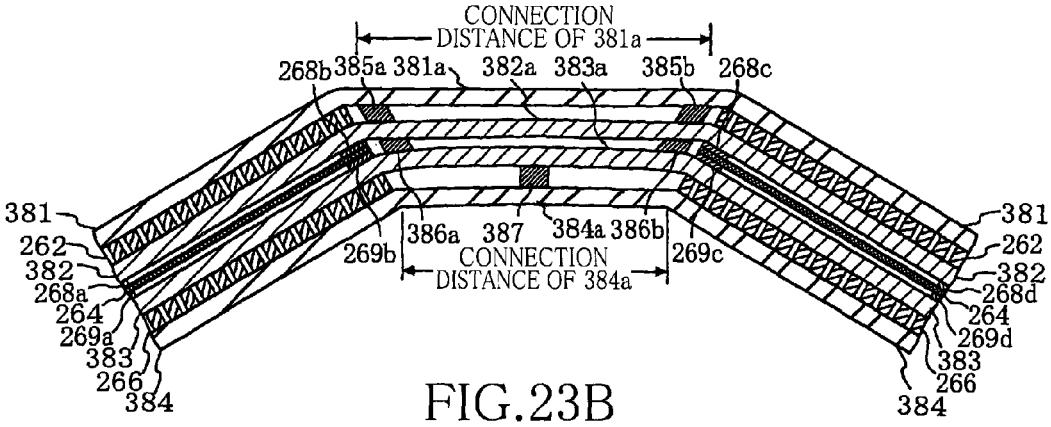

FIG. 23A shows a planar speaker 380 before it is folded. FIG. 23B is a partial cross-sectional view of the planar speaker 380 in a state in which the planar speaker 380 is folded along the continuous portion 380C.

The planar speaker 380 is configured such that the continuous portion 380C between adjacent planar-speaker units 380A, 380B is easily bendable. Laminated sheets of the planar speaker 380 are divided into two sections, i.e., the plane-speaker units 380A, 380B. The laminated structure of each planar-speaker unit 380A, 380B is identical with that in the first embodiment of FIG. 4, but reference numerals are changed as follows. That is, the reference numerals 381, 262, 382, 264, 383, 266, 384 in FIG. 23 denote a third insulating sheet, a first fixed electrode sheet, a first insulating sheet, a vibrating electrode sheet, a second insulating sheet, a second fixed electrode sheet, and a fourth insulating sheet, respectively. The reference numerals 268*a*, 268*b*, 269*a*, 269*b* denote adhesive layers.

At the continuous portion 380C, there exist no layers of the first fixed electrode sheet 262, the vibrating electrode sheet 264, and the second fixed electrode sheet 266 while there exist layers of the third insulating sheet 381, the first insulating sheet 382, the second insulating sheet 383, and the fourth insulating sheet 384, whereby the adjacent planar-speaker units 380A, 380B are connected.

The layers of the first and second insulating sheets 382, 383 may also be eliminated.

The reference numerals 381*a*, 382*a*, 383*a*, 384*a* respectively denote the third insulating sheet, the first insulating sheet, the second insulating sheet, and the fourth insulating sheet, at the continuous portion.

Like the continuous portion 52 shown in FIG. 6, the layers of the insulating sheets in the continuous portion 380C extend continuously from the corresponding layers in the planar-speaker units 380A, 380B which are located adjacent to the continuous portion 380C, and are continuous layers which are common to all of the units and the continuous portion.

At the continuous portion 380C, the third insulating sheet 381*a* has a length between the adjacent two planar-speaker units 380A, 380B, namely, a connection distance, which is made different from that of the fourth insulating sheet 384*a*.

In the illustrated example, the connection distance is larger in the third insulating sheet 381*a*. Accordingly, when the fourth insulating sheet 384*a* is straight, the third insulating sheet 381*a* sags. The length (connection distance) of each of the first insulating sheet 382*a* and the second insulating sheet 383*a* may be determined such that the connection distance becomes smaller in order from the third insulating sheet 381*a*, the first insulating sheet 382*a*, the second insulating sheet 383*a*, and the fourth insulating sheet 384*a*.

As a result, the first insulating sheet 382*a* and the second insulating sheet 383*a* also somewhat sag.

When the planar speaker 380 of FIG. 23A is folded along the continuous portion 380C, the connection distance of outward layers located outwardly of a lamination midpoint gets longer while the connection distance of inward layers located inwardly of the lamination midpoint gets shorter, as shown in FIG. 23B.

Accordingly, where the continuous portion 380C is arranged such that the third insulating sheet 381*a* has the longest connection distance and the fourth insulating sheet 384*a* has the shortest connection distance as explained above, undesirable stress will not be generated in the third, first, second, and fourth insulating sheets 381*a*-384*a* of the continuous portion 380C.

Adhesive layers 385*a*, 385*b* are strip-like, double-faced adhesive tapes. The adhesive layers 385*a*, 385*b* exist between the third insulating sheet 381 and the first insulating sheet 382 at a boundary region of the planar-speaker unit 380A and the continuous portion 380C and at a boundary region of the planar-speaker unit 380B and the continuous portion 380C, for bonding the two sheets 381, 382 in the longitudinal direction of the continuous portion 380C. It is preferable that each of the adhesive layers 385*a*, 385*b* function as a spacer having the same thickness as the first fixed electrode sheet 262.

Similarly, adhesive layers 386*a*, 386*b* are strip-like, double-faced adhesive tapes. The adhesive layers 386*a*, 386*b* exist between the first insulating sheet 382 and the second insulating sheet 383 at the boundary regions indicated above, for bonding the two sheets 382, 383 in the longitudinal direction of the continuous portion 380C. It is preferable that each of the adhesive layers 386*a*, 386*b* function as a spacer having a thickness which is a sum of the thicknesses of the adhesive layers 268, 269 and the vibrating electrode sheet 264.

Similarly, an adhesive layer 387 is a strip-like, double-faced adhesive tape. The adhesive layer 387 exists between the second insulating sheet 383*a* and the fourth insulating sheet 384*a* at a central portion of the continuous portion 380C, for bonding the two sheets 383*a*, 384*a* in the longitudinal direction of the continuous portion 380C. It is preferable that the adhesive layer 387 function as a spacer having the same thickness as the second fixed electrode sheet 266.

The structure of the continuous portion 380C is not limited to that described above. Even if the laminated layers (i.e., the third, first, second, and fourth insulating sheets 381-384) of the continuous portion 380C have a uniformly distributed structure, namely, even if the laminated layers have a uniform connection distance, there are not particular difficulties in allowing the planar speaker 380 to generate a sound in a folded state. This is because the thickness of the planar speaker 380 is about 1 mm and a difference in the connection distance between the most inward layer and the most outward layer at a time when the planar speaker 380 is folded is extremely small. For permitting the planar speaker 380 to be a product that endures folding of more than ten thousand times, however, the continuous portion 380C preferably has the structure described above.

The factor which greatly contributes to an improvement of durability of the laminated body is that the most outward sheet (the third insulating sheet 381) to be folded is less likely to be shifted with respect to its adjacent sheet (the first insulating sheet 382) which is located immediately inward thereof. If the most outward sheet is largely shifted with respect to the immediately-inward sheet at an initial period of the ten-thousand-time folding, the durability of the laminated body may be lowered. On the other hand, more inward sheets (the second insulating sheet 383 and the fourth insulating sheet 384) are protected by the most outward sheet and the immediately-inward sheet. Accordingly, the durability of the planar speaker is considered to be enhanced if only the most outward sheet is protected.

Seventh Embodiment

FIG. 24 is an external view of an electronic keyboard musical instrument of an upright piano type according to a seventh embodiment of the invention. FIG. 24A is a perspective view. FIG. 24B is an enlarged front view of a vicinity of a pedal lever in FIG. 24A.

Figure 24A:
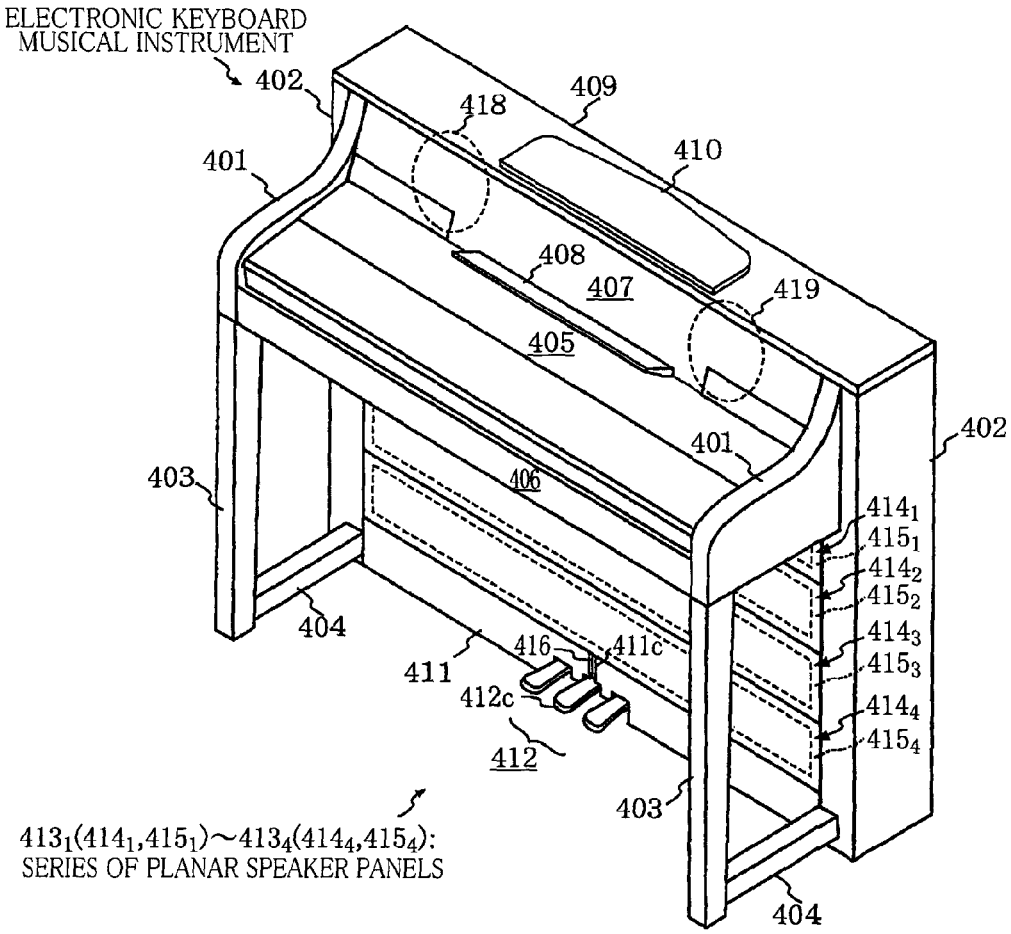
FIG. 24 is an external view of an electronic keyboard musical instrument of an upright piano type according to a seventh embodiment of the invention.
Figure 24B:
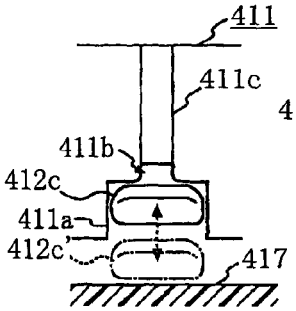
Figure 24C:
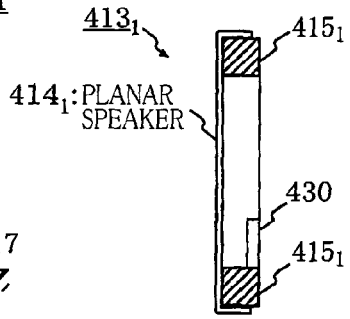
Figure 24D:
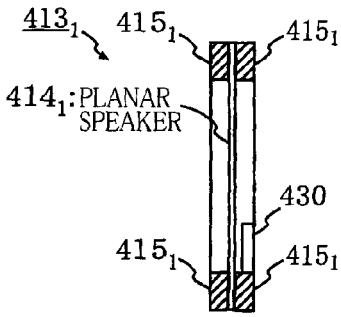

FIG. 24C is a vertical cross-sectional view of a longitudinally central portion of a planar speaker panel. FIG. 24D is a vertical cross-sectional view of a longitudinally central portion of a modified planar speaker panel.

A planar speaker 414 of the electronic keyboard musical instrument of the upright piano type according to the seventh embodiment is identical in construction with the planar speaker of the illustrated first embodiment. More specifically, a specific example of the planar speaker 414 is shown in FIGS. 4A-4D, FIG. 5, and FIGS. 6A, 6B.

In the electronic keyboard musical instrument, on the right side as viewed from the performer in FIG. 24A, the reference numerals 401, 402, 403, 404 respectively denote a side arm plate (side-surface portion), a side plate (side-surface portion, right leg body), a front leg, a stay connecting the front leg 403 and the side plate 402. A similar arrangement is provided on the left side in FIG. 24A, and the same reference numerals are attached to the corresponding components.

A keyboard portion disposed between the left and right side arm plates 401 is invisible because a fall board 405 is closed. The illustrated fall board 405 is a foldable type and is accommodated, during performance, in a lower part of an upper front plate 407 described below.

The front surface of the keyboard portion nearer to the performer is a key slip 406. The bottom surface of the keyboard portion is a key bed 421 (FIG. 25).

The upper part of the keyboard portion on the rear side remote from the performer is the upper front plate 407. At a central position of the upper front plate 407, a music rest 408 is provided. A top plate 409 is laid over the upper front plate 407, the left and right side plates 402, and a rear plate 422 (FIG. 25). At a central position of the top plate 409, a music rack 410 (in a fallen state in FIG. 24) is provided.

A pedal unit 411 is provided at a lower portion of the instrument, and three pedals 412 accommodated in a central portion of the pedal unit 411 protrude towards the performer's side. A pedal 12*c* is a center pedal.

A portion of the musical instrument, which extends from the pedal unit 411 to the bottom plate (key bed) 421 of the keyboard portion between the left and right side plates (left leg body and right leg body) 402, is formed as an open space in which no components or members exist between the front side (the performer's side) and the back side of the musical instrument. A series of planar speaker panels $\mathbf{413}_1$-$\mathbf{413}_4$ is provided so as to be flush with each other, namely, so as to be located on the same flat plane.

The planar speaker 414 is divided into four planar speakers $\mathbf{414}_1$-$\mathbf{414}_4$. The peripheral portions of the respective planar speakers $\mathbf{414}_1$-$\mathbf{414}_4$ are held by respective frames $\mathbf{415}_1$-$\mathbf{415}_4$, whereby respective planar speaker panels $\mathbf{413}_1$-$\mathbf{413}_4$ are constituted.

As shown in FIG. 24C which shows a planar speaker panel $\mathbf{413}_1$ by way of example, a rear surface of a rectangular planar speaker $\mathbf{414}_1$ is attached to a front surface of a rectangular frame $\mathbf{415}_1$, whereby the rectangular planar speaker $\mathbf{414}_1$ covers an upper surface and a lower surface of the rectangular frame $\mathbf{415}_1$, in addition to the front surface.

As shown in FIG. 24D, the planar speaker panel $\mathbf{413}_1$ may be configured such that peripheral portions of the front and rear surfaces of the rectangular planar speaker $\mathbf{414}_1$ are sandwiched by a pair of rectangular frame $\mathbf{415}_1$.

In each of FIGS. 24C and 24D, it is preferable that no fixed electrodes and vibrating electrodes be provided at the peripheral portions of the planar speaker $\mathbf{414}_1$. The frame $\mathbf{415}_1$ may be formed of a material having rigidity, such as wood or hard synthetic resin, or a material having substantially the same degree of flexibility as the planar speaker, such as soft synthetic resin.

In the planar speaker panels $\mathbf{413}_1$-$\mathbf{413}_4$, the frames $\mathbf{415}_1$-$\mathbf{415}_4$ of the respective planar speaker panels $\mathbf{413}_1$-$\mathbf{413}_4$ are contiguous to each other and are connected to each other by connecting members such as hinges 424-426 which will be explained later with respect to FIG. 25, thereby providing a series of planar speaker panels $\mathbf{413}_1$-$\mathbf{413}_4$, in other words, a connected speaker panel.

Accordingly, as explained later with respect to FIG. 25, the series of planar speaker panels $\mathbf{413}_1$-$\mathbf{413}_4$ changes in a state thereof, such that the planes of the respective planar speaker panels $\mathbf{413}_1$-$\mathbf{413}_4$ are flush with each other, namely, the planes of the respective planar speaker panels $\mathbf{413}_1$-$\mathbf{413}_4$ are located on one flat plane as a whole, and such that the planar speaker panels $\mathbf{413}_1$-$\mathbf{413}_4$ are bent, namely, the planes of the respective planar speaker panels $\mathbf{413}_1$-$\mathbf{413}_4$ are bent as a whole.

The series of planar speaker panels 413$_1$-413$_4$ is fixed at its upper end face to an upper position between the left side plate (left leg body) 402 and the right side plate (right leg body) 402. In the illustrated embodiment, left and right ends of an upper edge portion of the frame 415$_1$ of the planar speaker panel 413$_1$ are fixed to the upper position. A lower end face of the series of planar speaker panels 413$_1$-413$_4$, namely, a lower end face of the frame 415$_4$ of the planar speaker panel 413$_4$ is a free end. Hinges 427 are provided at left and right ends of the free end (lower end portion of the series of planar speaker panels 413$_1$-413$_4$), while a hook 416 is provided at a central portion of the lower end portion.

As shown in FIG. 25, the hook 416 is configured such that its proximal section is attached by a hinge 416*b* (only a shaft of which is shown) to the lower end face of the frame 415$_4$ and such that its distal section is bent at right angle so as to provide an engaging piece 416*a*. The hinge 416 is configured such that its flat plate (hinge wing) is loosely fixed to the lower end face of the frame 415$_4$ by one screw, whereby the flat plate per se is pivotable about the screw relative to the lower end face of the frame 415$_4$.

As shown in FIG. 24B, the pedal unit 411 includes a cutout 411*a* for accommodating the center pedal 412*c* located at its stationary position. When the performer steps on the pedal 412*c*, the pedal 412*c* gets closer to a floor surface 417 as illustrated by the reference sign 412*c*', and returns to the stationary position when the pedal 412*c* is released.

A recess 411*c* which is concave in the depth direction of the musical instrument is formed so as to extend from a central portion of an upper end of the cutout 411*a* to an upper end face of the pedal unit 411. Further, a cutout 411*b* is formed at one end of the recess 411*c* nearer to the cutout 411*a*.

When the performer fits the hook 416 into the recess 411*c* and inserts the engaging piece 416*a* of the hook 416 into the cutout 411*b*, the hook 416 is engaged. As a result, the series of planar speaker panels 413$_1$-413$_4$ and the planar speakers 414$_1$-414$_4$ maintain the state shown in FIG. 24A in which the planes of the respective planar speakers 414$_1$-414$_4$ are flush with each other, namely, the planes are located on one flat plane.

Referring back again to FIG. 24A, dynamic cone speakers 418, 419 are disposed on a left-side region and a right-side region of the upper front plate 407 as a baffle plate. Hereinafter, the dynamic cone speakers are simply referred to as "cone speakers". On the surface of the upper front plate 407, there is provided a punching metal, a net or a speaker grille, not shown, which has sound transmission property.

A stereo drive signal is supplied to the cone speakers 418, 419. The right cone speaker 419 may be eliminated, and only the left cone speaker 418 corresponding to the bass-range side of the keyboard may be provided. While the cone speakers 418, 419 are provided on the upper front plate 407 in the illustrated embodiment, the cone speakers 418, 419 may be provided on the key bed not shown, such that front opening portions of the cone speakers are directed downward.

The above-indicated side arm plates 401, side plates 402, top plate 409, key bed (bottom-surface portion) 421 in FIG. 25, key slip 406, upper front plate 407, rear plate 422 in FIG. 25 constitute a casing of the musical instrument. Further, an instrument main body is constituted by those components, the keyboard portion, and an inner space. The electronic keyboard musical instrument is constituted by the instrument main body, the front legs 403, the stays 404, the pedal unit 411, and a planar speaker panel 413$_1$-413$_4$.

The instrument main body incorporates a musical-sound-signal generating portion for generating a musical sound signal in accordance with a key operation by a user or performer.

The musical sound signal generated by the musical-sound-signal generating portion is amplified, and the amplified musical sound signal is boosted by a booster transformer. A high bias voltage is superimposed on the boosted musical sound signal, thereby providing a drive signal for the planar speakers 414$_1$-414$_4$. The drive signal is supplied, via an output code not shown, to the fixed electrodes and the vibrating electrode of each of the respective planar speakers 414$_1$-414$_4$ through a terminal provided on a corresponding one of the frames 415$_1$-415$_4$. Each planar speaker 414$_1$-414$_4$ outputs a sound in accordance with the musical sound signal outputted from the musical-sound-signal generating portion.

FIG. 25 is a first explanatory view showing a planar-speaker installation structure in the seventh embodiment of FIG. 24. FIG. 25 shows the series of planar speaker panels 413$_1$-413$_4$ and the left side plate 402 viewed from the right side of the musical instrument when the right side plate 402 is removed in FIG. 24.

For simplification, each planar speaker panel 413$_1$-413$_4$ is illustrated in a rectangular shape, and the planar speakers 414$_1$-414$_4$ and the frames 415$_1$-415$_4$ are not illustrated.

Figures 25A, 25B, 25C:
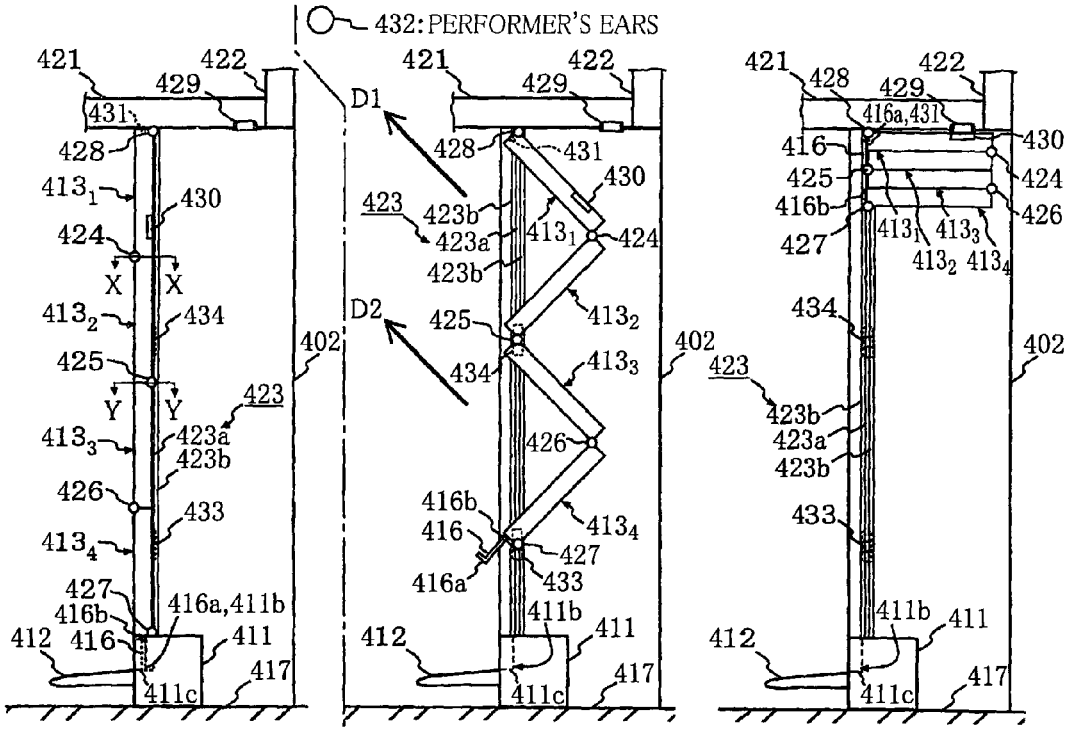
FIG. 25 is a first explanatory view of an installation structure of a planar speaker in the seventh embodiment shown in FIG. 24.

FIG. 25A is an explanatory view showing a state in which the planar speaker panels are flush with each other.

FIG. 25B is an explanatory view showing a state in which the planar speaker panels are alternately bent.

FIG. 25C is an explanatory view showing a state in which the planar speaker panels are folded up. The folded state is an extreme state of the alternately bent state.

The user manually operates the series of planar speaker panels 413$_1$-413$_4$, whereby the state of the planar speaker panels 413$_1$-413$_4$ changes among the above-indicated three states.

When the performer plays the musical instrument or when automatic performance is carried out, the musical sound is generated in the state shown in FIG. 25A. When the musical sound is not generated by the planar speaker panels 413$_1$-413$_4$, the planar speaker panels 413$_1$-413$_4$ are folded and accommodated as shown in FIG. 25C.

When the musical sound is generated in the state shown in FIG. 25B, direct sounds D1, D2 outputted from the planar speaker panels 413$_2$, 413$_4$ (the planar speakers 414$_2$, 414$_4$) are effectively heard at positions of the performer's ears 432. In this case, the state shown in FIG. 25B needs to be maintained.

In FIG. 25, the same reference numerals as used in FIG. 24 are used to identify the corresponding components. The reference numeral 421, 422 respectively denote the key bed as the bottom plate of the keyboard portion and the rear plate of the instrument main body. The reference numeral 423 denotes a guide rail (guide member) for regulating a relative movement of the series of planar speaker panels 413$_1$-413$_4$. In the illustrated embodiment, the guide rail 423 has a narrow-width opening portion 423*a* that extends in the vertical direction, and is fitted in a corresponding one of vertical grooves which are formed in regions of the respective left and right side plates 202, which regions are nearer to the performer's side. Edge portions 423*b* of the guide rail 423 which are located on opposite sides of the opening portion 423*a* are flush with the surface of the corresponding side plate 402.

The reference numerals 424-426 denote the hinges (connecting members). In FIG. 25, the hinges 424-426 are indicated by respective open circles. Each of the hinges 424-426 is provided so as to form a pair with respect to the left and right side plates 402.

Any adjacent two of the planar speakers 414$_1$-414$_4$ (any adjacent two of the frames 415$_1$-415$_4$) are connected by a corresponding one of the hinges 424-426, whereby the planar speakers $414_1$-$414_4$ are connected to each other so as to be alternately bendable, namely, so as to be bendable in a zigzag fashion.

As the hinges 424, 426, generally available hinges can be used. Each hinge 424 is disposed between: a corner portion between a lower end face and a front face of the planar speaker panel $413_1$ (the frame $415_1$); and a corner portion of an upper end face and a front face of the planar speaker panel $413_2$ (the frame $415_2$). Each hinge 426 is disposed between: a corner portion between a lower end face and a front face of the planar speaker panel $413_3$ (the frame $415_3$); and a corner portion between an upper end face and a front face of the planar speaker panel $413_4$ (the frame $415_4$).

On the other hand, each hinge 425 is disposed between: a corner portion between a lower end face and a back surface of the planar speaker panel $413_2$ (the frame $415_2$); and a corner portion between an upper end face and a back surface of the planar speaker panel $413_3$ (the frame $415_3$). In each hinge 425, a hinge shaft is extended on one side thereof (nearer to the left or right side plate 402), and is fitted in the opening portion 423*a* of a corresponding one of the left and right guide rails 423 provided on the respective left and right side plates 402, thus functioning as a guided shaft (guided member).

The reference numeral 427 denotes a guided shaft (guided member). Two guided shafts 427 are provided so as to form a pair with respect to the left and right side plates 402. Each guided shaft 427 is disposed at a corner portion between a lower end face and a back surface of the planar speaker panel $413_4$ (the frame $415_4$), and is fitted in the opening portion 423*a* of a corresponding one of the two guide rails 423.

The reference numeral 428 denotes a pivot shaft. Two pivot shafts 428 are provided so as to form a pair with respect to the left and right side plates 402. Each pivot shaft 428 is disposed at a corner portion between an upper end face and a back surface of the planar speaker panel $413_1$ (the frame $415_1$). A shaft end of each pivot shaft 428 is fitted in the opening portion 423*a* of a corresponding one of the left and right guide rails 423 so as to penetrate a bottom portion 423*d* (FIG. 26C) of the guide rail 423, whereby the pivot shaft 428 is pivotably supported directly by the corresponding one of the left and right side plates (the left and right leg bodies) 402.

Instead, the pivot shaft 428 may be supported, in the corresponding guide rail 423, by a support member (not shown) which is fixedly attached to the inside of the guide rail 423.

Alternatively, the pivot shaft 428 may be supported indirectly by the corresponding one of the left and right side plates (the left and right leg bodies) 402, by providing a bearing member for the pivot shaft 428 on the bottom surface of the key bed 421.

Thus, the upper end face of the planar speaker panel $413_1$ (the frame $415_1$), as the upper end portion of the series of planar speaker panels $413_1$-$413_4$, is supported by the pivot shafts 428 to the upper position between the left and right side plates (the left and right leg bodies) 402.

Further, the state of the series of planar speaker panels $413_1$-$413_4$ changes among the three states shown in FIGS. 25A, 25B, 25C permitting the lower end portion of the planar speaker panel $413_4$ (the frame $415_4$) to act as the free end while movements of the hinges 424-426 and the guided shafts 427 are regulated by the guide rails (the guide members) 423.

In FIG. 25A, by inserting the engaging piece 416*a* of the hook 416 into the cutout 411*b*, the flat state of the series of planar speaker panels $413_1$-$413_4$ shown in FIG. 25A is securely maintained.

The folded state shown in FIG. 25C is maintained by rotating the hinge 416*b* by a half-turn as shown in FIG. 25B and inserting the engaging piece 416*a* of the hook 416 into a groove 431 formed in the upper end face of the planar speaker panel $413_1$ (the frame $415_1$) for engagement, as shown in FIG. 25C. Instead, there may be provided, on the bottom surface of the key bed 421, a retaining portion into which the engaging piece 416*a* is to be inserted.

The hook 416 illustrated in FIGS. 25A, 25B is short in its length, so that the engaging piece 416*a* cannot be retained in the groove 431, as in the arrangement shown in FIG. 25C. In this respect, the thickness of the planar speaker panels $413_1$-$413_4$ can be made smaller than the illustrated thickness. Accordingly, even if the hook 416 is short, the engaging piece 416*a* can be fitted in the groove 431.

An engaging portion to be retained by the groove 431 may be provided on the lower end face of the planar speaker panel $413_4$, separately from the hook 416.

As shown in FIG. 25, a permanent magnet 429 may be provided on a portion of the bottom surface of the key bed 421 nearer to the rear plate 422 while an iron plate 430 may be provided on the rear surface of the planar speaker panel $413_1$. When folding the planar speaker panels $413_1$-$413_4$, the iron plate 430 is attracted to the permanent magnet 429. Owing to the attraction force, it is possible to prevent the frame $415_1$ from inclining rearward.

Where it is desirable to maintain the bent state shown in FIG. 25B, the state cannot be maintained by the hook 416.

The bent state is maintained by holding connected positions of the hinges 425 and the guided shafts 427 relative to the guide rails (the guide members) 423. In each guide rail 423, intermediate engaging portions 433, 434 are formed, and the hinge 425 and the guided shaft 427 are configured to temporarily engage the intermediate engaging portions 433, 434, respectively, when the respective shaft ends of the hinge 425 and the guided shaft 427 reach the positions of the corresponding intermediate engaging portions 433, 434. By pulling up and down the planar speaker panels $413_1$-$413_4$ with a strong force, the engaged state is cancelled.

In each of the intermediate engaging portions 433, 434, the bottom portion 423*d* of each guide rail 423 is cut, and a strip-like leaf spring which has been subjected to bending is fixed so as to protrude toward the inside of the guide rail 423. A central portion of the leaf spring is formed as a recess for engagement with the shaft end of the hinge 425 or the guided shaft 427, so as to provide a temporal fixation position (intermediate stable position). Convex portions are provided on an upward side and a downward side of the recess. The convex portions protrude so at to elastically press the shaft end of the hinge 425 or the guided shaft 427. The shaft end of the hinge 425 or the guided shaft 427 gets into the recess beyond the convex portions, whereby the movement of the hinge 425 or the guided shaft 427 is blocked. Because the convex portions are smoothly inclined, the shaft end becomes again movable beyond the convex portions when the user applies an extra force to the planar speaker panels $413_1$-$413_4$.

The state shown in FIG. 25B may be maintained by permitting the hinges 425 to have a function of holding an angle at which the planar speaker panel $413_2$ (the frame $415_2$) and the planar speaker panel $413_3$ (the frame $415_3$) that are adjacent to each other are connected, or by permitting the hinges 424 and the hinges 426 to have such a connection-angle holding function.

FIG. 26 is a second explanatory view showing an attaching structure of the hinges in the embodiment shown in FIG. 24.

Figure 26A:
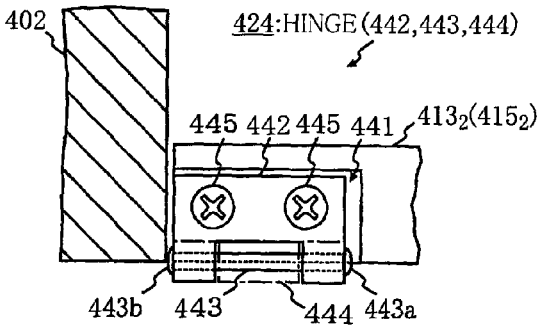
FIG. 26 is a second explanatory view of an attachment structure of hinges in the seventh embodiment shown in FIG. 24.

FIG. 26A is a plan view as seen in the direction of arrows X in FIG. 25 and showing a structure of the hinge 424 taken along line X-X of the left side plate 402 shown in FIG. 25A. In FIG. 26A, the side plate 402 and the guide rail 423 are illustrated in horizontal cross section. FIG. 26B is a front view of the part of FIG. 26A. The right side plate 402 has a similar arrangement, so that the left and right side plates 402 have a left-right symmetrical structure.

Figure 26C:
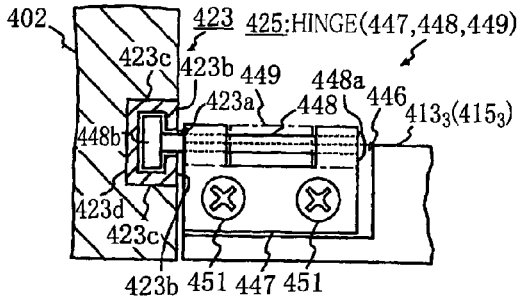
Figure 26B:
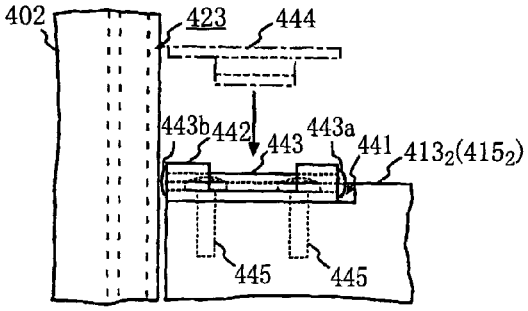
Figure 26D:
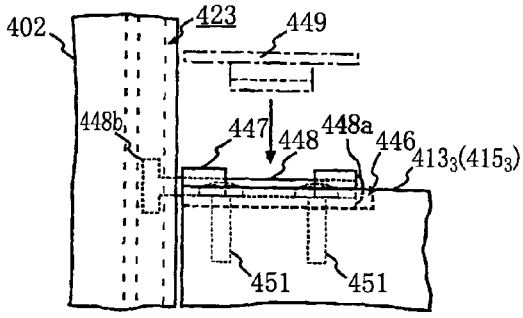

FIG. 26C is a plan view as seen in the direction of arrows Y and showing a structure of the hinge 425 taken along line Y-Y in FIG. 25A. In FIG. 26C, the side plate 402 is illustrated in horizontal cross section. FIG. 26D is a front view of the part of FIG. 26C.

In FIG. 26, the same reference numerals as used in FIGS. 24, 25 are used to identify the corresponding components.

The hinge shown in FIGS. 26A, 26B has flat plates 442, 444, each as a wing, and a shaft 443. A groove 441 providing a stepped surface is formed at the corner portion between the upper end face and the front face of the second planar speaker panel $\mathbf{413}_2$ (the frame $\mathbf{415}_2$), and the flat plate 442 is fixed by a screw 445. On the other hand, the flat plate 444 indicated by long dashed and short dashed line is screwed to the lower end face of the first planar speaker panel $\mathbf{413}_1$ (the frame $\mathbf{415}_1$).

Cylindrical portions are alternately formed on the flat plates 442, 444. The shaft 443 is inserted into the cylindrical portions, and opposite (left and right) ends 443*a*, 443*b* of the shaft 443 are processed for prevention of coming off, whereby the flat plates 442, 443 are pivotable about the shaft 443, and the second planar speaker panel $\mathbf{413}_2$ (the frame $\mathbf{415}_2$) and the first planar speaker panel $\mathbf{413}_1$ (the frame $\mathbf{415}_1$) are accordingly pivotable relative to each other.

It is possible to increase a frictional force between the cylindrical portions of the flat plates 442, 444 and the shaft 443 by increasing the diameter of the shaft 443 or by fitting, on the shaft 443, a material having a large frictional coefficient, thus ensuring an action of holding the connection angle of the hinge 424.

The hinge 425 shown in FIGS. 26C, 26D has flat plates 447, 449 and a shaft 448. A groove 446 providing a stepped surface is formed at the corner portion between the upper end face and the rear surface of the third planar speaker panel $\mathbf{413}_3$ (the frame $\mathbf{415}_3$), and the flat plate 447 is fixed by a screw 451. On the other hand, the flat plate 449 indicated by long dashed and short dashed line is screwed to the lower end face of the second planar speaker panel $\mathbf{413}_2$ (the frame $\mathbf{415}_2$).

Cylindrical portions are alternately formed on the flat plates 447, 449. The shaft 448 is inserted into the cylindrical portions, and one end 448*a* of the shaft 448 is processed for prevention of coming off. The other end 448*b* of the shaft 448 is inserted into the opening portion 423*a* of the corresponding guide rail 423 beyond left-side ends (in FIGS. 26C, 26D) of the respective flat plates 447, 449.

Each of the illustrated guide rails 423 is formed such that opposite edge portions 423*b* of the opening portion 423*a* are contiguous to respective side portions 423*c*, and the side portions 423*c* are contiguous to the bottom portion 423*d*. The opening portion 423*a* has a width smaller than that of the side portions 423*c*.

By making the diameter of the other end 448*b* of the shaft 448 larger than the width of the opening portion 423*a*, the other end 448*b* is prevented from coming off.

An increase in a frictional force between the other end 448*b* of the shaft 448 and the opposite edge portions 423*b* of the opening portion 423*a* or an increase in a frictional force between the shaft 448 and the guide rail 423 ensures an action of holding the connection position of the hinge 425.

The guided shaft 427 shown in FIG. 25 is realized by using a combination of the shaft 448 and the flat plate 449 among the components of the hinge 425 shown in FIGS. 26C, 26D. Similarly, the pivot shaft 428 shown in FIG. 25 is realized by a combination of the flat plate 447 and the shaft 448. In these instances, the other end 448*b* of the shaft 448 is supported in the guide rail 423 by a support member not shown.

Figure 27:
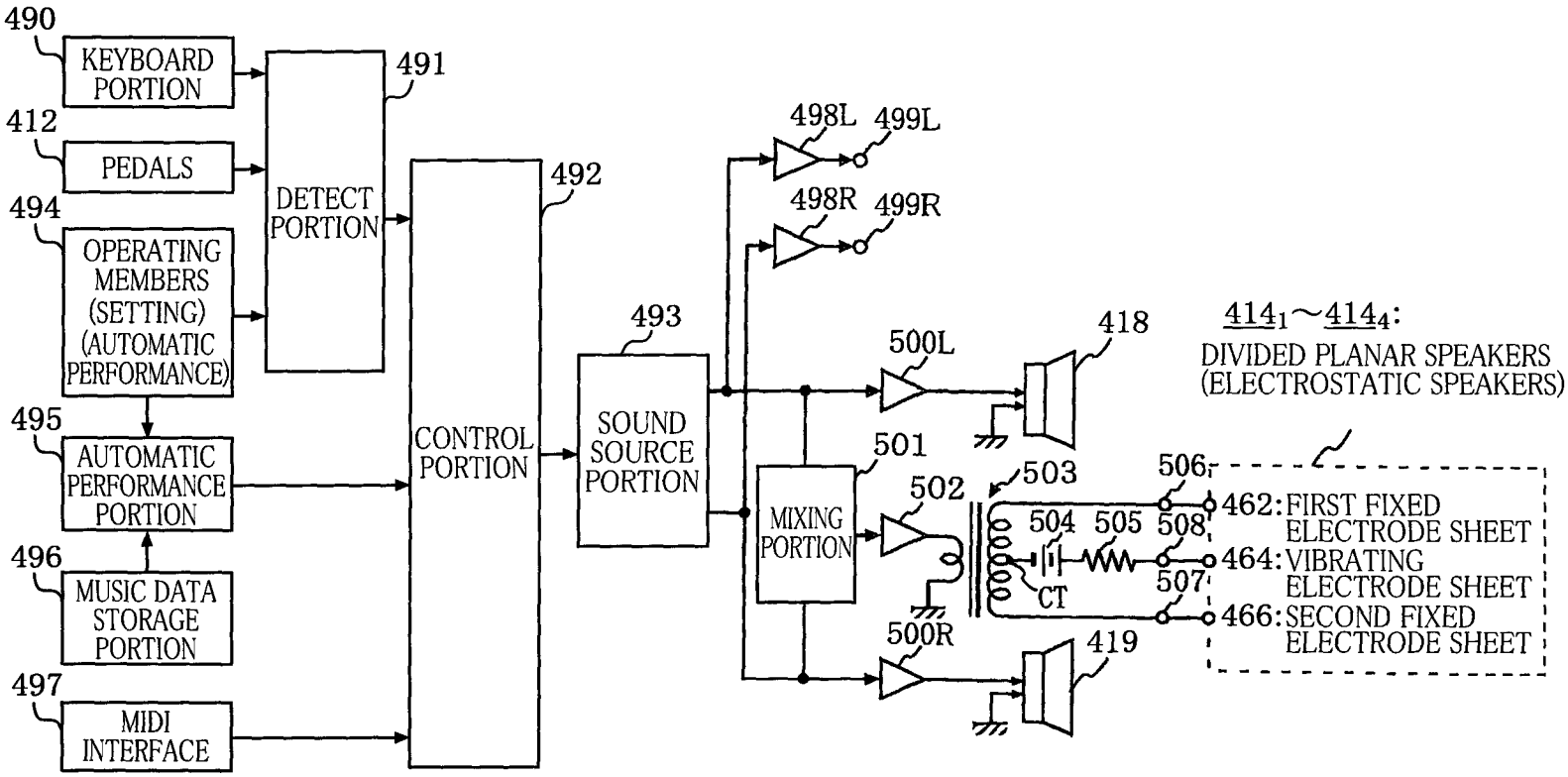
FIG. 27 is a functional block diagram of the electronic keyboard musical instrument according to the seventh embodiment shown in FIG. 24.

FIG. 27 is a functional block diagram of the electronic keyboard musical instrument according to the embodiment shown in FIG. 24.

Operations of the white keys and the black keys of the keyboard portion 490 hidden by the fall board 405 and operations of the pedals 412 shown in FIG. 24 are detected by a detect portion 491, and detection signals are outputted to a control portion 492. The control portion 492 outputs performance data to a sound source portion 493. The performance data includes data relating to timing of key depression and key release, a note number (pitch) corresponding to a depressed or released key, a velocity (key depression velocity), an aftertouch amount, and so on. Further, data relating to a kind and an operation amount of the operated pedal 412 is also outputted. The control portion 492 indicated above is realized by permitting a CPU to execute instrument's built-in programs.

In the electronic keyboard musical instrument shown in FIG. 24, an operation panel is provided below the fall board 405, together with the keyboard portion 490. In the operation panel, a plurality of operating members (buttons and knobs) are provided. The operating members 490 include an operating switch for setting of instrument's sound color or timbre and a switch for controlling music selection, and reproduction starting and reproduction stopping, for automatic performance.

The operations of the operating members 494 are detected by the detect portion 491 and outputted to the control portion 492. The control portion 492 sets functions assigned to the operating members 494 with respect to the electronic keyboard musical instrument. Where the setting is made with respect to the sound source portion 493, sound source setting data is outputted to the sound source portion 493.

The above-indicted electronic keyboard musical instrument incorporates an automatic performance portion 495 and a music data storage portion 496. The automatic performance portion 495 reads out music or tune stored in the music data storage portion 496 by the operation of the operating members 494, and outputs MIDI (Musical Instrument Digital Interface) performance data to the control portion 492. The above-indicated automatic performance portion 495 is also realized by permitting the CPU to execute the instrument's built-in programs.

MIDI interface 497 receives, through terminals provided on the rear plate 422 (FIG. 25), the MIDI performance data supplied from a personal computer and other electronic musical instruments, and outputs the data to the control portion 492.

On the basis of the performance data inputted from the control portion 492, the sound source portion 493 generates a musical sound signal for a stereo with two channels L and R having pitch and intensity in accordance with sound source setting such as the sound color or the key depression operation, and outputs the signal to amplifiers 498L, 498R, 500L, 501R and a mixing portion (mixer) 502.

The illustrated sound source portion 493 utilizes a left source and a right source for the stereo, for generating one musical sound. These sound sources are stored in a sound source waveform memory not shown.

The sound source portion 493 may be configured to use a monaural source and to control a volume ratio between the left channel and the right channel in accordance with the band zone of the operated key, and so on, namely, may be configured to perform a sound image localization control.

Outputs of the amplifiers 498L, 498R are respectively outputted to external terminals 499L, 499R for headphones.

Outputs of the amplifier 500L, 500R are respectively sent to the cone speakers 418, 419 shown in FIG. 24.

The mixing portion 501 mixes the stereo outputs of the sound source portion 493 and outputs to an amplifier 502. An output of the amplifier 502 is sent to a primary coil of a booster transformer 503. To a secondary coil of the booster transformer 503, the electrostatic speakers such as the planar speakers $414_1$-$414_4$ shown in FIG. 24 are connected. The secondary coil of the booster transformer 503 includes a center tap CT to which is connected a series circuit of a high-voltage bias direct current (DC) power source 504 and a high-resistance resistor 505. Opposite ends of the secondary coil described above function as terminals 506, 507, and one end of the resistor 505 functions as a terminal 508.

The terminal 506 is connected to the first fixed electrode sheet 32, the terminal 507 is connected to the second fixed electrode sheet 36, and the terminal 508 is connected to the vibrating electrode sheet 34, shown in FIGS. 4C and 4D.

Here, there will be explained an operation principle of the electrostatic planar speaker, taking a potential of the vibrating electrode sheet 34 as a reference of potential. The first fixed electrode sheet 32 and the second fixed electrode sheet 36 are negatively charged at $E_0$=several hundred voltage [V] by the bias DC power source 504, and there are generated electrostatic attraction forces in mutually opposite directions between the vibrating electrode sheet 34 and the first fixed electrode sheet 32 and between the vibrating electrode sheet 34 and the second fixed electrode sheet 36.

In this state, where musical sound signals of ±e [V] (here, e is sufficiently smaller than $E_0$) having mutually opposite phases are respectively applied to the first fixed electrode sheet 32 and the second fixed electrode sheet 36, the first fixed electrode sheet 32 and the second fixed electrode sheet 36 are negatively charted at ($E_0$+e) [V] and ($E_0$−e) [V], respectively. Consequently, the balance of the electrostatic attraction force between the vibrating electrode sheet 34 and the first fixed electrode sheet 32; and the electrostatic attraction force between the vibrating electrode sheet 34 and the second fixed electrode sheet 36 is broken. As a result, there is generated an electrostatic attraction force that is proportional to the musical sound signal e [V], and the vibrating electrode sheet 34 is push-pull driven depending upon whether the musical sound signal e [V] is positive or negative.

In the above explanation, the outputs of the amplifiers 500L, 500R are outputted directly to the respective cone speakers 418, 419. The cone speakers 418, 419 are used for compensating for a decrease in the reproduction output on the lower frequency side of the planar speakers $414_1$-$414_4$. Accordingly, speakers called woofer speakers are normally used. In view of this, it is preferable to insert a low-pass filter circuit to the input side or the output side of each amplifier 500L, 500R, for supplying the music sound signal in accordance with the frequency characteristic of the cone speakers 418, 419.

Similarly, a high-pass filter circuit or a middle and high-pass filter circuit may be inserted to the input side or the output side of the amplifier 502, for supplying, to the booster transformer 503, the music sound signal in accordance with the frequency characteristic of the planar speakers $414_1$-$414_4$.

The characteristics of the above-indicated filter circuits are designed such that the sound outputted from the cone speakers 418, 419 and the sound outputted from the planar speakers $414_1$-$414_4$ are balanced in terms of the frequency characteristic.

Further, tweeter speakers for reproduction of the treble range (such as dome-type dynamic speakers) may be provided, and the amplifiers 500L, 500R may distribute the musical sound signal to the tweeter speakers. A switch may be provided for switching the planar speakers $414_1$-$414_4$ and the tweeter speakers for selective use thereof.

While not shown, a sound source exclusive for the planar speakers $414_1$-$414_4$ may be prepared in the sound source portion 493. In this instance, the musical sound signal based on the exclusive source may be supplied to the booster transformer 503 after having been amplified by the amplifier 502.

Where the above-indicated planar speakers $414_1$-$414_4$ are divided for the left and right channels, a stereo signal is supplied from the sound source portion 493, amplified without being mixed by the mixing portion 501, and is outputted to the booster transformers of the left and right channels.

Eighth Embodiment

FIG. 28 is an external view of an electronic keyboard musical instrument of an upright piano type according to an eighth embodiment of the invention.

Figure 28A:
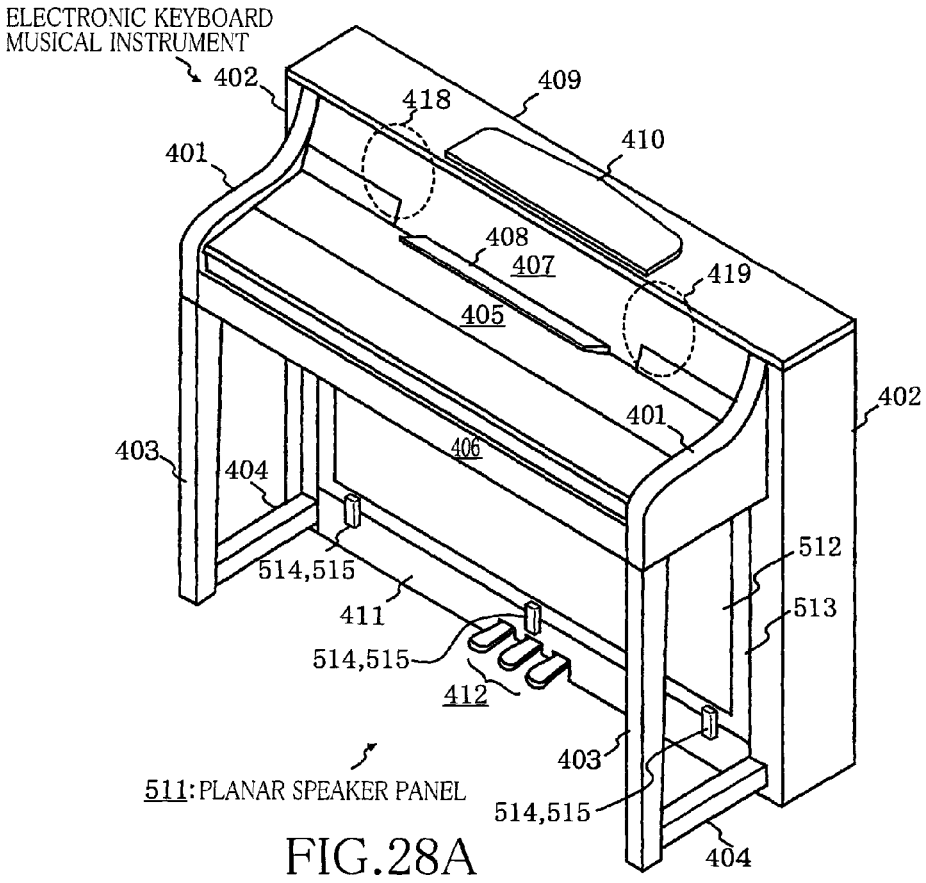
FIG. 28 is an external view of an electronic keyboard musical instrument of an upright piano type according to an eighth embodiment of the invention.
Figure 28B:
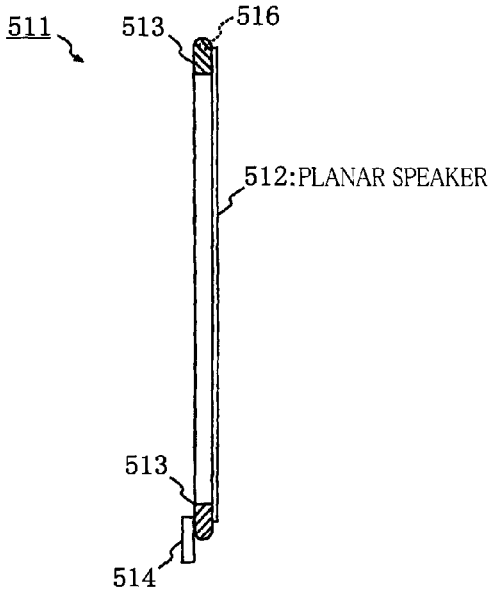
Figure 28C:
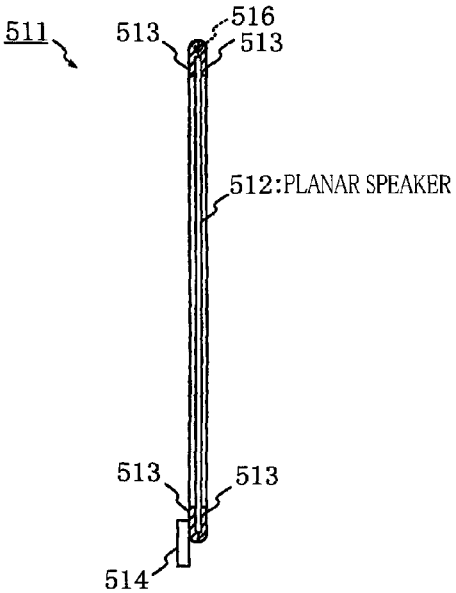

FIG. 28A is a perspective view. FIG. 28B is a vertical cross-sectional view of a longitudinally central portion of a planar speaker panel 511 shown in FIG. 28A. FIG. 28C is a vertical cross-sectional view of a longitudinally central portion of a modified example of the planar speaker panel 511.

In FIG. 28, the same reference numerals as used in FIG. 24 are used to identify the corresponding components.

As shown in FIG. 28A, the planar speaker panel 511 is disposed between the left and right side plates (left and right leg bodies) 502, such that a planar speaker 512 of the planar speaker panel 511 is in a state in which the plane of the planar speaker 512 maintains flat (a flat state), namely, the plane of the planar speaker 512 is located on one flat plane.

In the planar speaker panel 511 shown in FIG. 28B, a rectangular frame 513 is attached to a front surface of the rectangular planar speaker 512, whereby the rectangular planar speaker 512 covers a rear surface of the rectangular frame 513. Instead, the planar speaker panel 511 may be configured such that peripheral portions of the front and rear surfaces of the rectangular planar speaker 512 are sandwiched by a pair of rectangular frames 513, as shown in FIG. 28C.

In each of FIGS. 28B and 28C, it is preferable that no fixed electrodes and vibrating electrodes be provided at the peripheral portions of the planar speaker 512. The frame 513 is formed of a soft synthetic resin having substantially the same degree of flexibility as the planar speaker 512.

In the illustrated embodiment, connecting members 514 are fixed to a lower end portion of the frame 513 so as to be respectively located at a central portion, a left portion, and a right portion, of the lower end portion of the frame 513. First connection members 515 are provided on the front surface of the pedal unit 411. The first connection members 515 are to be connected to the lower end portion of the planar speaker panel 511, specifically, to be connected to the respective connecting members 514. Each of the illustrated first connection members 515 is a hook, a hole, or a groove, for instance, for retaining each first connection member 515 such as a protuberance, a through-hole, or a ring. Each connecting member 514 may be a permanent magnet while each connection member 515 may be an iron member.

In the planar speaker panel 511, the connecting members 514 come into engagement with the respective connection members 515, whereby the plane of the planar speaker 512 is kept flat, namely, the plane of the planar speaker 512 is located on one flat plane.

In FIGS. 28B and 28C, the reference numeral 516 denotes a pivot shaft. The pivot shaft 516 is provided at an upper end portion of the frame 513 and is pivotably supported in bearing holes 117 (FIG. 29A) formed in the respective left and right side plates (left and right leg bodies) 402.

Accordingly, an upper end of the planar speaker panel 511 is fixed to an upper position between the left and right side plates (left and right leg bodies) 402 while a lower end portion of the planar speaker panel 511 is a free end.

The upper end portion of the planar speaker panel 511 may be fixed to the upper position between the left and right side plates (left and right leg bodies) 402 by a simple stationary or fixed shaft which is not pivotable or may be fixed to the lower surface of the key bed 421.

FIG. 29 is an explanatory view showing an installation structure of the planar speaker in the embodiment of FIG. 28.

Figures 29A, 29B, 29C:
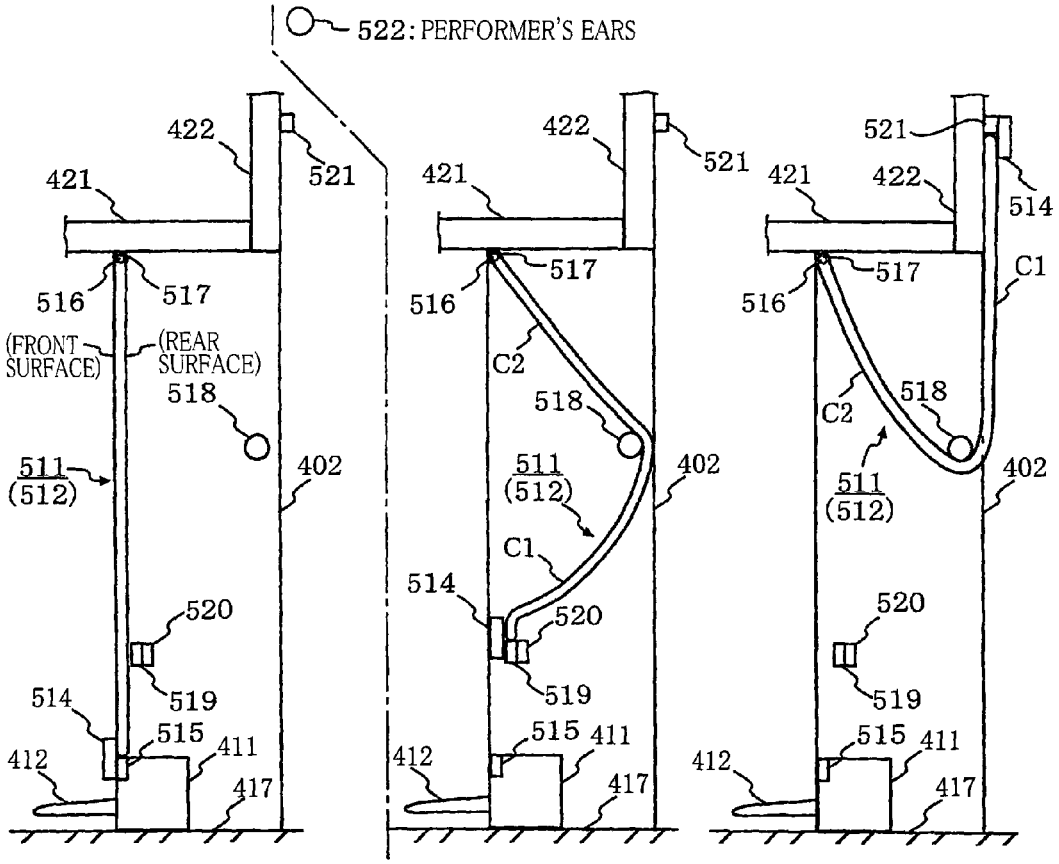
FIG. 29 is an explanatory view of an installation structure of a planar speaker in the eighth embodiment shown in FIG. 28.

FIG. 29A-29C show the planar speaker panel 511 and the left side plate 402 viewed from the right side of the musical instrument when the right side plate 402 is removed in FIG. 28.

For simplification, the planar speaker 512 of the planar speaker panel 511 and the frame 513 are not illustrated.

In FIG. 29, the same reference numerals as used in FIGS. 24, 25, 28 are used to identify the corresponding components.

FIG. 29A is an explanatory view showing a flat state of the planar speaker panel 511 in which the plane of the planar speaker panel 511 is located on one flat plane.

FIGS. 29B, 29C are explanatory views respectively showing a first bent state and a second bent state of the planar speaker panel 511.

The user manually operates the planar speaker panel 511, whereby the state of the planar speaker panel 511 changes among the above-indicated three states.

When the musical sound is generated in performance by a performer or in automatic performance, the planar speaker panel 511 (the planar speaker 512) may take any of the states shown in FIGS. 29A-29C.

The pivot shaft 516 is disposed on an upper end face of the planar speaker panel 511 (the frame 513) and is fitted in the bearing holes 517 formed in the respective left and right side plates (left and right leg bodies) 402, whereby the pivot shaft 516 is pivotably supported with respect to the left and right side plates 402.

The reference numeral 518 denotes a guide member along which the planar speaker panel 511 is bent. In the illustrated embodiment, the guide member has a circular cross section and extends between the left and right side plate 402.

The reference numerals 519, 520 respectively denote a second connection member and a holder for the second connection member 519. In the illustrated embodiment, each of the second connection member 519 and the holder 520 is a bar member having a rectangular cross section and extends between the left and right side plates 402. The reference numeral 521 denotes a third connection member provided on the back surface of the rear plate 422 in the illustrated embodiment.

In FIG. 29A, the planar speaker panel 511 is disposed such that the planar speaker 512 keeps a flat state in which the plane of the planar speaker 512 is kept flat, namely, the plane of the planar speaker 512 is located on one flat plane, between the left and right side plates (left and right leg bodies) 402.

When the planar speaker 512 is driven in this state, the plane wave is outputted from the front surface of the planar speaker 512 toward the front side of the electronic keyboard musical instrument. At the same time, the plane wave is outputted also from the rear surface of the planar speaker 512 toward the back side of the electronic keyboard musical instrument.

Here, the user disengages connection between the connecting members 514 and the first connection members 515, and passes the lower end of the planar speaker panel 511 behind the guide member 518.

When the connecting members 514 of the planar speaker panel 511 which is bent along the guide member 518 are brought into connection with the second connection member 519 by the user as shown in FIG. 29B, the state of the planar speaker panel 511 changes to the bent state shown in FIG. 29B.

When the planar speaker 512 is driven in this bent state, the sound generated from a front surface of a section C1 of the planar speaker 512, which is located at a lower position than the guide member 518 in this state, can be more effectively heard by performer's ears 522.

Further, the user disengages connection between the connecting members 514 and the first connection members 515 shown in FIG. 29A. Subsequently, the connecting members 514 of the planar speaker panel 511, which is bent along the guide member 518, are brought into connection with the third connecting members 521 by the user without passing the lower end portion of the planar speaker panel 511 behind the guide member 518, whereby the state of the planar speaker panel 511 changes to the bent state shown in FIG. 29C.

In this state, the sound generated from a rear surface of the section C1 of the planar speaker 512 is effectively transmitted directly to the audience present on the back side of the electronic keyboard musical instrument.

In the illustrated embodiment, the planar speaker panel 511 is bent at one position. Where the planar speaker panel 511 is bent at a plurality of positions by using a plurality of guide members, the planar speaker panel 511 (the planar speaker 512) can be bent in a zigzag fashion, like the planar speaker panels $\mathbf{413}_1$-$\mathbf{413}_4$ shown in FIG. 24, or can be curved. In this instance, where the planar speaker panel 511 is bent or curved so as to become convex with respect to the front side of the electronic keyboard musical instrument (i.e., toward the performer's side), the directivity angle of the sound outputted from the front surface of the planar speaker 512 is enlarged. On the other hand, where the planar speaker panel 511 is bent or curved so as to become concave with respect to the front side of the electronic keyboard musical instrument (i.e., toward the performer's side), the sound outputted from the front surface of the planar speaker 512 converges. In FIG. 29B, the section C1 of the planar speaker 512 is concave due to sagging thereof. In this instance, there is obtained, at the positions of the performer's ears 522, a convergence effect of the sound outputted from the section C1 of the planar speaker 512, e.g., a convergence effect of a convex cylindrical lens where the sound is likened to a light.

The state shown in FIG. 29C may be made as a state in which the planar speaker 512 is accommodated while being lifted, when the planar speaker panel 511 is not in use.

Further, where the bending angle of the planar speaker panel 511 is made equal to 180 degrees, the planar speaker panel 511 is placed in a state in which the planar speaker panel 511 is folded up. This folded state is an extreme state of the bent state.

While not illustrated, in the series of planar speaker panels $\mathbf{413}_4$-$\mathbf{413}_4$ (the planar speakers $\mathbf{414}_1$-$\mathbf{414}_4$) shown in FIGS. 24 and 25, all of the hinges 424-426 and the guided shafts 427 may be rearranged so as to be disposed on the front surface side of the series of planar speaker panels $\mathbf{413}_1$-$\mathbf{413}_4$. By using one or a plurality of guide members 518 shown in FIG. 29 and by also using the holding member 520, the connecting members 514, and the second connection member 519, the planar speakers $414_1$-$414_4$ indicated above may be formed as a curved speaker which is curved so as to be concave with respect to the front side.

The structure of the planar speaker 512 of the electronic keyboard musical instrument of the upright piano type according to the eighth embodiment is identical with that of the planar speaker according to the fifth embodiment.

As the planar speaker 512 shown in FIGS. 28 and 29, the planar speaker 350 according to the fifth embodiment of FIG. 21 may be employed in which the planar-speaker units 350A, 350B are disposed so as to be continuous with the continuous portion 350C interposed therebetween.

In this instance, the planar speaker 512 is designed such that the right side of the planar speaker 512 is provided by the upper side of the planar speaker 350 while the upper side of the planar speaker 512 is provided by the left side of the planar speaker 350 and such that the length of each side of the planar speaker 512 is suitably determined in accordance with the size or dimension of the electronic keyboard musical instrument shown in FIG. 28.

Further, the planar speaker 512 is designed such that the position of the continuous portion 350C corresponds to the position of the guide member 518 so as to extend along the guide member 518.

Because the flexibility of the continuous portion 350C can be easily increased in terms of its structure, it is possible to ensure sufficient durability with respect to repeated bending of the planar speaker 512 along the guide member 518.

Ninth Embodiment

Figure 30A:
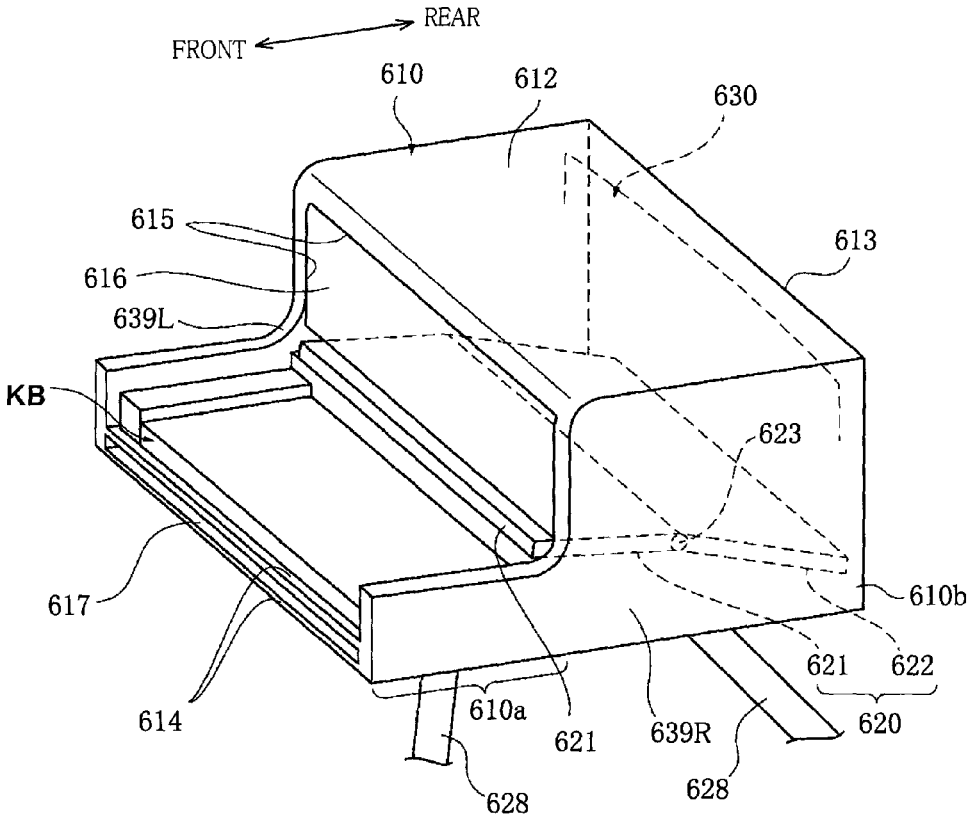
FIG. 30A is a perspective view of an electronic keyboard musical instrument according to a ninth embodiment of the present invention and FIG. 30B is a plan view showing a rear portion of the electronic keyboard musical instrument.
Figure 30B:
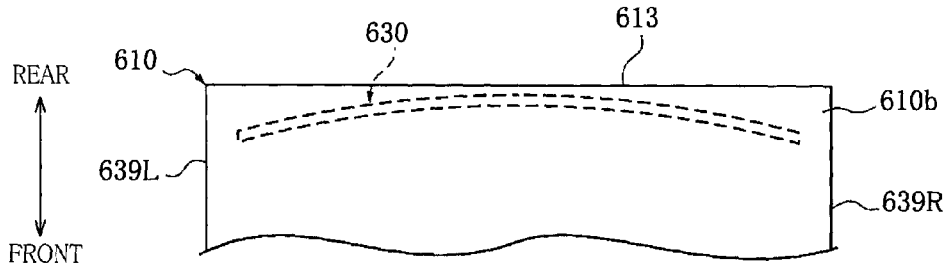
Figure 31A:
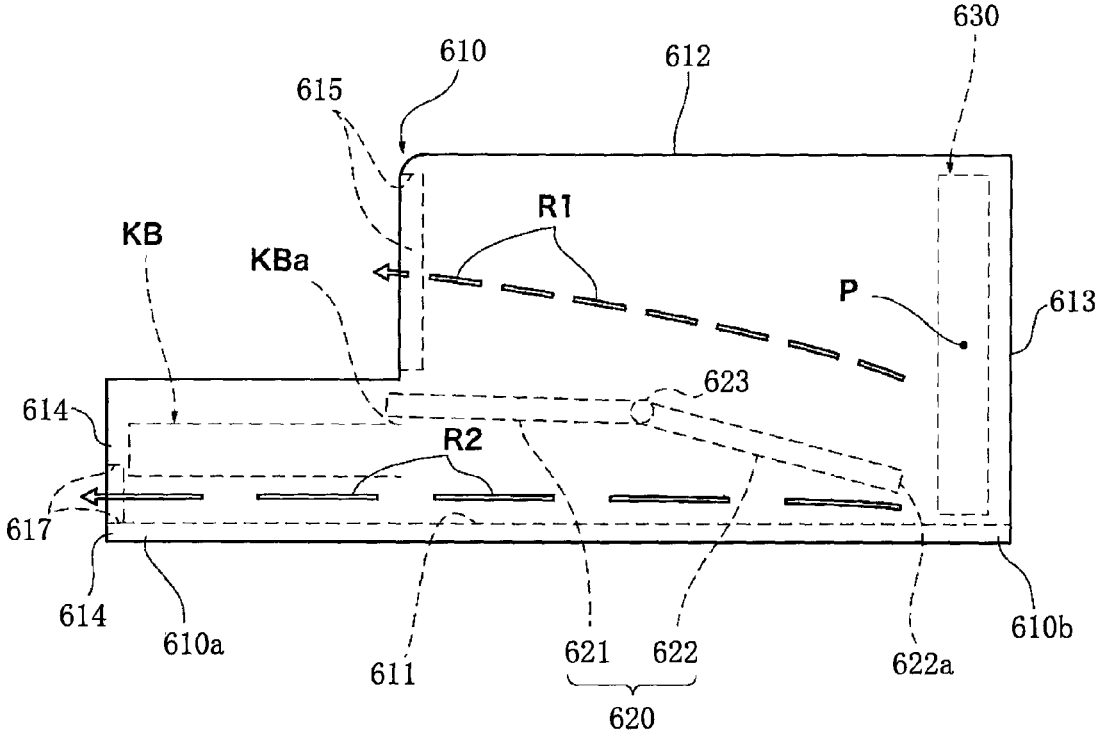
FIG. 31A is a schematic side view of an instrument main body.

FIG. 30A is a perspective view of an electronic keyboard musical instrument according to a ninth embodiment of the present invention. FIG. 30B is a plan view showing a rear portion of the electronic keyboard musical instrument. FIG. 31A is a schematic side view of an instrument main body 610.

As shown in FIG. 30A, the electronic keyboard musical instrument has the instrument main body 610 supported by leg portions 628. A keyboard portion KB is disposed at a front portion 610*a* of the instrument main body 610. In an interior of the instrument main body 610, which is enclosed by a top plate 612, a rear plate 613, a left side plate 639L, and a right side plate 639R, a planar speaker unit 630 is disposed at a rear portion 610*b* of the instrument main body 610.

The structure of the planar speaker unit 630 of the electronic keyboard musical instrument according to the ninth embodiment is identical with the structure of the planar speaker 7 according to the first embodiment. The specific example of the planar speaker unit 630 is shown in FIGS. 4A-4D, FIG. 5, and FIGS. 6A-6B.

Above a rear portion KBa of the keyboard portion KB, the instrument main body 610 has a first opening portion 615 (as a first window portion), as shown in FIGS. 30A and 31A. A saran net 616 in which a multiplicity of through-holes are formed is attached to the first opening portion 615. Further, in a key slip portion 614 of the front portion 610*a* of the instrument main body 610, there is provided a second opening portion 617 (as a second window portion) in which a multiplicity of small holes are formed. A saran net may be attached also to the second opening portion 617.

The instrument main body 610 is provided with a fall board 620. The fall board 620 is constituted such that a front lid 621 and a rear lid 622 are pivotably connected by a pivot shaft 623. The fall board 620 is slidably movable in a front-rear direction (i.e., in a depth direction of the musical instrument) along guide grooves (not shown) formed in inner walls of the respective left and right side plates 639L, 639R. The fall board 620 covers the keyboard portion KB from above in a closed state. In an open state shown in FIGS. 30A, 31A, the fall board 620 opens the keyboard portion KB such that the keyboard portion KB is exposed to an exterior, for allowing the musical instrument to be played.

An electronic circuit unit (which is not illustrated in FIG. 30) is disposed below the front lid 621 of the fall board 620 in the open state and on the key bed 611.

In the present embodiment, the top plate 612, the rear plate 613, the first opening 615, the side plates 639, and the key bed 611 constitute a casing of the electronic keyboard musical instrument and define an inner space.

The electronic circuit unit of the electronic keyboard musical instrument according to the ninth embodiment is identical in structure with the electronic circuit in the first embodiment. The specific example of the electronic circuit unit is shown in FIG. 7, for instance. In place of the planar speaker 7 of the first embodiment, the planar speaker unit 630 of the ninth embodiment is disposed.

Not only the electronic circuit unit, but also cone speakers may be disposed below the front lid 621 and on the key bed 611. Where the cone speakers are disposed, opening portions for sound emission are formed in the key bed 611. Owing to the electronic circuit unit, there are generated, from the planar speaker unit 630 (and the cone speakers), electronic musical sounds in accordance with operations by a performer with respect to the keyboard portion KB.

Figure 31B:
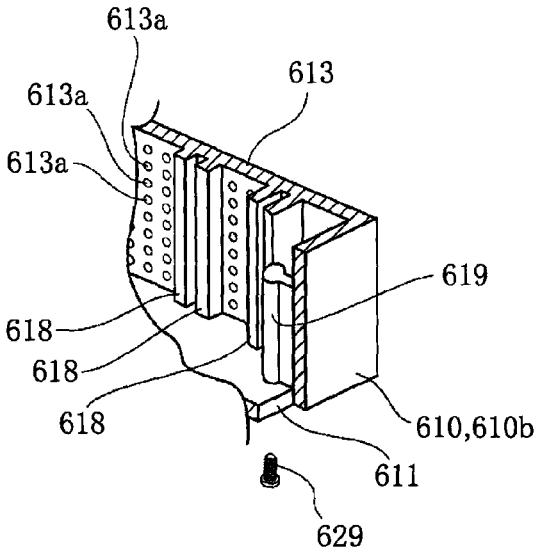
FIG. 31B is a perspective view showing an interior of a right-side rear portion of the instrument main body.
Figure 31C:
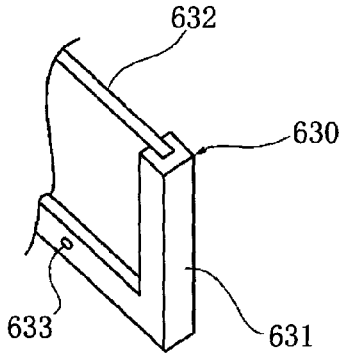
FIG. 31C is a perspective view showing a right-side portion of a planar speaker unit in partial cross section.

FIG. 31B is a perspective view showing an interior of a right-side rear portion of the instrument main body 610, and FIG. 31C is a perspective view showing a right-side portion of the planar speaker unit 630 in partial cross section.

As shown in FIG. 30B, the planar speaker unit 630 is curved so as to protrude rearward in plan view, namely, so as to be convex rearward. As described above, the planar speaker unit 630 is identical in construction with the planar speaker 7 of the first embodiment. The basic structure of the planar speaker unit 630 may be a known structure disclosed in JP-A-2008-227832, for instance. A manner of supplying an electric power to the planar speaker unit 630 may be similar to a manner of electric power supply to the planar speaker 7 in the first embodiment or a manner of electric power supply disclosed in JP-A-2008-227832.

As shown in FIG. 31C, the planar speaker unit 630 is constituted by a generally rectangular frame 631 which is long in the left-right direction and a planar speaker portion 632 supported by the frame 631. While not illustrated in detail, the planar speaker portion 632 is constituted by an electrostatic speaker and has a plate-like structure principally composed of a vibrating plate (diaphragm), insulating members, and fixed electrodes. In FIG. 31C, the thickness of the planar speaker portion 632 is exaggerated, namely, illustrated thicker than actual. Actually, the thickness of the planar speaker portion 632 including the electrodes is as thin as about 1 mm. When a prescribed voltage is applied to the fixed electrodes and a bias voltage is applied onto the vibrating plate, a sound is generated owing to vibration of the vibrating plate by an electrostatic force.

Where the planar speaker portion 632 is disposed so as to extend widely over the entirety of the rear surface of the instrument main body 610, it is possible to generate a sound with a volume level as high as a monitor speaker, only by an audio output signal without applying any bias voltage.

While the frame 631 may be formed to have an arcuate shape shown in FIG. 30B in its free state, the frame 631 may be formed straightly so as to have flexibility to such an extent that the frame 631 can be subjected to flexural deformation into the arcuate shape. The frame 631 is produced by outsert molding in which resin and a metal plate are integrated with each other, for instance. As shown in FIG. 31C, the planar speaker portion 632 is fitted in a groove formed in the frame 631 and is fastened to the frame 631 through a plurality of fastening holes 633, whereby the planar speaker unit 630 is produced.

Where the rear plate 613 is formed of resin, for instance, a multiplicity of small holes 613*a* for sound emission are formed in the rear plate 613, as shown in FIG. 31B. Further, vertically extending bosses 619 are formed at left and right end portions of the rear plate 613. Screws 629 are screwed into the respective bosses 619 from below the bosses 619 via fastening holes of the key bed 611, whereby the key bed 611 and the rear plate 613 are fixed to each other.

A plurality of vertical ribs 618 are formed on the front surface of the rear plate 613. A protruding dimension or height of the vertical ribs 618 by which the vertical ribs 618 protrude from the front surface of the rear plate 613 in a forward direction is determined such that the vertical ribs 613 located nearer to the left and right end portions of the rear plate 613 have a larger protruding dimension or height while the vertical ribs 613 located nearer to the central portion of the rear plate 613 in the left-right direction have a smaller protruding dimension or height. Accordingly, a line that connects front edges of the respective vertical ribs 613 is arcuate in plan view.

The frame 631 of the planar speaker unit 630 is brought into abutting contact with the front edges of the vertical ribs 618 and is screwed between prescribed adjacent two vertical ribs 618. At the same time, the rear surface of the planar speaker portion 632 at an intermediate position in the left-right direction is bonded, by using a double-faced tape or the like, to the front edges of the vertical ribs 618 with a cushioning member such as a felt interposed therebetween. Thus, the planar speaker unit 630 can be disposed so as to be curved into the arcuate shape shown in FIG. 30B. The disposition technique of the planar speaker unit 630 is not limited to that illustrated above.

The planar speaker unit 630 emits a sound in both of the frontward and backward directions. The sound is emitted in the backward direction through the small holes 613*a* (FIG. 31B) of the rear plate 613. Because the planar speaker unit 630 protrudes so as to be convex backward, the sound is widely diffused in the left-right direction, so that the sound is emitted widely and uniformly to the audience present on the back side of the instrument main body 610.

As for emission of the sound generated from the planar speaker unit 630 toward the performer's side (toward the front side of the instrument main body 610), the first opening portion 615 and the second opening portion 617 function as main sound emission portions for emitting a sound toward the performer's side. In this respect, the sound is emitted also through clearances between adjacent keys of the keyboard portion KB and various clearances such as a clearance between the fall board 620 and the instrument main body 610. Because the planar speaker unit 630 protrudes so as to be convex backward, there is ensured a so-called acoustic lens effect, and the sound transmission effect toward the performer's side is increased, as compared with an arrangement in which the planar speaker unit 630 is disposed such that a plane thereof is flat.

During performance of the electronic keyboard musical instrument, the fall board 620 is normally placed in the open state as shown in FIG. 31A. In this instance, a rear end portion 622*a* of the rear lid 622 which functions as a rear end portion of the fall board 620 is located at a position lower than that when the fall board 620 is placed in the closed state. In this embodiment, in particular, the rear end portion 622*a* is located at a position lower than a central position P of the planar speaker unit 630 in the up-down (vertical) direction. Accordingly, the sound generated mainly from a region of the planar speaker unit 30 which is higher than the rear end portion 622*a* passes through a sound emission path R1 above the fall board 620 and is emitted from the first opening portion 615 toward the performer's side. On the other hand, the sound generated mainly from a region of the planar speaker unit 630 which is lower than the rear end portion 622*a* passes through a sound emission path R2 below the fall board 620 and is emitted from the second opening portion 617 toward the performer's side.

Although the region lower than the rear end portion 622*a* is small in this embodiment, the sound emission path is roughly divided into two sections in the up-down (vertical) direction, depending upon the position of the rear end portion 622*a*. Thus, the sound from the planar speaker unit 630 is transmitted toward the performer's side through the first opening portion 615, the second opening portion 617, and various clearances. Accordingly, it is felt as if the entirety of the instrument main body 610 generates a sound. Therefore, the sound from the planar speaker unit 630 becomes closer to the sound of a natural instrument, as compared with an arrangement in which cone speakers for monitor are disposed so as to be oriented to the front side of the instrument main body 610.

The planar speaker unit 630 is disposed on the rear plate 613 at the rear portion 610*b* of the instrument main body 610. Accordingly, this arrangement is advantageous for ensuring a large area and for emitting a sound widely backward. At the same time, the musical instrument is designed such that the sound is emitted toward the performer's side through the inside of the instrument main body 610, so that it is helpful for the performer to monitor the sound. In particular, the planar speaker unit 630 has the arcuate shape in plan view, and the left and right end portions thereof are oriented inward. Hence, there is generated a sound collection effect with respect to the position of the performer, whereby the sound efficiently reaches the performer.

According to the present embodiment, the sound is emitted widely and uniformly in the backward direction (toward the back side), and the sound is efficiently transmitted to the performer. In particular, the provision of the first opening portion 615 and the second opening portion 617 is effective for more efficient transmission of the sound to the performer.

Because the sound emission path R1 is formed over the fall board 620, it is possible to efficiently transmit the sound to the performer's side when the fall board 620 is placed in the open state, even where the planar speaker unit 630 is disposed only at an upper half portion of the instrument main body 610 or even where the second opening portion 617 is not provided. Further, because the sound emission path R2 is formed below the fall board 620, it is possible to efficiently transmit the sound to the performer's side when the fall board 620 is placed in the open state, even where the position of the rear end portion is relatively high in the open state of the fall board 620 or even where the first opening portion 615 is not provided.

In the illustrated ninth embodiment, the planar speaker unit 630 is disposed at the rear portion of the interior of the electronic keyboard musical instrument, so as to be convex rearward in plan view. The planar speaker unit may have a flat shape. That is, the electronic keyboard musical instrument may have a casing constituted by a bottom surface portion, an upper surface portion, a side surface portion (a left surface portion, a right surface portion, and a rear surface portion), and a front surface portion, and a planar speaker having a flat shape (i.e., flat planar speaker) may be disposed at a rear portion of an inside of the casing.

It is preferable that the flat planar speaker be disposed such that its plane is substantially parallel to the left-right direction of the musical instrument (i.e., the key arrangement direction in which the keys of the keyboard portion are arranged). However, the flat planar speaker may be disposed such that an angle defined by the plane of the flat planar speaker and the left-right direction is within 30°.

In the illustrated ninth embodiment, the multiplicity of small holes 613*a* for sound emission are formed in the rear plate 613. The small holes 613*a* may be formed in the left and right side plates, in addition to the rear plate 613. Such an arrangement will be explained below as a modified example of the ninth embodiment.

Figure 31D:
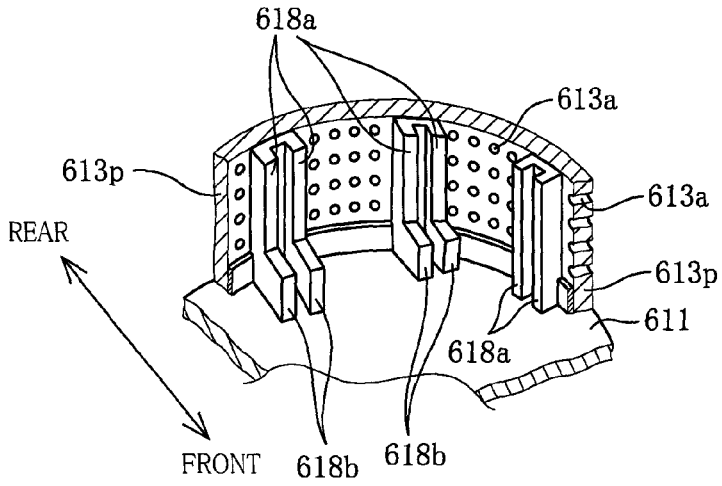
FIG. 31D is a perspective view showing an interior of a right-side rear portion of the instrument main body according to a modified example of the ninth embodiment.

FIG. 31D is a perspective view showing an interior of a right-side rear portion of the instrument main body 610. A side plate 613*p* in this modified example is formed such that a left side surface, a rear surface, and a right side surface are continuous to each other so as to have an arcuate shape. The radius of curvature of the arc at each of various portions of the side plate 613*p* may not be necessarily constant. For instance, the radius of the rear surface portion may be larger than the radius of the side surface portion.

As shown in FIG. 31D, the side plate 613*p* has small holes 613*a* for sound emission formed in its rear surface portion. The side plate 613*p* further has the small holes 613*a* formed in its right side surface portion. While not illustrated, the small holes 613*a* are formed in the left side surface portion.

Figure 31E:
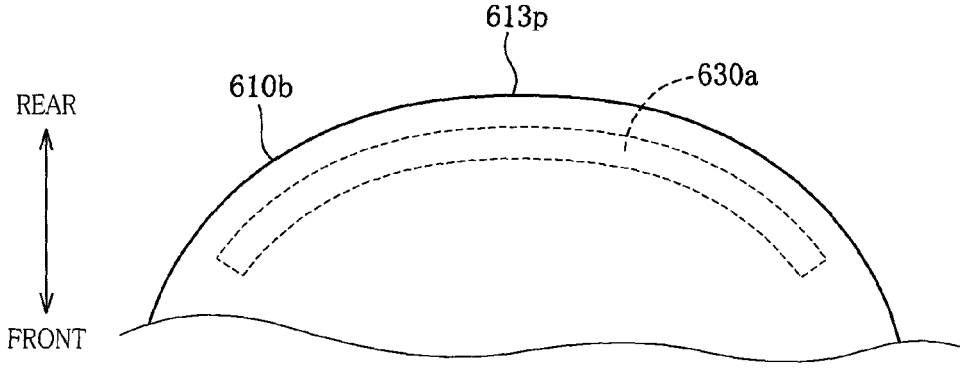
FIGS. 31E, 31F are plan views each showing a rear portion of the electronic keyboard musical instrument according to the modified example.

The planar speaker unit is disposed on the side plate 613*p*. A plurality of vertical ribs 618*a*, 618*b* are formed on an inner surface of the side plate 613*p*. The vertical ribs 618*a* are for holding a planar speaker unit 630*a* such that the planar speaker unit 630*a* has an arcuate shape in plan view. Abutting surfaces of the vertical ribs 618*a* with which the planar speaker unit 630*a* comes into abutting contact are formed so as to be curved along the inner surface of the side plate 613*p*. The vertical ribs 618*a* have the same protruding amount or height from the inner surface of the side plate 613*p*. The planar speaker unit 630*a* is brought into engagement with the side plate 613*p*, such that the planar speaker unit 630*a* is fixed by tapping screws in a groove between adjacent two vertical ribs 618*a* through a plurality of fastening holes 633 of the frame 631. The planar speaker unit 630*a* which is thus held in engagement with the side plate 613*p* is held so as to have the arcuate shape in plan view, as shown in FIG. 31E. FIG. 31E is a plan view of the rear portion of the electronic keyboard musical instrument.

Figure 31F:
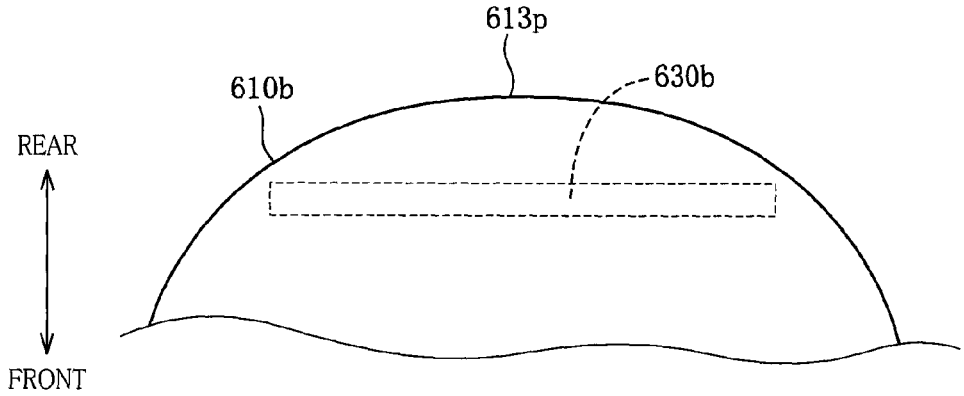

The vertical ribs 618*b* are for holding a planar speaker unit 630*b* such that the planar speaker unit 630*b* has a straight shape in plan view. Abutting surfaces of the vertical ribs 618*b* with which the planar speaker unit 630*b* comes into abutting contact are formed so as to be located on one plane which is perpendicular to the front-rear direction of the musical instrument. The planar speaker unit 630*b* is brought into engagement with the side plate 613*p*, such that the planar speaker unit 630*b* is fixed by tapping screws in a groove between adjacent two vertical ribs 618*b* through a plurality of fastening holes 633 of the frame 631. The planar speaker unit 630*b* which is thus held in engagement with the side plate 613*p* is held so as to have the straight shape in plan view, as shown in FIG. 31F. FIG. 31F is a plan view of the rear portion of the electronic keyboard musical instrument. While not shown in FIG. 31D, the vertical ribs 618*b* are similarly formed on the upper portion of the side plate 613*p*.

As explained above, in the electronic keyboard musical instrument of the modified example, the small holes 613*a* for sound emission are formed on the rear surface portion, the left side surface portion, and the right side surface portion of the side plate 613*p*. Accordingly, the sound of the planar speaker unit 630 can be emitted to the sides of the musical instrument, namely, in the lateral direction of the musical instrument. The placement of the planar unit speaker 630*a* shown in FIG. 31E is suitable when the electronic keyboard musical instrument is played on a stage in concerts, for instance. In concerts, the electronic keyboard musical instrument is generally disposed such that the right side surface of the musical instrument is seen by audience present at a position lower than the stage. Accordingly, the sound from the planar speaker unit 630*a* is emitted from the right side surface, ensuring good sound emission to the audience. Where it is desirable that the sound be emitted from only the right side surface of the musical instrument, there may be used, in place of the planar speaker unit 630*a* shown in FIG. 31E, a planar speaker unit without a left side surface portion, namely, a planar speaker unit constituted by a rear surface portion and a right side surface portion.

In the electronic keyboard musical instrument constructed as described above, the planar speaker unit 630*b* having the flat shape can be disposed owing to the vertical ribs 618*b*, whereby it is possible to emit the sound only in the frontward direction and the rearward direction. The placement of the planar speaker unit 630*b* shown in FIG. 31F is suitable when the performer listens to his/her performance at home, for instance.

As apparent from FIGS. 31E, 31F, the planar speaker unit 630*a* of FIG. 31E has a width (breadth) larger than that of the planar speaker unit 630*b* of FIG. 31F.

Tenth Embodiment

Figure 32A:
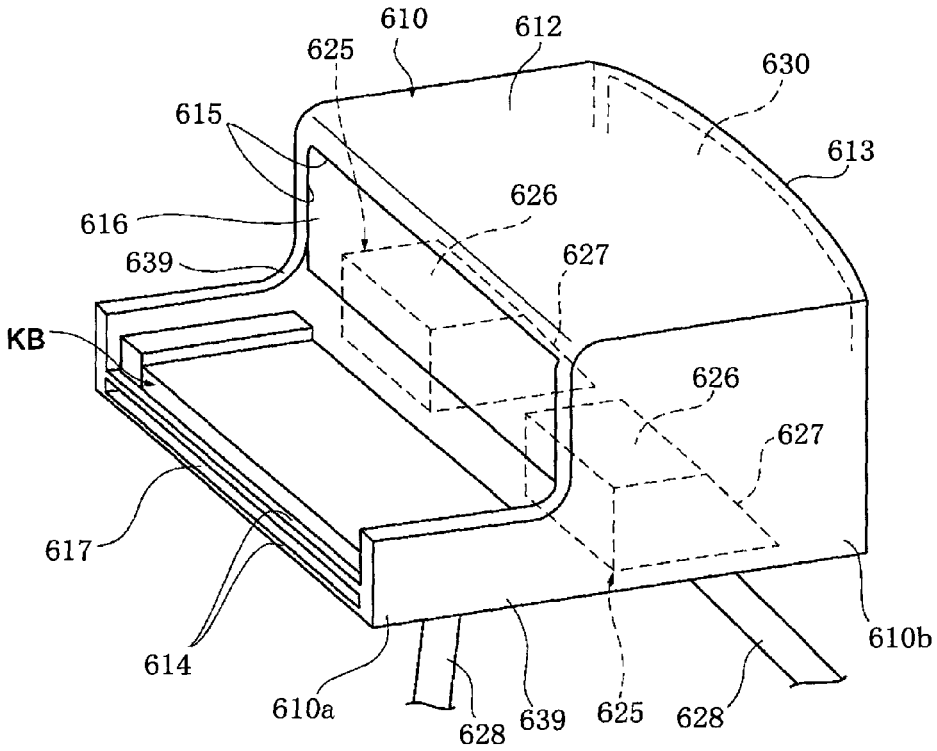
FIG. 32A is a perspective view of an electronic keyboard musical instrument according to a tenth embodiment of the present invention and FIG. 32B is a schematic side view of the instrument main body.
Figure 32B:
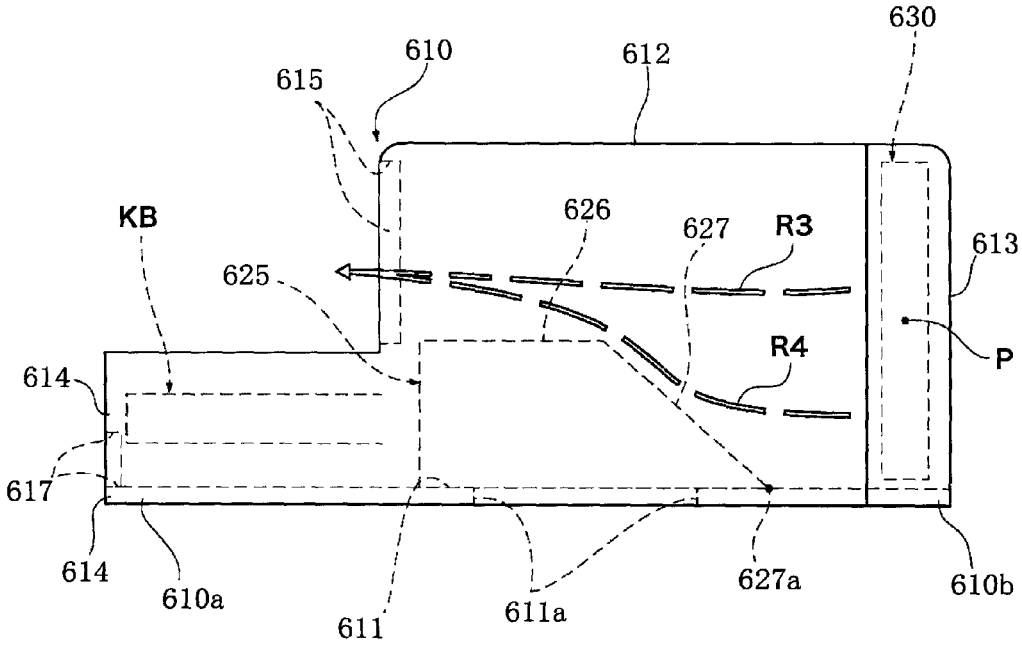

FIG. 32A is a perspective view of an electronic keyboard musical instrument according to a tenth embodiment of the present invention. FIG. 32B is a schematic side view of the instrument main body 610.

The tenth embodiment is identical in construction with the ninth embodiment except for the following points. In the electronic keyboard musical instrument of the tenth embodiment, the fall board 620 is eliminated. Further, the configuration of the rear plate 613 is modified. Moreover, speaker boxes 625 are disposed in such a way that the sound transmission paths are efficiently formed.

As in the ninth embodiment illustrated above, in the tenth embodiment, the top plate 612, the rear plate 613, the first opening 615, the side plates 639, and the key bed 611 constitute a casing of the electronic keyboard musical instrument and define an inner space.

As shown in FIGS. 32A and 32B, a pair of speaker boxes 625, i.e., a left and right speaker boxes 625, are disposed on the key bed 611 in the inside of the instrument main body 610 behind the keyboard portion KB. Each speaker box 625 has a cone speaker (not shown) and is configured to emit a sound from a sound emission portion 611*a* formed in the key bed so as to be open downward. The left and right speaker boxes 625 are formed symmetrically with respect to each other. An upper surface 626 of a front half portion of each speaker box 625 is horizontal while an upper surface of a rear half portion (or a back surface) of each speaker box 625 is formed as an inclined surface 627. The inclined surface 627 has a height which becomes lower toward the back side of the musical instrument. A rear end portion 627*a* of the inclined surface 627 which functions as a rear end portion of each speaker box 625 is located at a height position that is substantially equal to that of the upper surface of the key bed 611.

The curved shape of the planar speaker unit 630 is the same as in the ninth embodiment. However, the rear plate 613 is curved in advance so as to be convex backward. The protruding dimension or height of the vertical ribs 618 (FIG. 31B) by which the vertical ribs 618 protrude form the rear plate 613 in the frontward direction is made uniform in this embodiment. Accordingly, the planar speaker unit 630 is disposed along the curved surface of the rear plate 613 which is formed in the curved shape in advance. In terms of the external design of a grand piano, the planar speaker unit 630 can be installed along the rear-side curved surface of the instrument main body 610 without wasted space, so that there is little design limitation.

In the arrangement described above, the sound is emitted from the planar speaker unit 630 in the backward direction (toward the back side) in a manner similar to that in the ninth embodiment, namely, the sound is emitted through the small holes 613*a* of the rear plate 613. On the other hand, the sound is emitted toward the performer's side (toward the front side) as shown in FIG. 32B. More specifically, the sound generated from a region of the planar speaker unit 630 which is higher than the upper surface 626 of each speaker box 625 is emitted toward the performer's side from the first opening portion 615 mainly through a sound emission path R3 which is located at a higher position than the upper surface 626 of the speaker box 625. The sound generated from a region of planar speaker unit 630 which is lower than the upper surface 626 of each speaker box 625 is emitted toward the performer's side from the first opening portion 615 mainly through a sound emission path R4 along the inclined surface 627 and the upper surface 626 of the speaker box 625. The inclined surface 627 permits the sound to be reflected thereon so as to be directed in the frontward direction.

The electronic circuit unit (not shown) is disposed between the two speaker boxes 625, for instance, and has an inclined rear surface similar to the inclined surface 627 of each speaker box 625. Accordingly, in a region where the electronic circuit unit is disposed, the sound is emitted passing through a path similar to the sound emission paths R3, R4. Because there are, in the instrument main body 610, spaces in which the speaker boxes 625 and the electronic circuit unit are not present, the sound is partly transmitted toward the performer's side via the second opening portion 617, the above-indicated spaces, and various clearances.

The present embodiment ensures advantages similar to those in the illustrated ninth embodiment. That is, the sound is emitted widely and uniformly in the backward direction (toward the back side), and the sound is efficiently transmitted to the performer. In particular, the upper surface of the rear portion of each speaker box 625 is formed as the inclined surface 627, so that the sound can be efficiently transmitted toward the performer's side in an arrangement in which the speaker boxes 625 are incorporated in the instrument main body 610.

It is preferable that the rear end portion 627*a* of the inclined surface 627 be located at a lower position. Where the rear end portion 627*a* is located at a position lower than the highest position of each speaker box 625 and lower than the central position P of the planar speaker unit 630, it is possible to ensure minimum sound emission efficiency from the first opening portion 615.

In the ninth and tenth embodiments, the planar speaker unit 630 is disposed such that the plane (the front and rear surfaces) thereof are parallel to the vertical direction. As shown in a modified example of FIG. 33, the planar speaker unit 630 may be disposed such that the plane thereof is inclined with respect to the front-rear direction. For instance, the planar speaker unit 630 may be inclined backward, such that the front surface of the planar speaker unit 630 confronts directly the first opening portion 615, in plan view. More specifically, the planar speaker unit 630 may be inclined such that the plane thereof becomes perpendicular with respect to a straight line L which connects the central position P of the planar speaker unit 630 and a central position P2 of the first opening portion 615, in the up-down direction, in plan view. The arrangement further enhances the sound emission efficiency toward the performer's side through the first opening portion 615.

Figure 33:
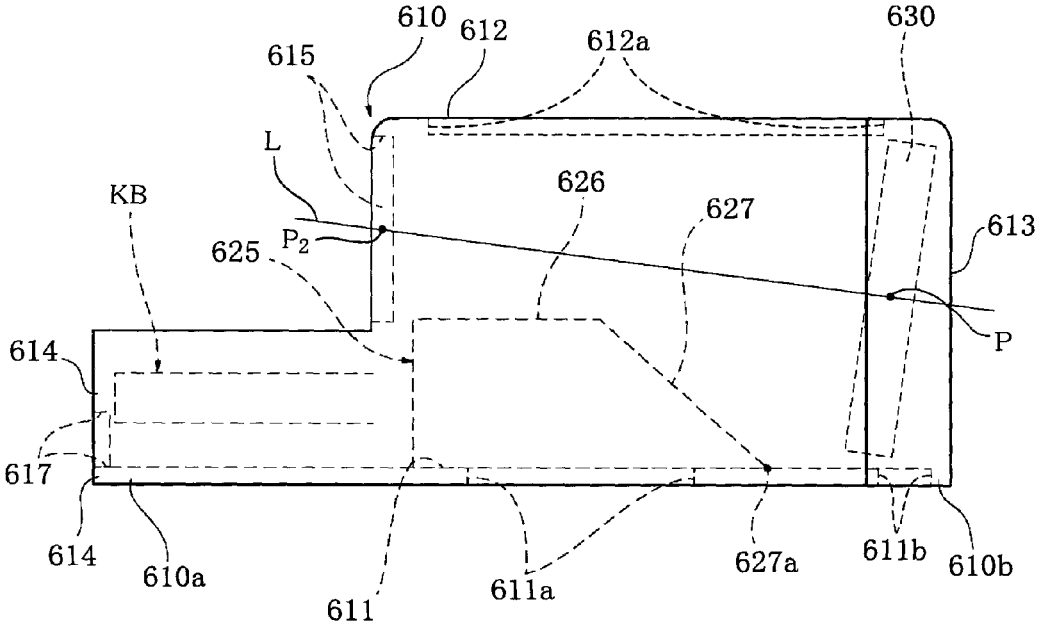
FIG. 33 is a schematic view showing a modified example of disposition of the planar speaker unit.

As shown in FIG. 33, a key-bed rear portion 611*b* which is a part of the key bed 611 and which is nearer to the rear plate 613, more specifically, the key-bed rear portion 611*b* which includes a part of the key bed 611 that is located more backward than the most forward end of the rear surface of the planar speaker unit 630, may be formed with a multiplicity of small holes for sound emission, like the rear plate 613. In this instance, the sound generated on the rear surface of the planar speaker unit 630 can be emitted to the exterior through the key-bed rear portion 611*b*.

Further, as shown in FIG. 33, a top-plate front portion 612*a* which is a part of the top plate 612 and which is located more frontward than the most backward end of the front surface of the planar speaker unit 630 may be formed with a multiplicity of small holes for sound emission, like the rear plate 613. In this instance, the sound generated on the front surface of the planar speaker unit 630 can be emitted to the exterior through the top-plate front portion 612*a*.

A saran net may be attached to an outer surface of each of the key-bed rear portion 611*b* and the top-plate front portion 612*a*.

As shown in FIG. 33, the sound generated in each of the cone speakers in the speaker boxes 625 is emitted to the exterior through the sound emission portion 611*a*. The cone speaker may be disposed so as to be oriented upward, whereby the sound generated in the cone speaker may be emitted to the exterior through the top-plate front portion 612*a*. Alternatively, the cone speaker may be disposed so as to be oriented backward, whereby the sound generated in the cone speaker may be emitted to the exterior through the key-bed rear portion 611*b*.

The illustrated embodiments may be partially combined. For instance, there may be employed a structure in which the fall board 620 is provided and the rear plate 613 is curved in advance. Further, there may be employed a structure in which the planar speaker unit 630 is provided and the rear plate 613 is straight in the lent-right direction.

What is claimed is:

1. An electronic keyboard musical instrument comprising:

an instrument main body having a casing;

a left leg body and a right leg body that support the instrument main body at a left portion and a right portion of the instrument main body, respectively;

a keyboard portion including a plurality of keys as performance operating elements;

a musical-sound-signal generating portion configured to generate a musical sound signal by a key operation of the keyboard portion;

at least one planar speaker configured to output sound in accordance with the musical sound signal generated by the musical-sound-signal generating portion; and a holding portion configured to hold the planar speaker in an arbitrary state between the left leg body and the right leg body, wherein the planar speaker includes a plurality of superposed flexible layers that at least include a vibrating layer and electrode layers that sandwich the vibrating layer from opposite sides of the vibrating layer, wherein the planar speaker is disposed inside the casing or disposed at a portion of a surface of the casing, and wherein the holding portion is configured to hold not only the planar speaker in a state before a configuration of a plane of the planar speaker changes, but also the planar speaker in a state after the configuration of the plane of the planar speaker is changed.

2. The electronic keyboard musical instrument according to claim 1, wherein the planar speaker is disposed at a rear portion of the inside of the casing, and is curved so as to have a convex shape, in plan view, in a backward direction of the electronic keyboard musical instrument.

3. The electronic keyboard musical instrument according to claim 2, further comprising a first window portion, which is provided above a rear portion of the keyboard portion, through which the sound generated from the planar speaker is transmitted to a performer's side.

4. The electronic keyboard musical instrument according to claim 1, wherein:

the casing includes a side-surface portion, a roof portion, and a bottom-surface portion, and the planar speaker is disposed at at least one of the side-surface portion, the roof portion, or the bottom-surface portion.

5. The electronic keyboard musical instrument according to claim 4, wherein:

the roof portion includes a roof plate at which the planar speaker is disposed, the roof plate is pivotally attached to the instrument main body so as to be pivotable about an axis that extends along one side of the roof plate, to allow the roof plate to open and close an upper portion of the instrument main body, and the planar speaker disposed at the roof plate is provided along a back surface of the roof plate and is exposed to an exterior when the upper portion of the instrument main body is opened by a pivotal movement of the roof plate.

6. The electronic keyboard musical instrument according to claim 4, wherein:

the side-surface portion includes a left side-surface portion and a right side-surface portion, the electronic keyboard musical instrument further comprises a lid body disposed to cover the planar speaker disposed along the side-surface portion of the casing, the lid body is configured to be moved selectively between a position at which the planar speaker is exposed to an exterior and a position at which the planar speaker is not exposed to the exterior, and the planar speaker and the lid body are disposed at at least one of the left side-surface portion or the right surface-side portion.

7. The electronic keyboard musical instrument according to claim 4, wherein:

the side-surface portion includes a left side-surface portion, a right side-surface portion, and a rear-surface portion, the planar speaker is disposed at (a) at least one of the left side-surface portion or the right side-surface portion and (b) the rear-surface portion, and the electronic keyboard musical instrument further comprises an acoustic reflection plate configured to pivot about an axis that extends along adjoining sides of the left side-surface portion and the rear-surface portion at which the planar speaker is disposed, or an axis that extends along adjoining sides of the right side-surface portion and the rear-surface portion at which the planar speaker is disposed.

8. The electronic keyboard musical instrument according to claim 1, wherein the holding portion is configured to hold the planar speaker at least in a state in which the plane of the planar speaker is bent as a whole.

9. The electronic keyboard musical instrument according to claim 1, wherein:

the planar speaker comprises a plurality of planar speaker panels with respective peripheries thereof supported by respective frames, a connected planar speaker panel comprising at least two of the plurality of planar speaker panels with the respective frames of any adjacent planar speaker panels connected with connecting members, an upper end of the connected planar speaker panel is held between the left leg body and the right leg body so as to be a fixed end while a lower end of the connected planar speaker panel is a free end, and the holding portion is configured to hold the connected planar speaker panel at least in a state in which planes of the respective planar speaker portions of the planar speaker panels of the connected planar speaker panel are bent as a whole.

10. The electronic keyboard musical instrument according to claim 9, further comprising:

guide members provided on the left leg body and the right leg body, respectively, wherein the connected planar speaker panel includes, at a left end and a right end thereof, further guided members whose movements are regulated by the corresponding guide members, wherein the connected planar speaker is configured to allow the further guided members to move relative to the corresponding guide members while the movements of the further guided members are regulated by the corresponding guide members, to change a state of the planar speaker, and wherein the connected planar speaker is held in a state in which the planes of the respective planar speaker portions of the planar speaker panels of the connected planar speaker panel are bent as a whole.

11. The electronic keyboard musical instrument according to claim 1, wherein:

an upper end of the planar speaker is held between the left leg body and the right leg body so as to be a fixed end while a lower end of the planar speaker is a free end, the electronic keyboard musical instrument further comprises:

a guide member configured to come into contact with a plane of the planar speaker to place the plane of the planar speaker in a bent state; and a connecting member configured to be connected to the lower end of the planar speaker, and wherein the lower end is connected to the connecting member after the plane of the planar speaker has been bent, to enable the planar speaker to be held in the state in which the plane thereof is bent.

12. The electronic keyboard musical instrument according to claim 1, wherein:

the casing includes:

a bottom surface portion;

an upper surface portion;

a side surface portion including a left surface portion, a right surface portion, and a rear surface portion; and a front surface portion having a first window portion, the planar speaker is disposed at a rear portion of the inside of the casing along at least the rear surface portion, and a sound emission path extends from the planar speaker to the first window portion.

13. The electronic keyboard musical instrument according to claim 1, wherein an air layer is formed between the planar speaker the surface of the casing.

14. An electronic keyboard musical instrument comprising:

an instrument main body having a casing;

a keyboard portion including a plurality of keys as performance operating elements;

a musical-sound-signal generating portion configured to generate a musical sound signal by a key operation of the keyboard portion; and an internal speaker configured to output sound in accordance with the musical sound signal generated by the musical-sound-signal generating portion;

a first output terminal configured to amplify the musical sound signal generated by the musical-sound-signal generating portion and output the amplified signal to an exterior;

a second output terminal configured to output a drive signal to a planar speaker having a plurality of flexible layers that at least include a vibrating layer and electrode layers that sandwich the vibrating layer form opposite sides of the vibrating layer; and a planar-speaker drive circuit that amplifies the musical sound signal generated by the musical-sound-signal generating portion, wherein the amplified signal is boosted by a booster portion, and the drive signal on which a high bias voltage is superimposed is supplied to the second output terminal, wherein the casing includes a plurality of retaining portions, wherein the planar speaker includes a plurality of engaging portions corresponding to the plurality of retaining portions, wherein each of the retaining portions is provided with the second output terminal for a corresponding one of electrodes of the planar speaker, wherein each of the engaging portions is provided with an input terminal connected to a corresponding one of the electrodes of the planar speaker, the input terminals of the engaging portions respectively corresponding to the second output terminals of the retaining portions, and wherein the planar speaker is attached to and held by the electronic keyboard musical instrument by engagement of the engaging portions and the retaining portions.

15. The electronic keyboard musical instrument according to claim 14, wherein the planar speaker is detachable from the casing and is disposed outside the casing.

* * * * *